US009072393B2

(12) United States Patent
Friedman et al.

(10) Patent No.: US 9,072,393 B2
(45) Date of Patent: Jul. 7, 2015

(54) PORTABLE BEACH CHAIR COVER

(76) Inventors: David Friedman, Monroe, NY (US); Zalman Sofer, Monroe, NY (US)

( * ) Notice: Subject to any disclaimer, the term of this patent is extended or adjusted under 35 U.S.C. 154(b) by 0 days.

(21) Appl. No.: 12/658,769

(22) Filed: Feb. 9, 2010

(65) Prior Publication Data

US 2011/0198895 A1 Aug. 18, 2011

Related U.S. Application Data

(60) Provisional application No. 61/207,717, filed on Feb. 12, 2009.

(51) Int. Cl.

| | |
|---|---|
| ***A47C 31/11*** | (2006.01) |
| ***A47C 1/14*** | (2006.01) |
| ***A47C 7/62*** | (2006.01) |

(52) U.S. Cl.
CPC . *A47C 31/11* (2013.01); *A47C 1/14* (2013.01); *A47C 7/62* (2013.01)

(58) Field of Classification Search
USPC ..... 297/219.1, 228.1, 220
See application file for complete search history.

(56) References Cited

U.S. PATENT DOCUMENTS

| | | | | |
|---|---|---|---|---|
| 4,277,859 | A * | 7/1981 | Seaman | 5/639 |
| 4,877,288 | A * | 10/1989 | Lee | 297/229 |
| 4,991,245 | A * | 2/1991 | Franco | 5/419 |
| 5,275,463 | A * | 1/1994 | Rocha | 297/229 |
| D359,411 | S * | 6/1995 | Wade | D6/610 |
| 5,620,229 | A * | 4/1997 | Ledford | 297/229 |
| 5,644,807 | A * | 7/1997 | Battistella | 5/419 |
| 6,626,491 | B1 * | 9/2003 | Blome et al. | 297/229 |
| 6,783,175 | B1 * | 8/2004 | Henderson | 297/4 |
| 6,848,746 | B2 * | 2/2005 | Gentry | 297/380 |
| 7,076,816 | B1 * | 7/2006 | Nielsen et al. | 5/417 |
| D598,182 | S * | 8/2009 | Vossoughi et al. | D2/861 |
| 8,122,538 | B2 * | 2/2012 | McBrearty | 5/417 |
| 2005/0016872 | A1 * | 1/2005 | Johnson | 206/77.1 |

* cited by examiner

*Primary Examiner* — Sarah B McPartlin
(74) *Attorney, Agent, or Firm* — Kramer Levin Naftalis & Frankel LLP

(57) ABSTRACT

A beach chair cover has a slip-over pouch which slides over the upper portion of a beach or lounge chair, with a lower portion that affixes to a beach chair. The cover has pockets hanging off of its sides, to hold various objects. The pockets can be open, or closable via a fastening device, with fold over flap. Underneath the cover's lower portion is a hidden pouch, securable via a small lock, or otherwise. The pouch, invisible to passers-by, can hold wallets, cash, or other items. The cover can have a series of sewn-in loops, e.g., on its sides, which can hold a wire for earphones or a small speaker. The beach chair cover can be folded up into a slip-over pouch, and carried by means of an integrated handle.

20 Claims, 61 Drawing Sheets
(61 of 61 Drawing Sheet(s) Filed in Color)

PORTABLE BEACH CHAIR COVER

CROSS REFERENCE TO RELATED APPLICATIONS

This application claims the benefit of U.S. Provisional Patent Application No. 61/207,717, filed on Feb. 12, 2009, which is hereby fully incorporated herein by reference.

TECHNICAL FIELD

The present invention relates to recreational furniture and accessories, and more particularly to a beach chair cover and organizer that can readily be folded into a portable sac.

BACKGROUND OF THE INVENTION

People often go to the beach or sit by the side of a swimming pool for long hours during warmer weather. This activity often occurs in semi-pubic venues such as, for example, a beach club or a communal swimming pool, or, for example, on a cruise ship. In each of these venues there are generally multiple beach chairs provided for the attendees, members of the club, or guests. People often compete for the better chairs and the better locations. This competition is often expressed through bathers placing their paraphernalia on the beach chair, including their towel. They then may go off, for example, to swim, to chat, or to eat, and then return, hoping to find their belongings intact. Sometimes they spread out their towel on the beach chair before they leave, with some personal belongings spread over it.

Often upon return, they have been swimming and they want to sit on their beach chair. If not having done so previously, they spread out their towel and lie on the chair. The problem with this procedure is that the towel is not affixed to the beach chair, and thus it can move around, and in fact, often falls down, remaining only half on the beach or lounge chair and half off.

Another problem with this mode of beach chair use is that bathers often bring suntan lotion, sunglasses, an iPod or other media player, music player, etc., a book to read, their wallet with their valuables, as well as other assorted items with them to their beach chair. When they get up to go swimming or to go buy a drink they do not wish to carry all this paraphernalia with them. However, at the same time, they are concerned that their paraphernalia, especially their wallet and valuables, could be stolen.

Finally, people often enjoying resting their head on more than just the flat surface of a beach chair as may be covered by a towel or beach chair cover. However, to carry a portable pillow is a further addition to what is often a burdensome set of objects and paraphernalia and most people tend to be reluctant to do it. Moreover, the pillows people tend to have at home are neither waterproof nor designed for poolside use so they often go without.

What is needed is a device that can enhance a beach or lounge chair experience and at the same time address the above-mentioned problems in the prior art.

SUMMARY OF THE INVENTION

A portable beach chair cover is presented. In exemplary embodiments of the present invention a portable beach chair cover has a fold which slides over the head or upper portion of a beach or lounge chair, and has ties clasps to affix a lower or footward portion to a beach chair. In exemplary embodiments of the present invention there can be a number of pockets hanging off of the sides of the beach chair cover in which can be stored sunglasses, suntan lotion, books, coins, portable digital devices and other small devices or objects which a beach chair user would find convenient. In exemplary embodiments of the present invention such pockets can be open, or can be closed via a zipper, VELCRO, "hook and loop", "burr" and "touch", or other fastening device, and can also, for example, have a fold over flap to further secure the objects inside. In exemplary embodiments of the present invention the pockets themselves can have tiny locks such as are commonly found in luggage, for added security. In exemplary embodiments of the present invention, underneath the foot portion of the beach chair cover can be a pouch which is only visible when the lower end of the beach chair is pulled up and over to expose it. This pouch can be zippered and further secured by means of a small lock, or can be closed with a fold over flap secured by VELCRO, "hook and loop", "burr" and "touch", or other known closure mechanisms. Inside this pocket, which is invisible to someone looking at the beach chair cover in its normal configuration on a beach chair, a user may place his wallet, cash, valuables and any other items he does not wish to be immediate visible to a casual observer or passer-by. In exemplary embodiments of the present invention, there can be, for example, a series of loops sewn into one or both of the sides of the beach chair cover, and made adjacent to one of the above-described pockets, such that a cord or wire can be run from a device placed in the pocket. Such devices can include a cell phone, iPod or other media player, BlackBerry, MP3 player, or the like. The cord can run through the loops and up to either the user's ear (if an earphone) or to a small speaker which can be clasped to the upper portion of the beach chair. In such exemplary embodiments a user can conveniently organize and store the electronic device in its provided pocket and have a well-organized and neatly placed wire running through such loops. In exemplary embodiments of the present invention, the beach chair cover can have a foot protector, being a pouch at or near its footward edge.

In exemplary embodiments of the present invention, the entire beach chair cover can be folded up into the slip-over pouch, and carried by means of a handle attached to the beach chair cover.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 40 is a close up of the exemplary beach chair cover shown with its under side upwards in a slightly folded position. The view at the right side of the picture is the head end of the underside of the exemplary beach chair cover;

FIG. 41 is a close up of the ties used to affix the beach chair cover to a beach chair;

FIG. 42 shows a close up of the ties and the underside hidden closable pouch folded over;

FIG. 43 is a close up of the three loops of an exemplary beach chair cover;

FIGS. 44-45 depict wider angle views of the same three loops and an exemplary single side-pocket;

FIG. 46 depicts the underside of the footward portion of exemplary beach chair according to an exemplary embodiment of the present invention;

FIG. 47 is a close up of an exemplary double side-pocket folded over and sitting on the beach chair cover underside so that its front side can be seen;

FIG. 48 is the corresponding double side-pocket on the other side of the exemplary beach chair cover of FIG. 47;

FIG. 49 is a single pocket pouch of the beach chair cover shown in FIGS. 44 and 45, now folded over so that its upward side can be seen;

FIG. 50 is a long angle shot from the underside of the headward portion of an exemplary beach chair cover with two double pocket pouches as well as a single pocket pouch folded over so that their respective upwards, or outward, sides, can be readily seen;

FIG. 51 depicts the view of FIG. 46 from a slightly different angle;

FIG. 52 is a close up of the underside of a zipper pouch of an exemplary beach chair cover with the zipper unzipped;

FIG. 53 depicts an exemplary double pocket pouch and ties on the left side of the exemplary beach chair cover near a footward portion;

FIG. 54 depicts a view from behind of the exemplary beach chair cover with the headward slip-over portion hanging down;

FIG. 55 depicts the right side of the exemplary beach chair cover with two doubleside-pockets and a single pocket;

FIG. 56 depicts the left side of the exemplary beach chair cover with a double side-pocket and footward ties in the untied position;

FIG. 57 depicts the right side of the headward portion of the exemplary beach chair cover showing the loops in a single pocket pouch designed to hold a media player;

FIGS. 58 and 59 respectively depict normal and folded back positions of the footward closable pouch of the exemplary beach chair cover;

It is noted that the patent or application file contains at least one drawing executed in color. Copies of this patent or patent application publication with color drawings will be provided by the U.S. Patent Office upon request and payment of the necessary fees.

DETAILED DESCRIPTION OF THE INVENTION

Figure 1:
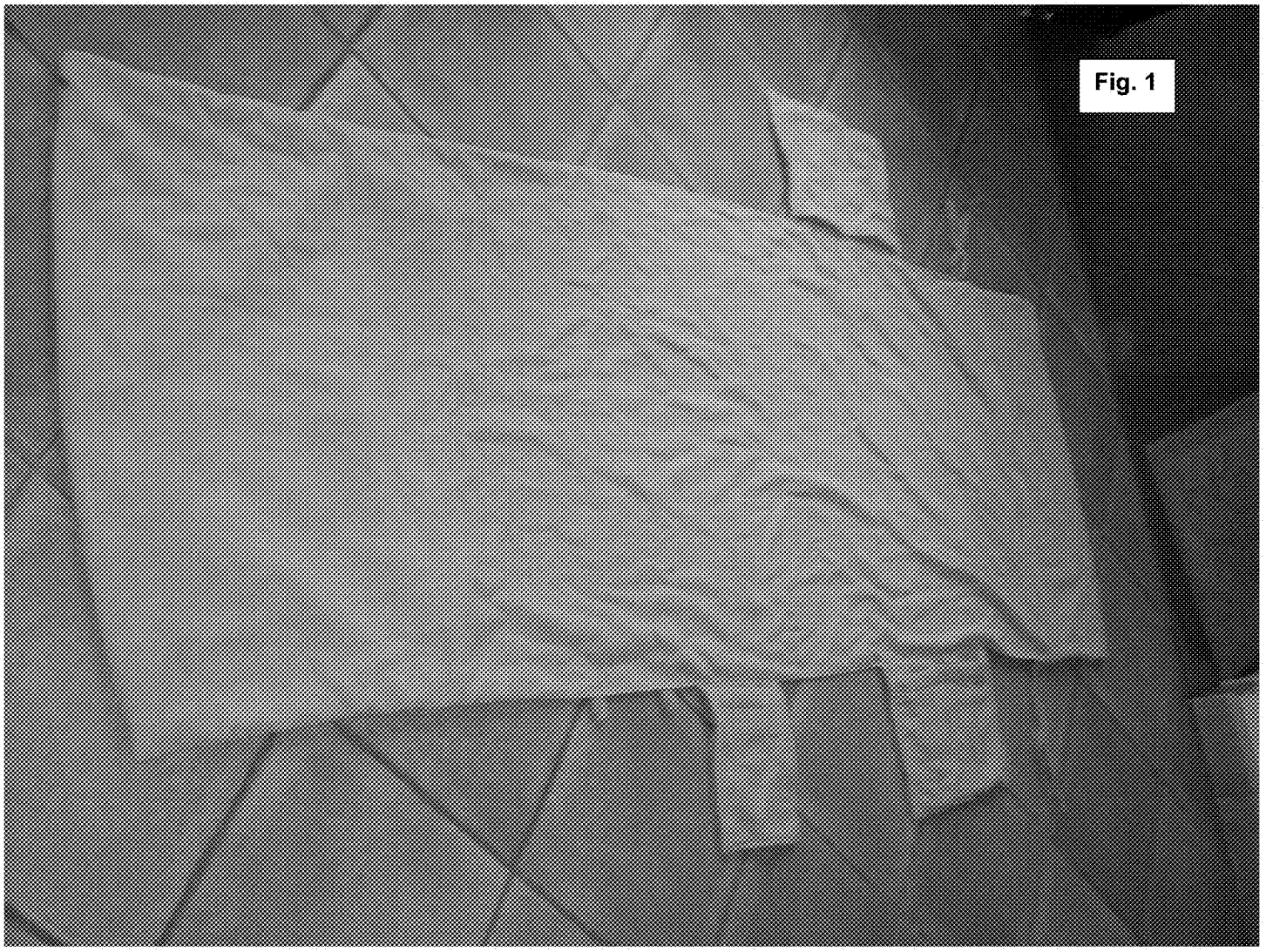
FIG. 1 depicts a beach chair cover according to an exemplary embodiment of the present invention spread out horizontally.
Figure 2:
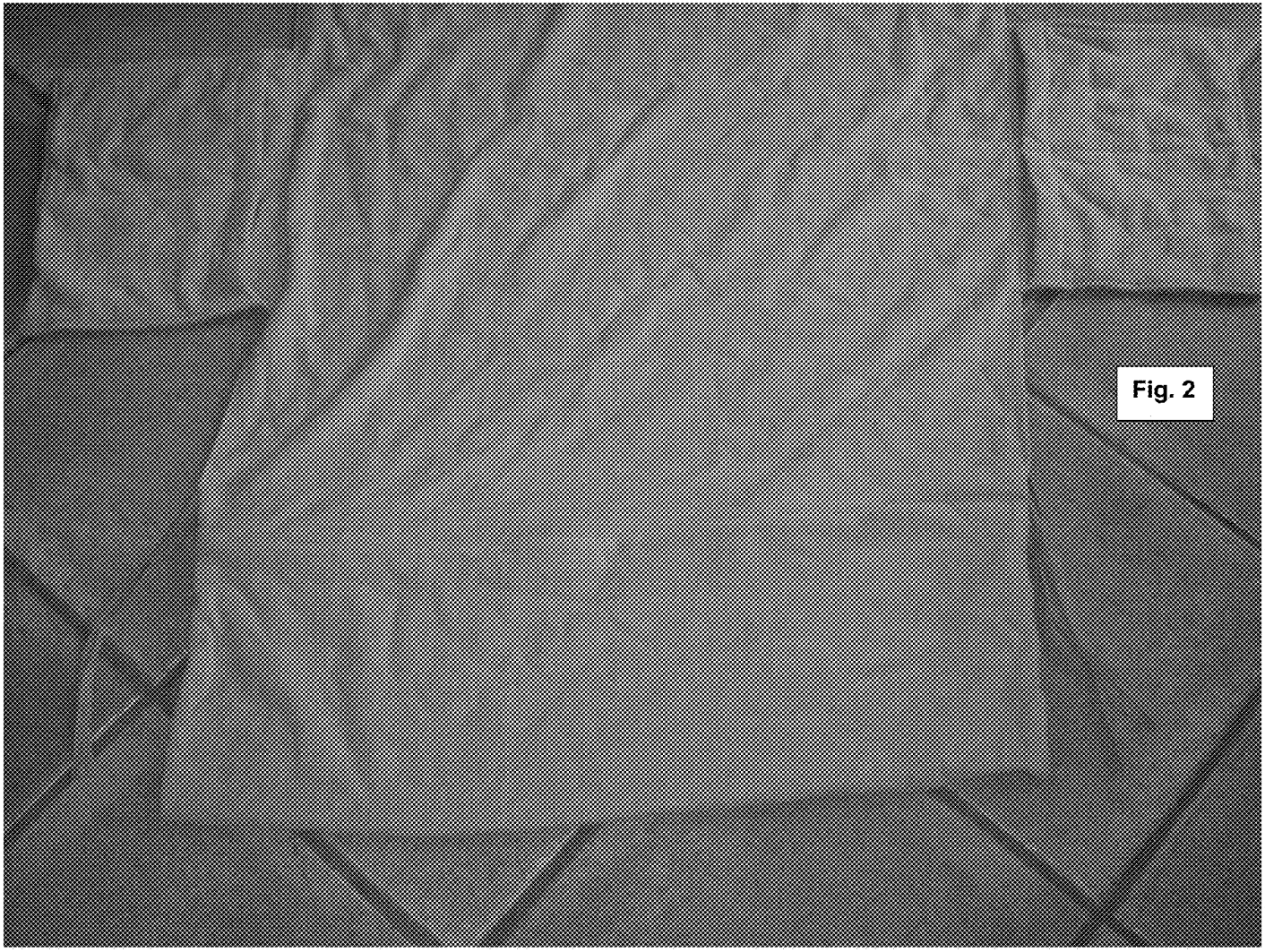
FIG. 2 is a close-up of the lower or footward portion of the exemplary beach chair cover of FIG. 1.
Figure 61:
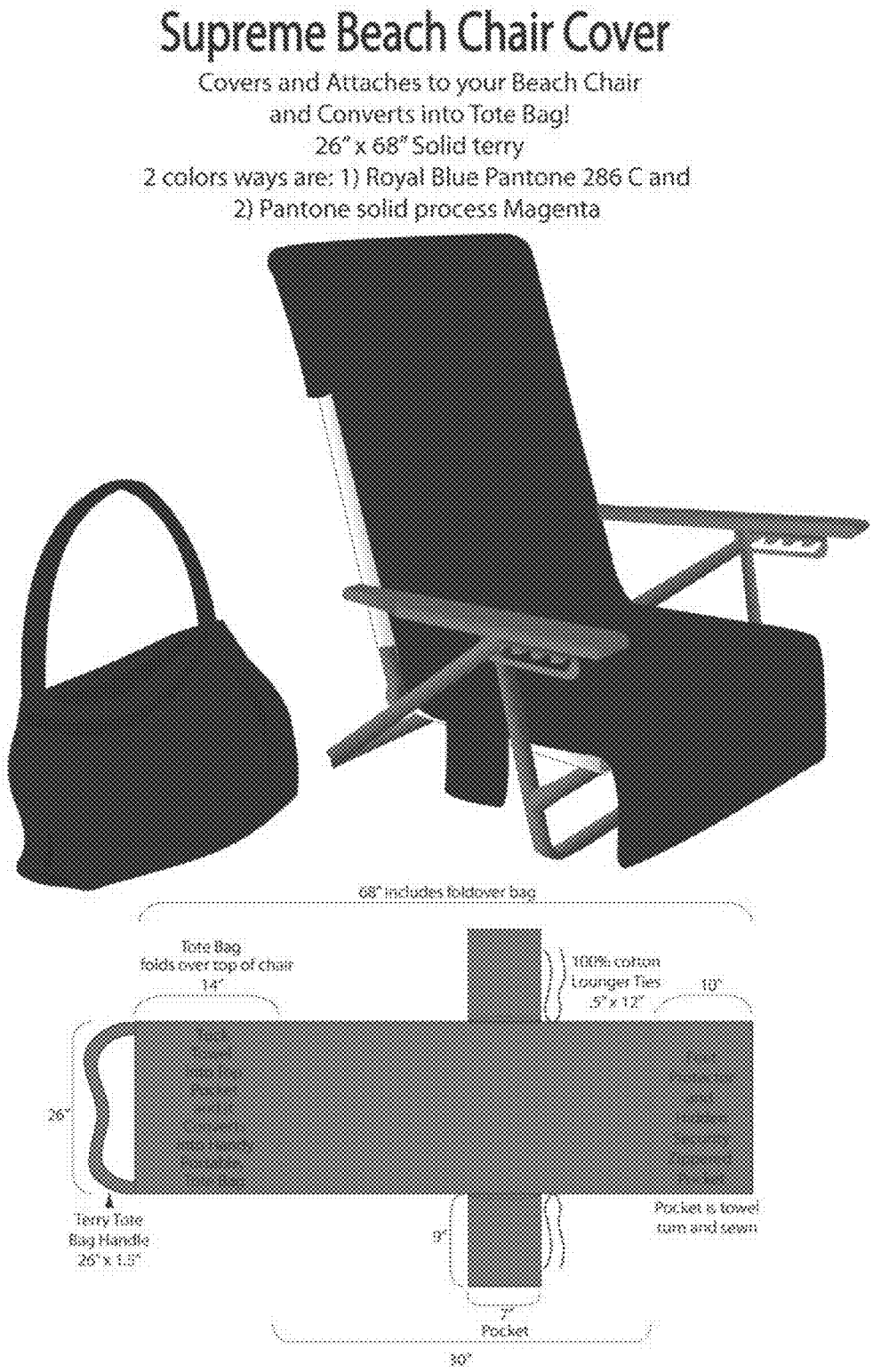
FIG. 61 depicts an alternate exemplary embodiment for a portable beach chair cover according to an exemplary embodiment of the present invention.

FIGS. 1-61, briefly described above, copiously depict various features of a portable beach chair cover according to an exemplary embodiment of the present invention. In what follows, various ones of these features will be described in greater detail, with reference to certain of those figures.

Figure 7:
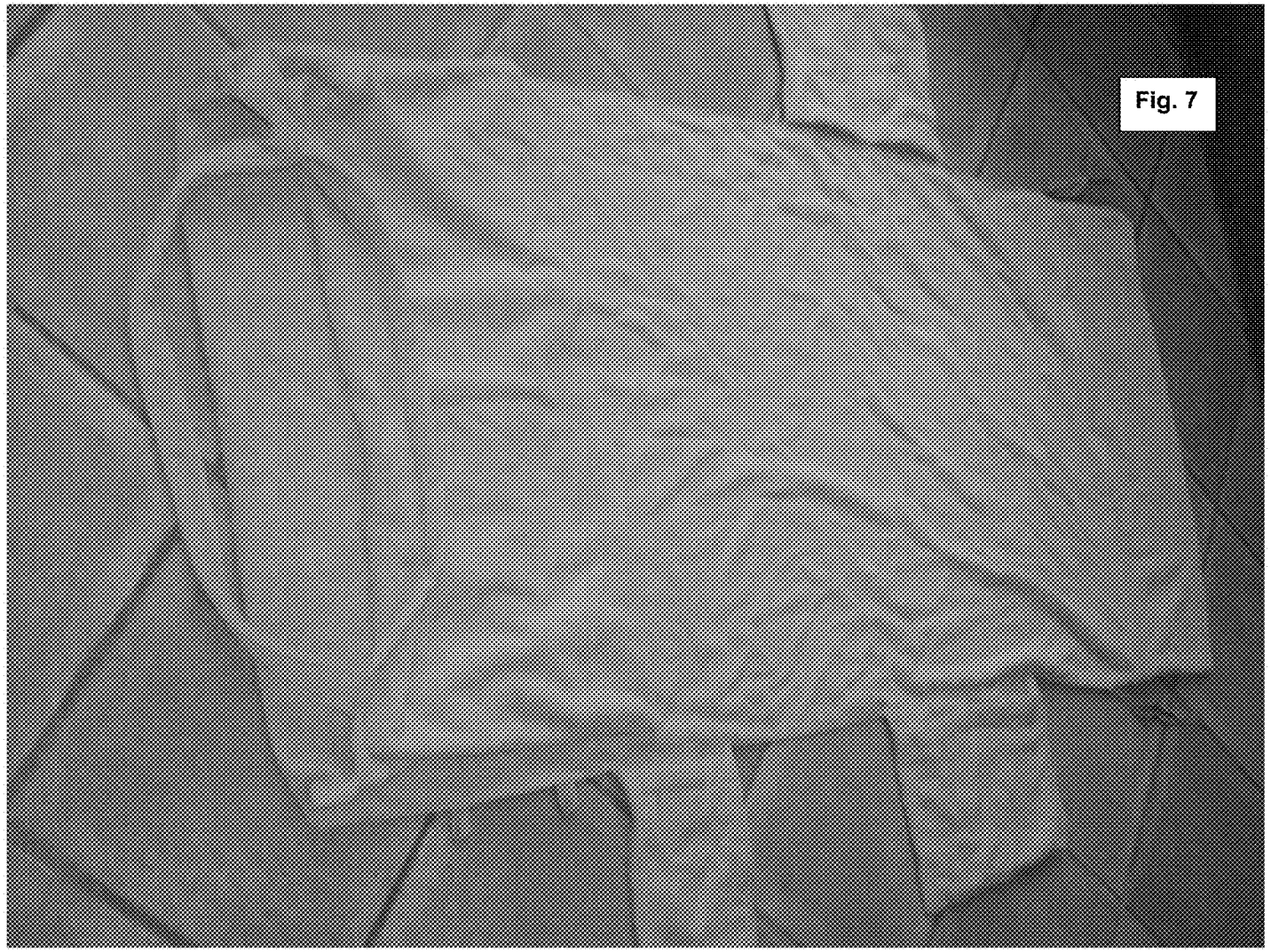
FIG. 7 depicts the exemplary beach chair cover of FIG. 1 with the headward portion folded back showing the open pouch by which the head of the beach chair cover is slid over the headward portion of an exemplary beach chair.
Figure 8:
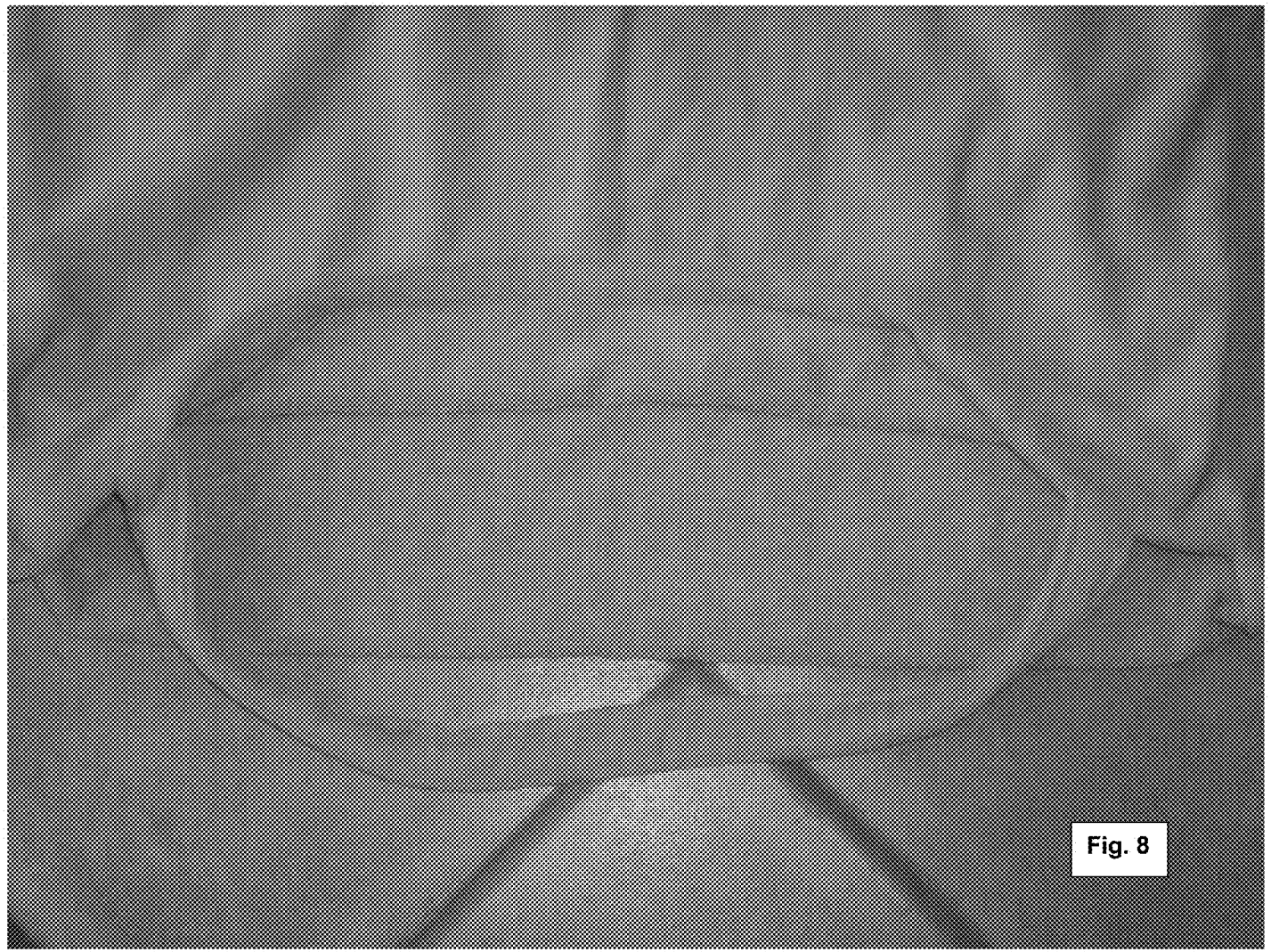
FIG. 8 shows a close-up of the opening of the headward pouch shown in FIG. 7.
Figure 54:
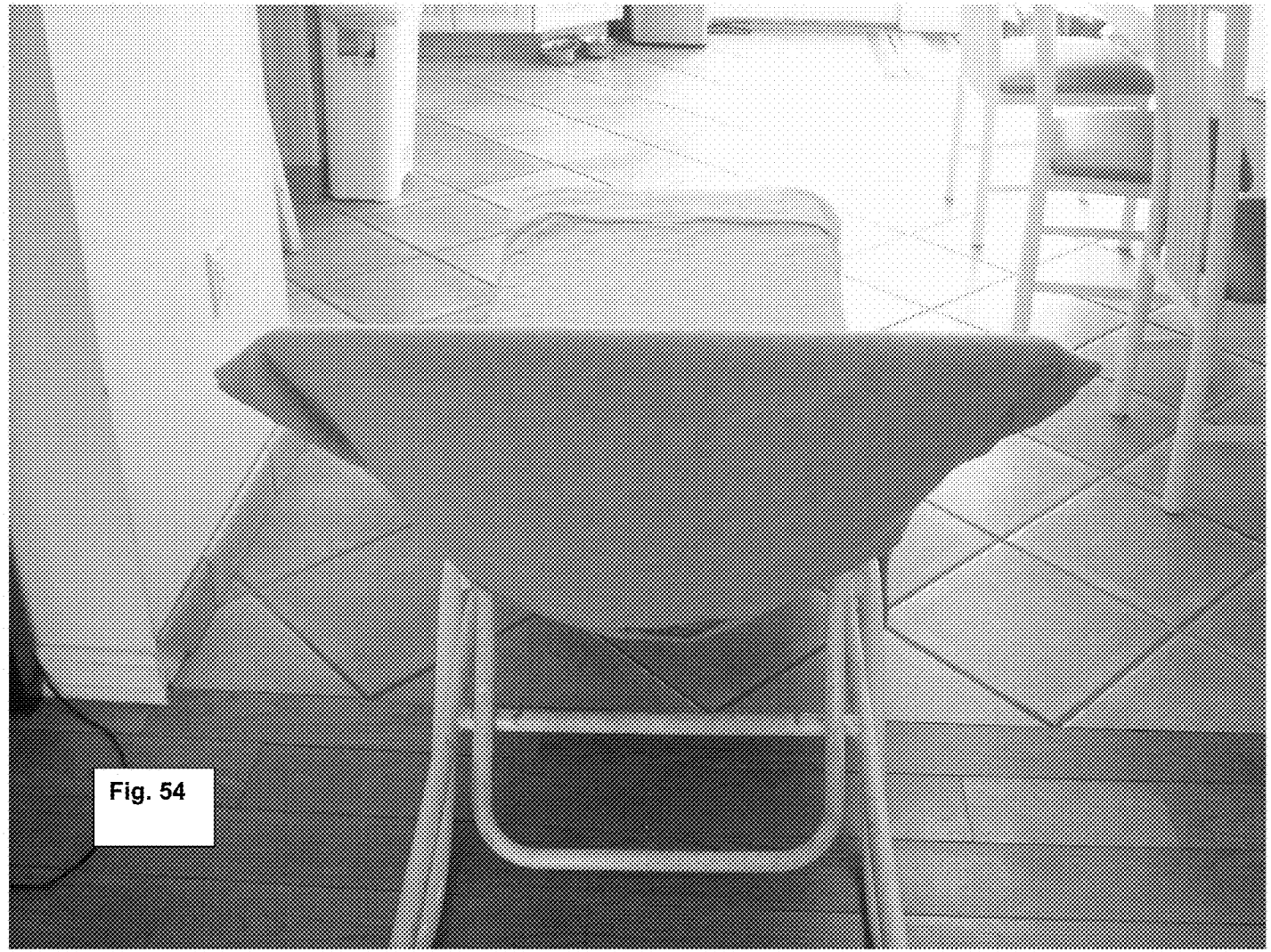
Figure 55:
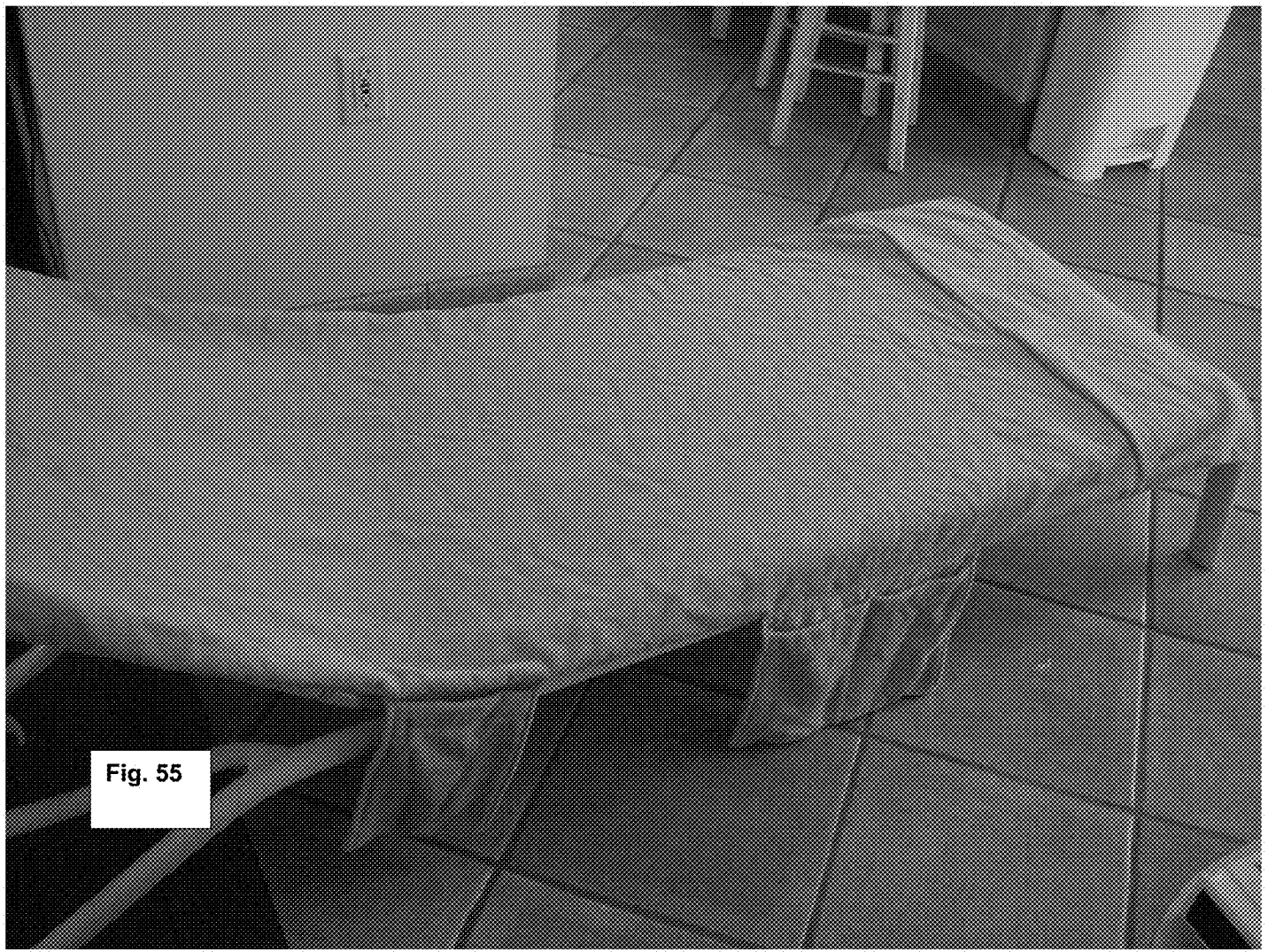
Figure 56:
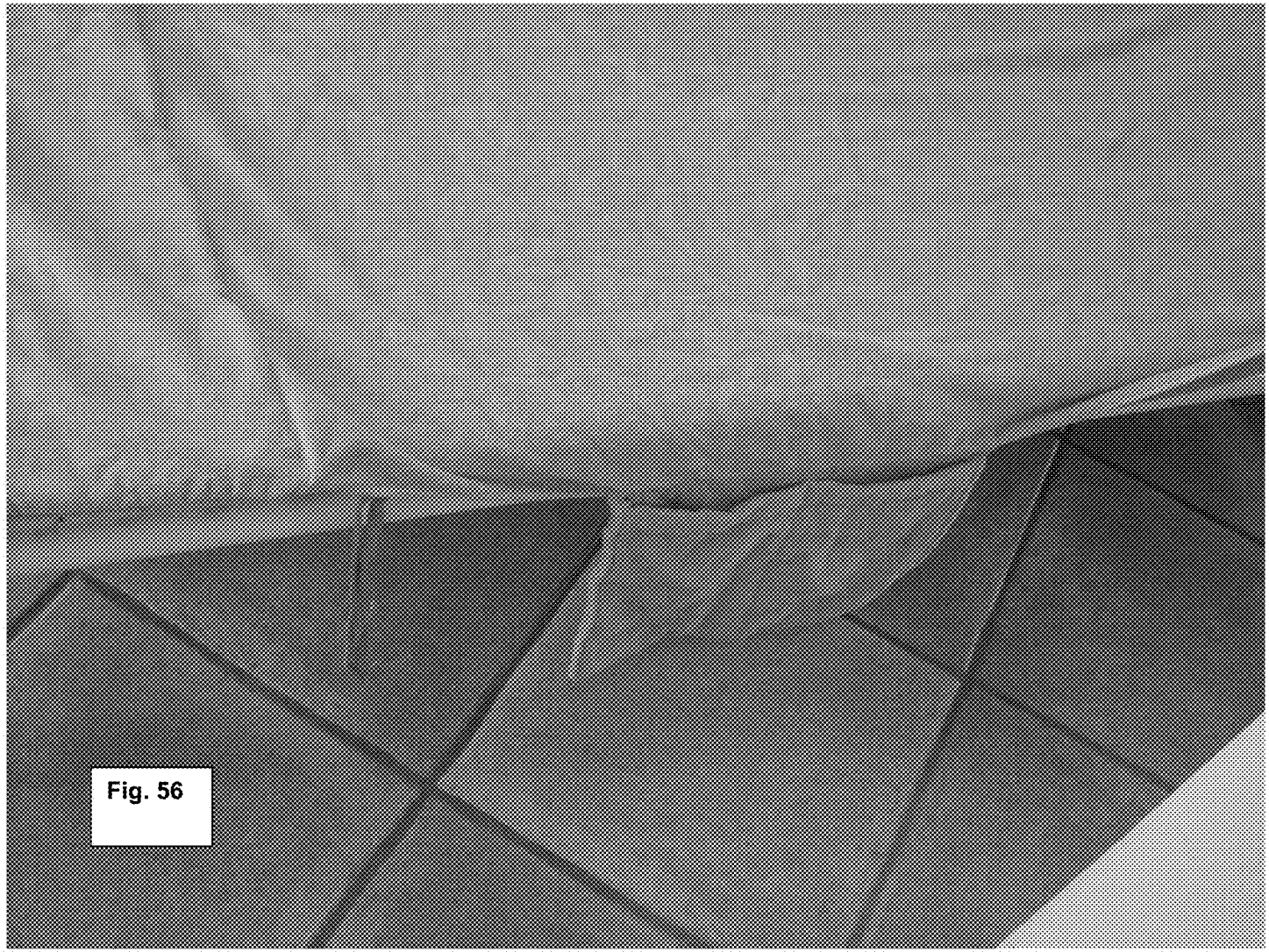
Figure 57:
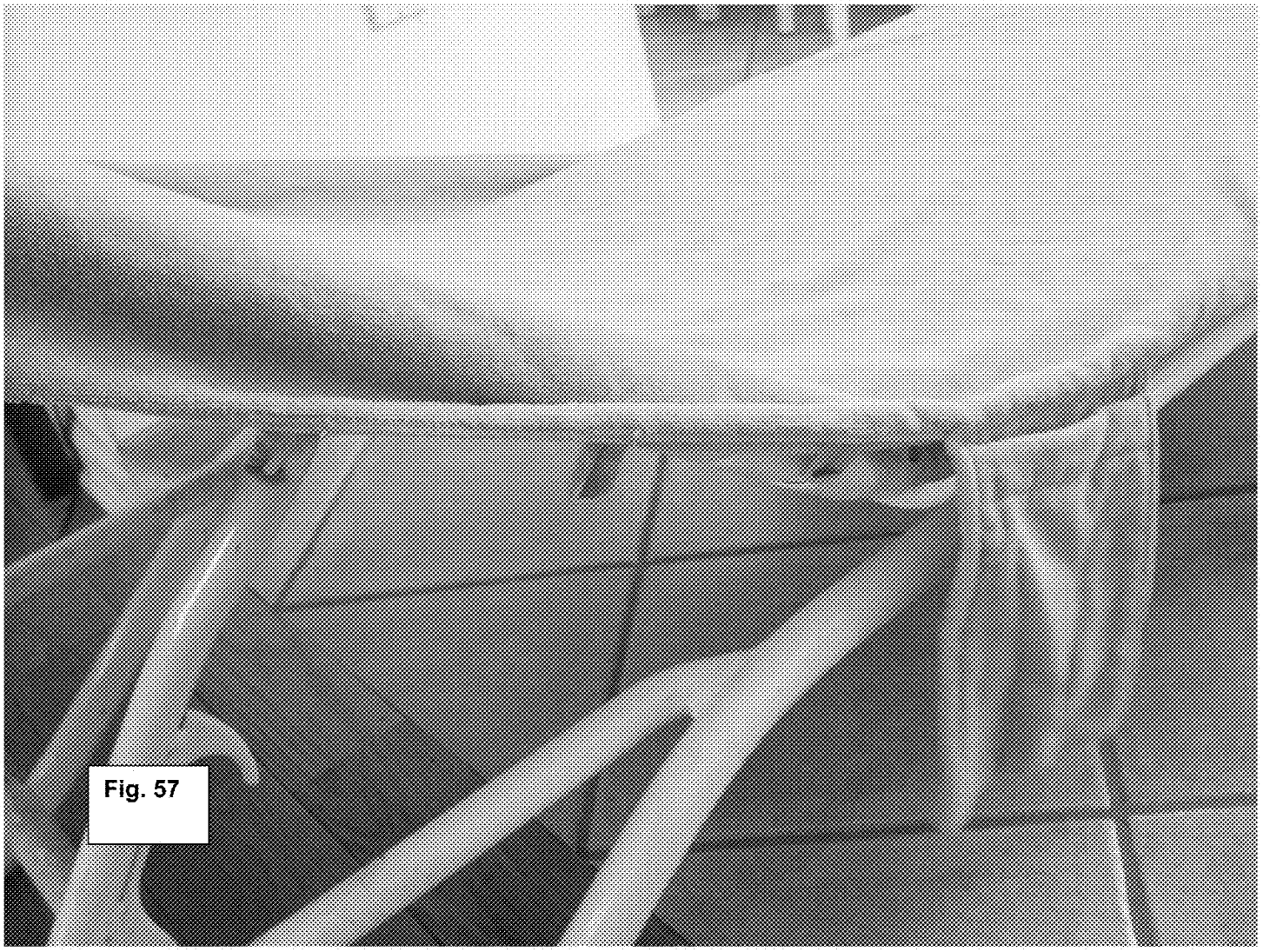

In exemplary embodiments of the present invention, a portable beach chair cover can include a slip over type cavity at its top (or headward) side by means of which the portable beach chair cover can be slid over the top of a beach chair. An example of this is depicted in FIGS. 7-8. FIG. 7 depicts an exemplary beach chair cover with the headward portion folded back showing an open pouch by which the headward of the beach chair cover can be slid over the headward portion of an exemplary beach chair, and FIG. 8 depicts a close-up of the opening of the headward slip-over pouch shown in FIG. 7. FIG. 54 depicts a view from behind of an exemplary beach chair cover with the headward slip-over portion hanging down.

Figure 11:
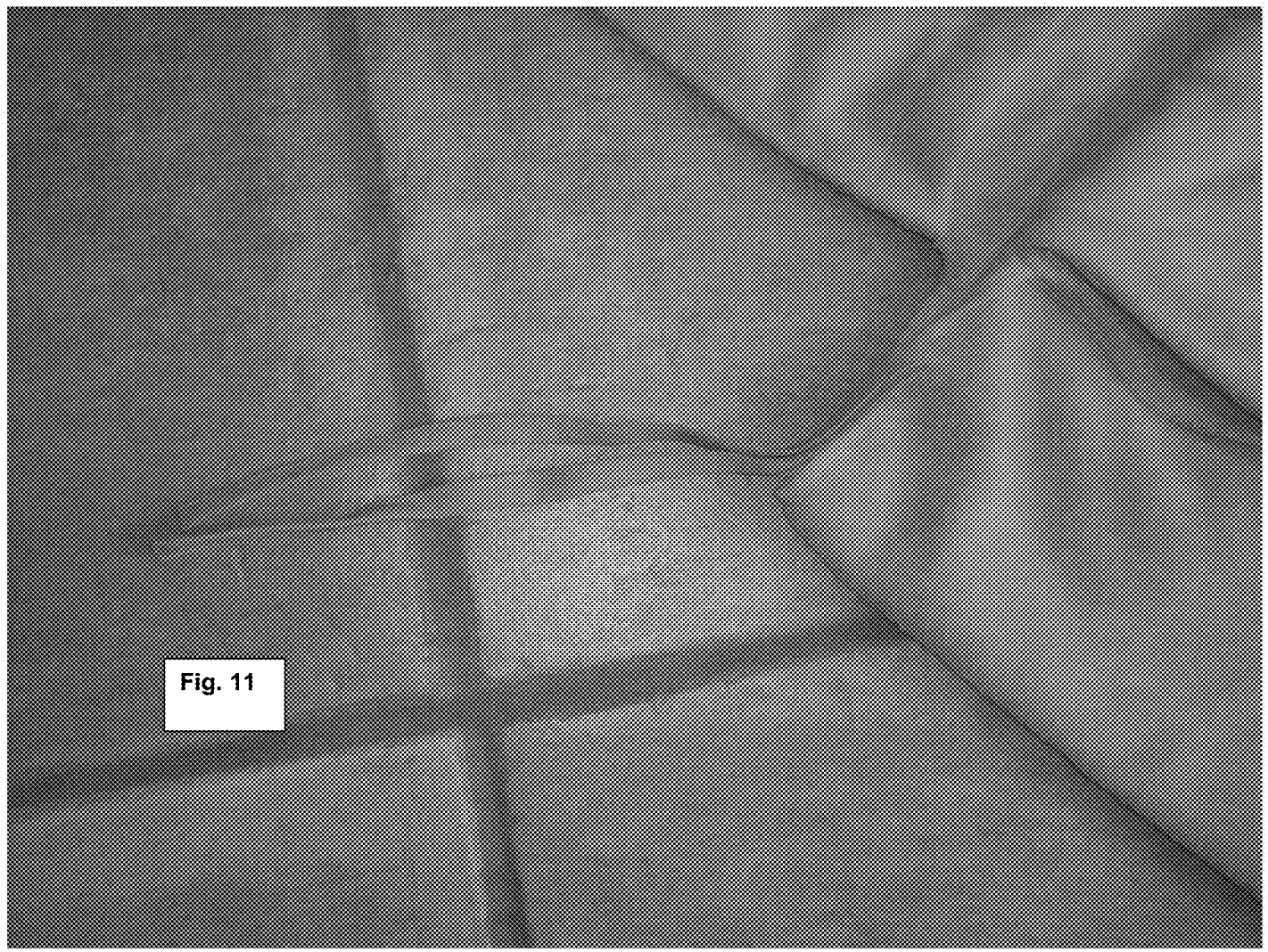
FIG. 11 depicts exemplary ties used to affix the footward portion of the exemplary beach chair cover of FIG. 1 to a beach chair.
Figure 12:
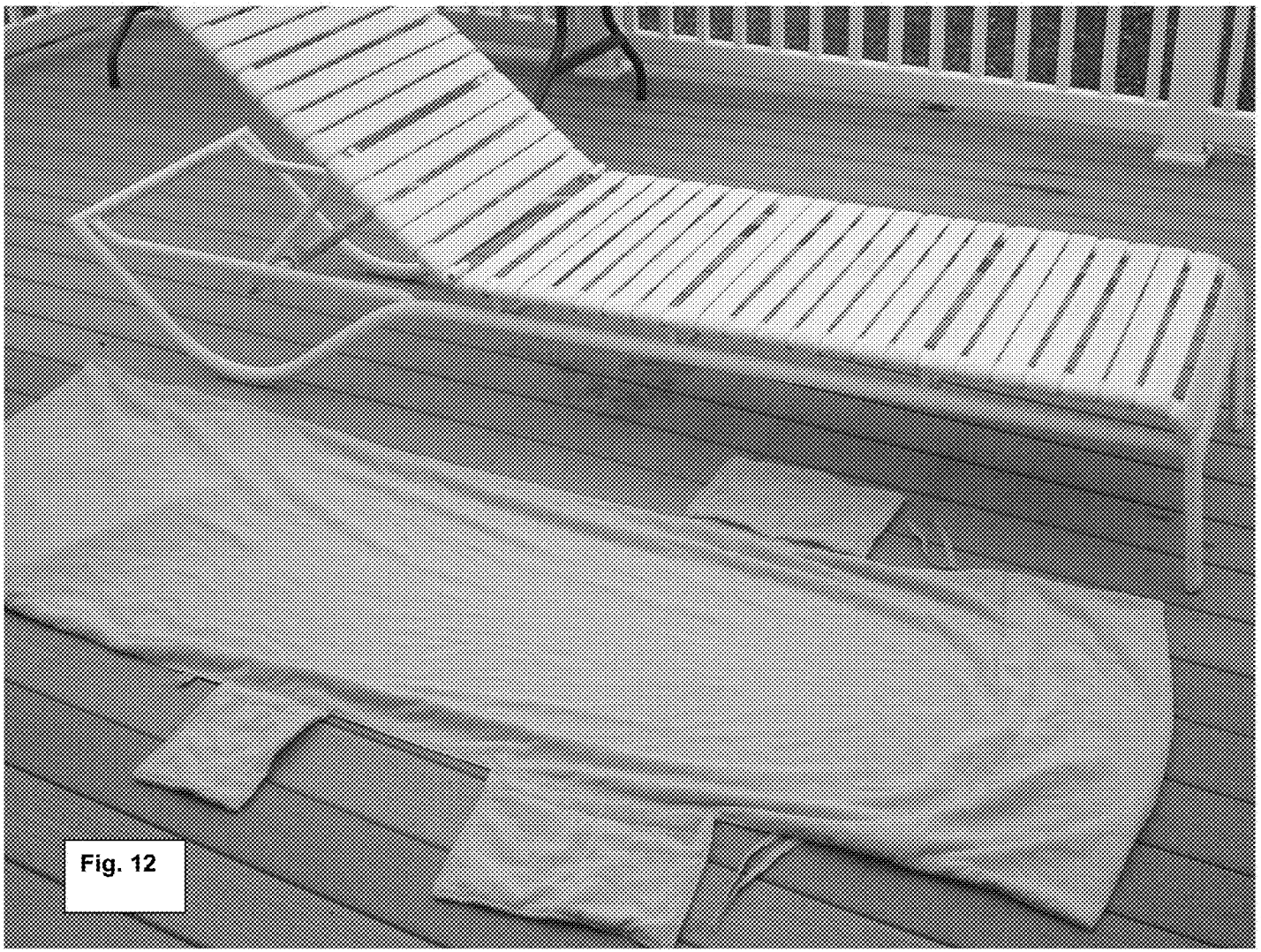
FIG. 12 depicts an exemplary beach chair cover according to an exemplary embodiment of the present invention laid out in front of an exemplary beach chair.
Figure 13:
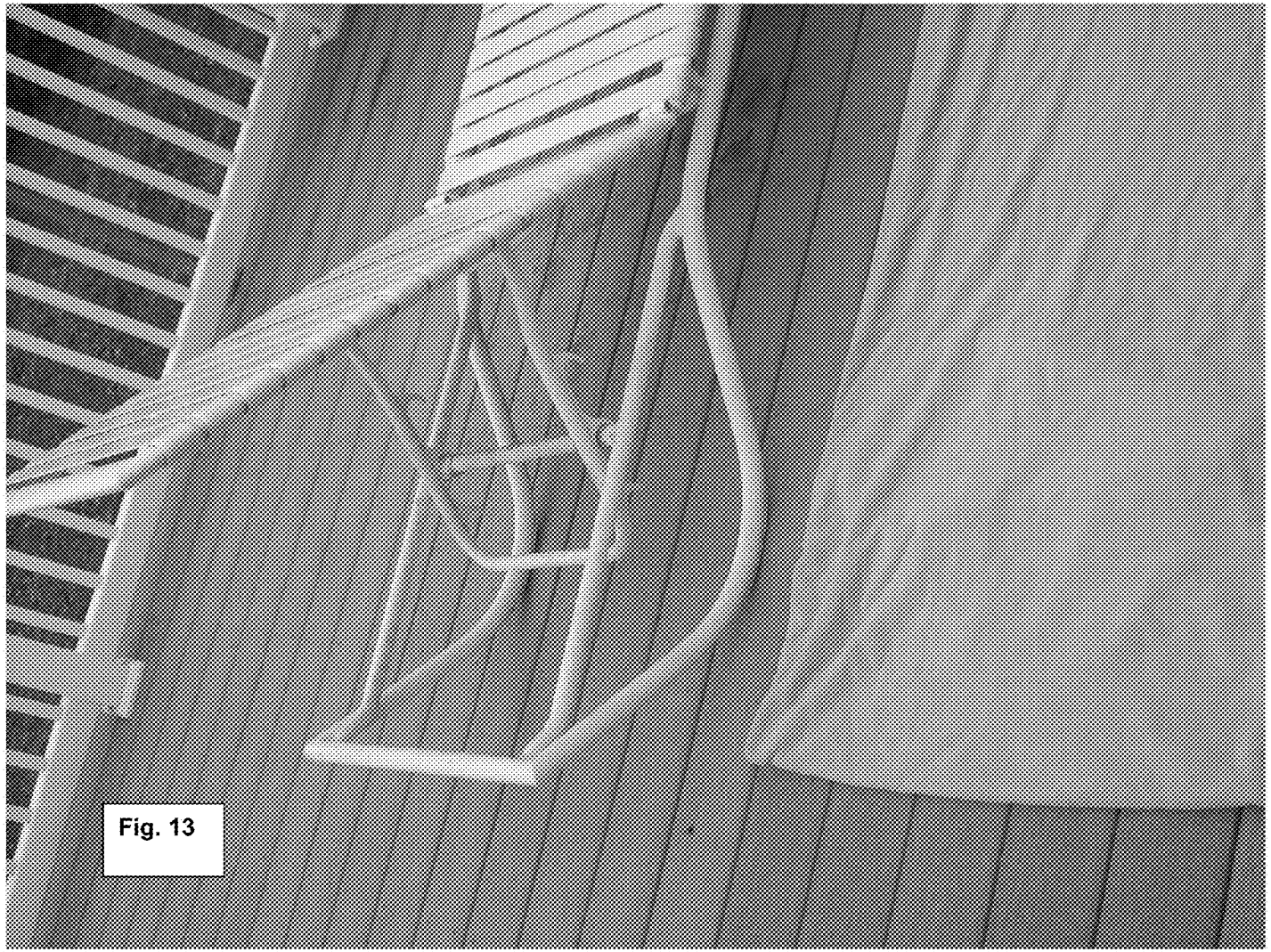
FIG. 13 is a close-up of the leftmost portion of FIG. 12.
Figure 14:
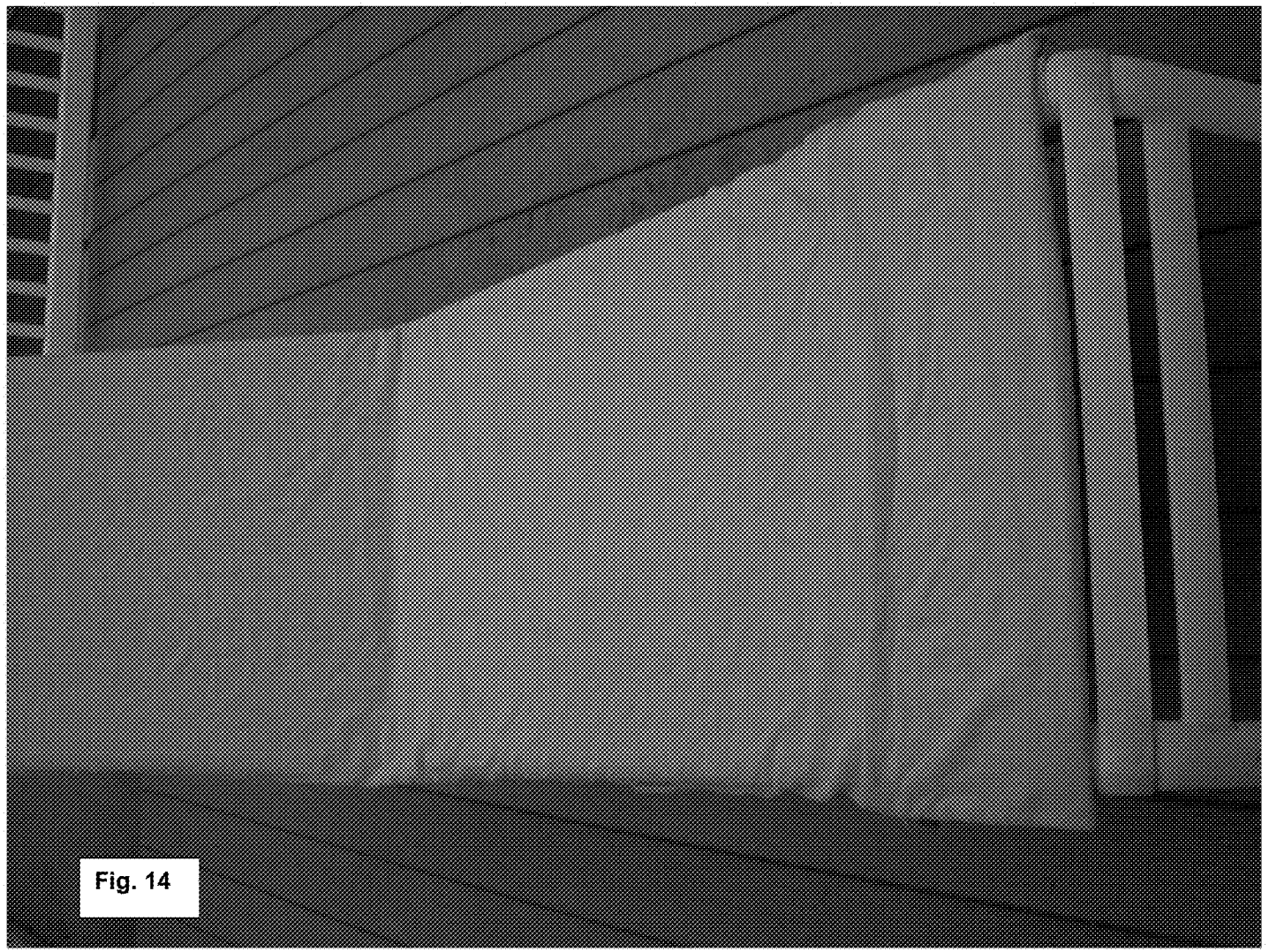
FIG. 14 is a view from the footward portion of the exemplary beach chair cover of FIG. 12.
Figure 15:
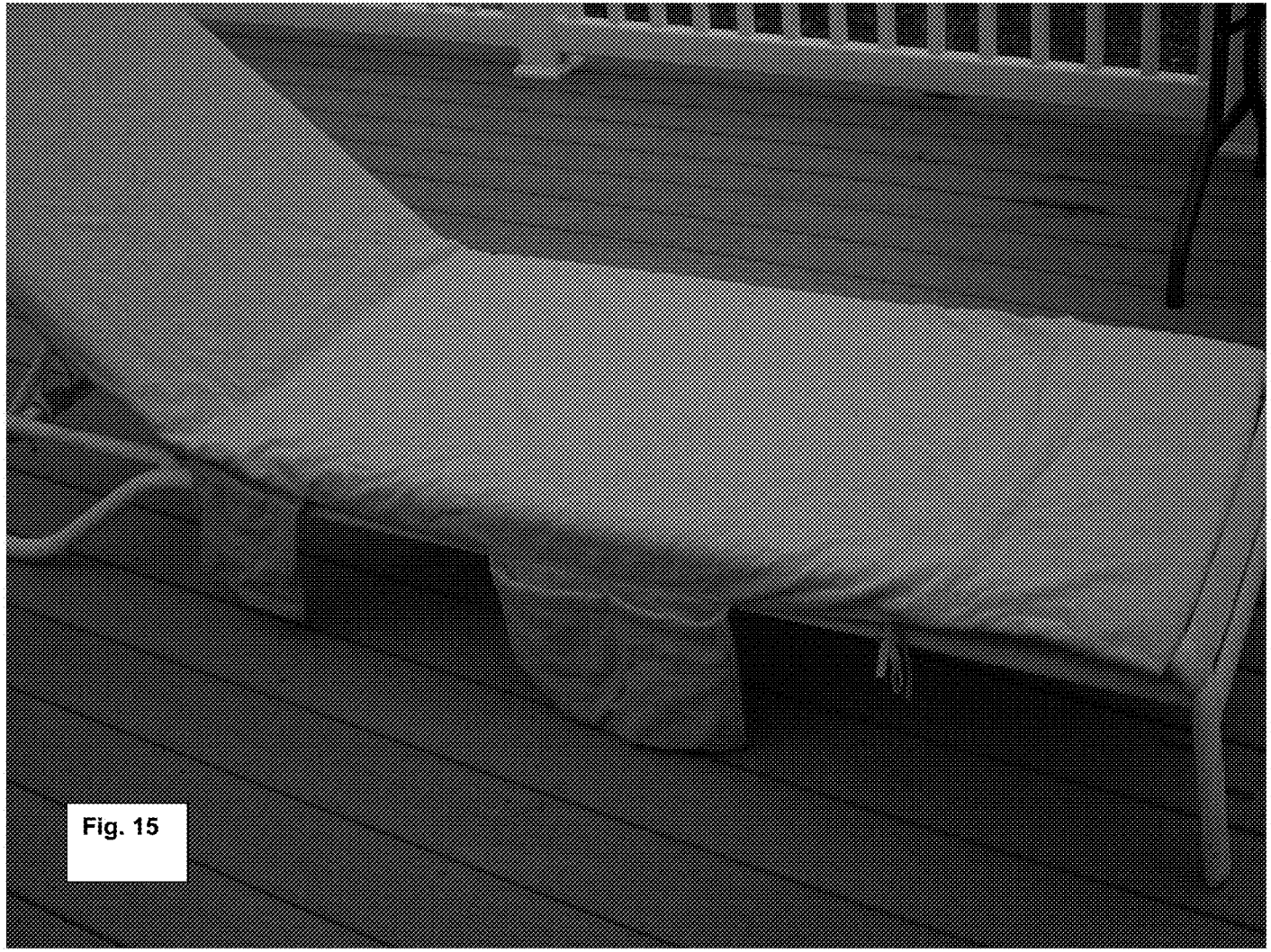
FIG. 15 is a view from the side of the exemplary beach chair cover of FIG. 12.
Figure 16:
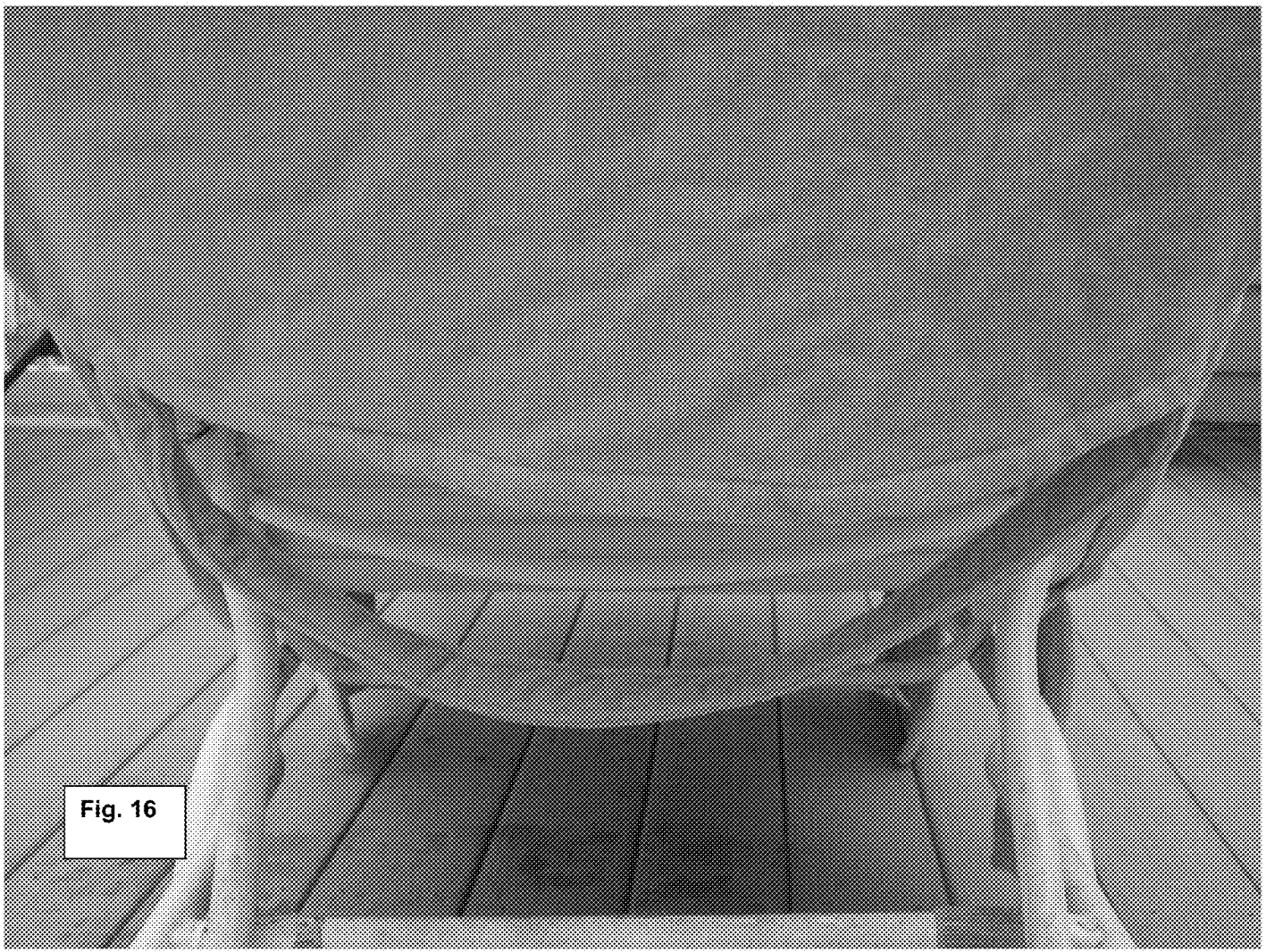
FIG. 16 is a view from underneath the headward portion of the exemplary beach chair showing a slide-over pouch.
Figure 17:
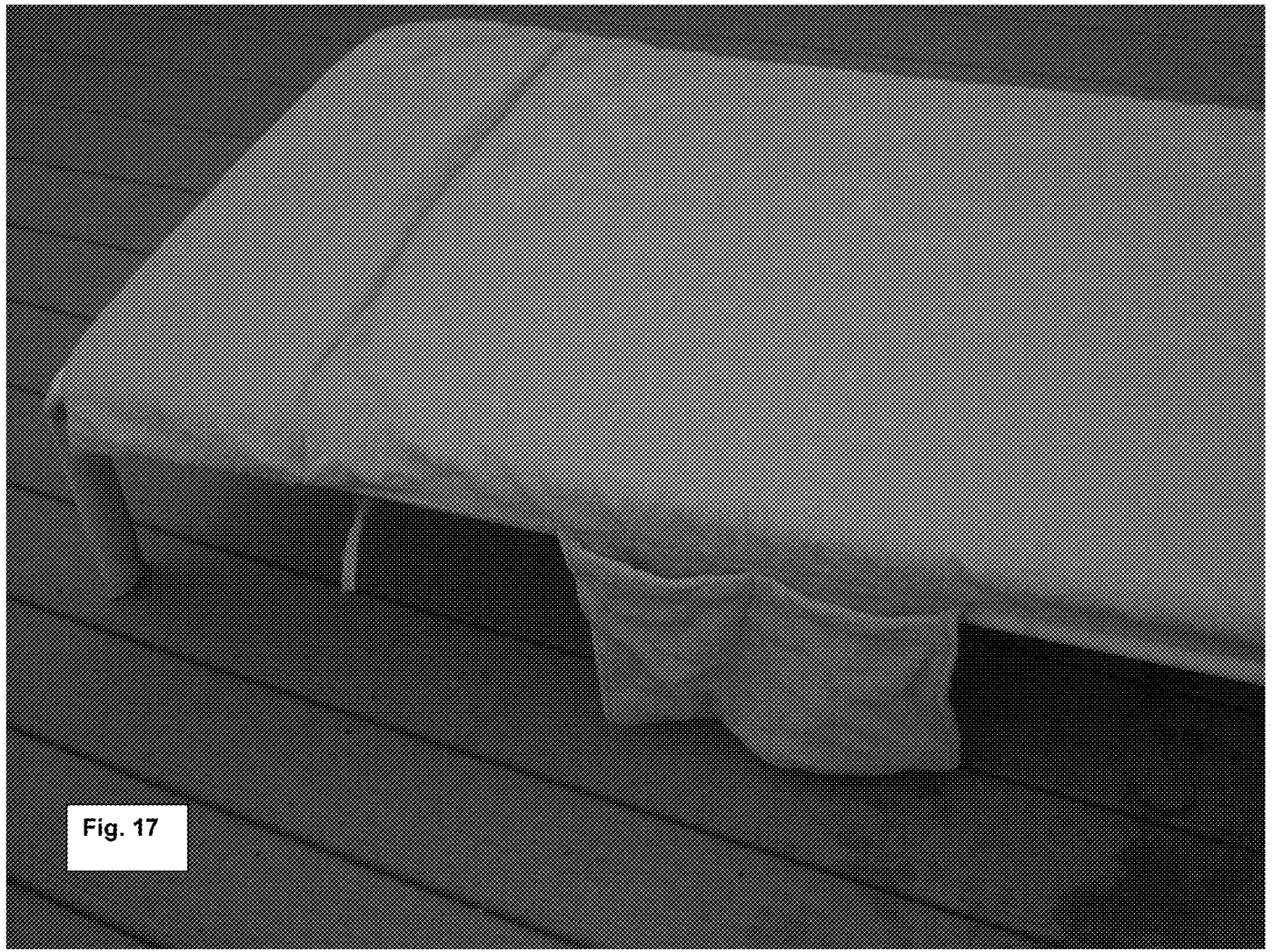
FIG. 17 depicts the double pockets on the left side of the exemplary beach chair cover of FIG. 12.
Figure 18:
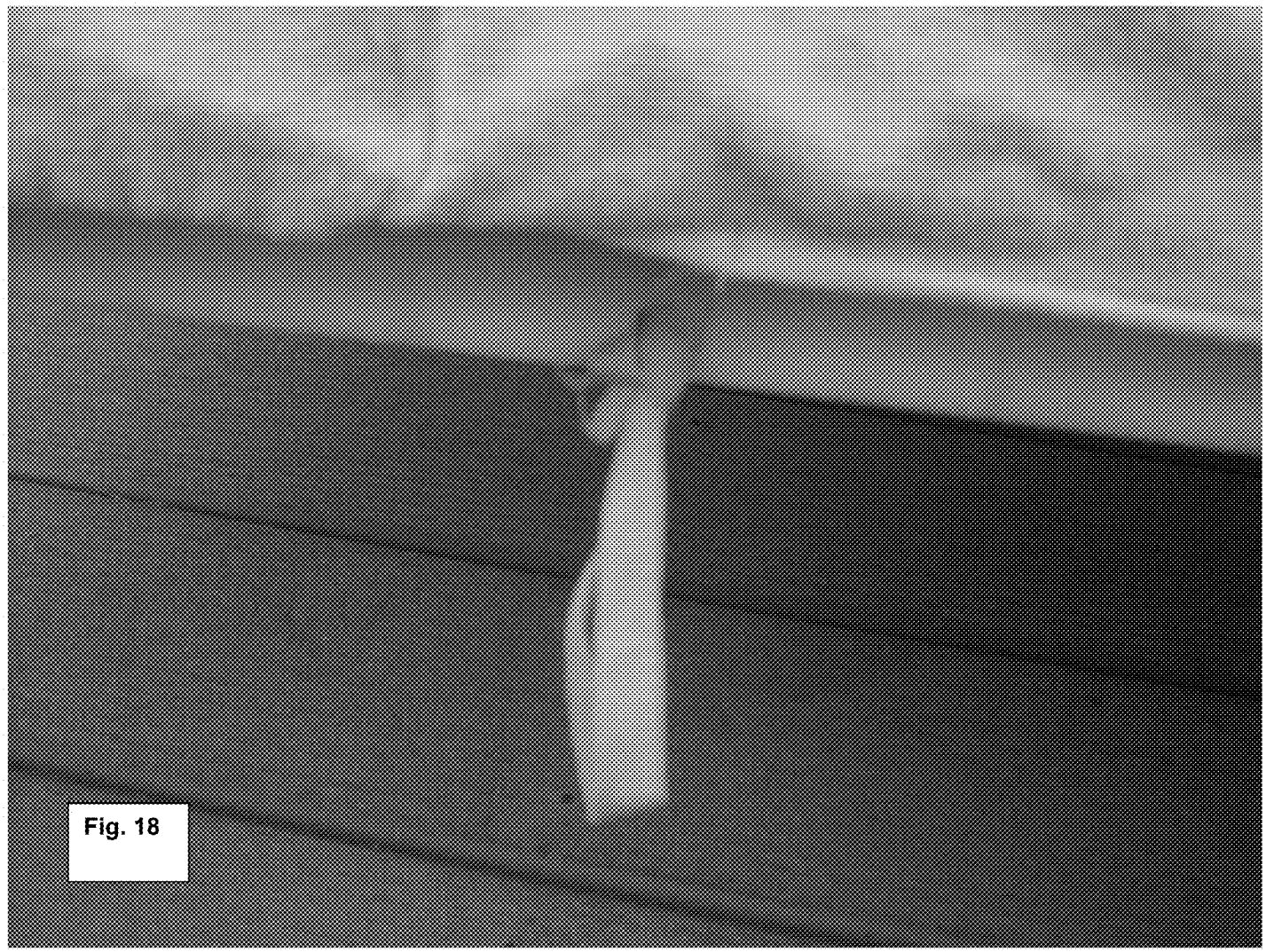
FIG. 18-19 are close-ups of fastening ties used to affix the beach chair cover to the side of the beach chairs chassis.
Figure 19:
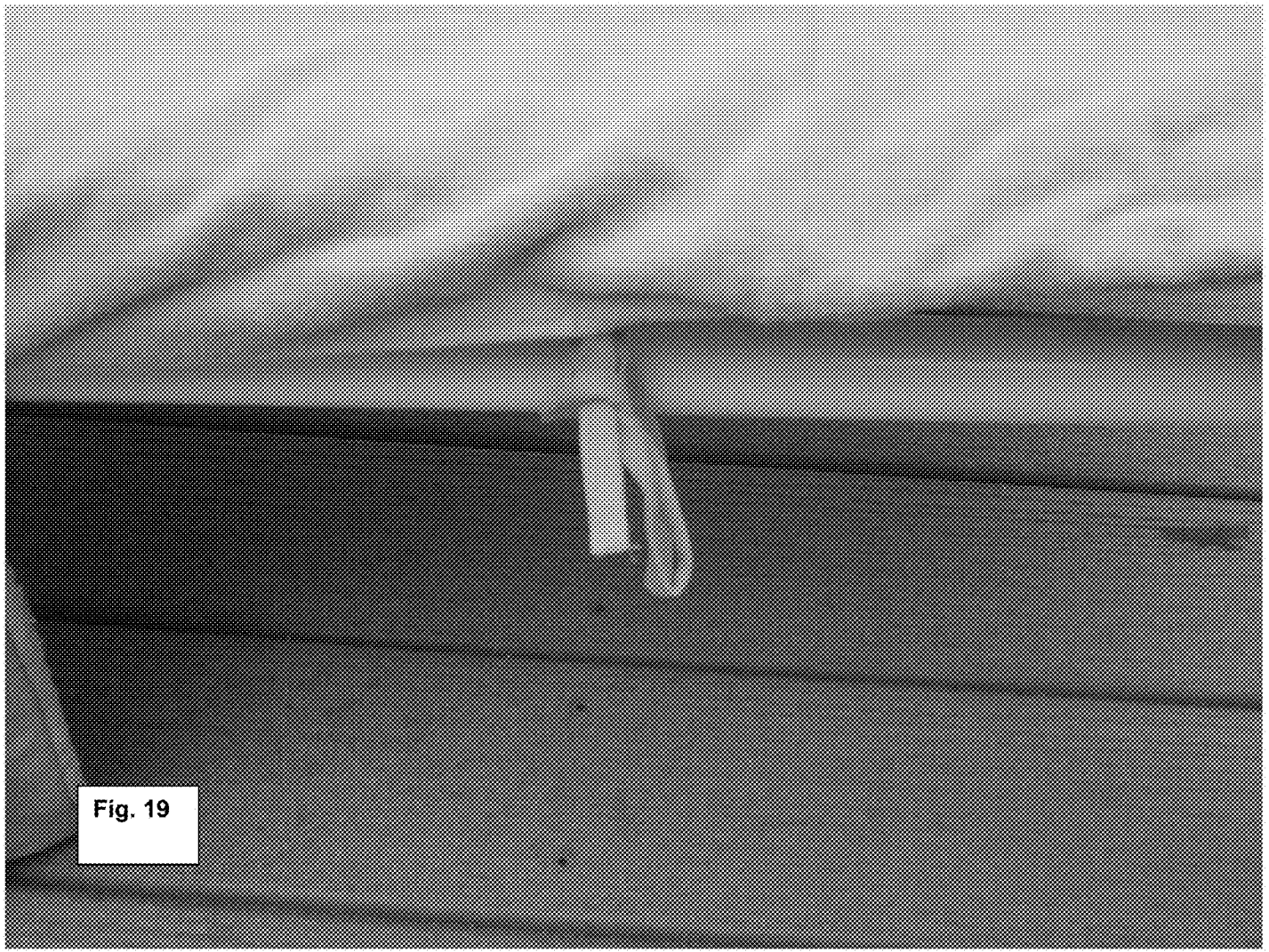
Figure 20:
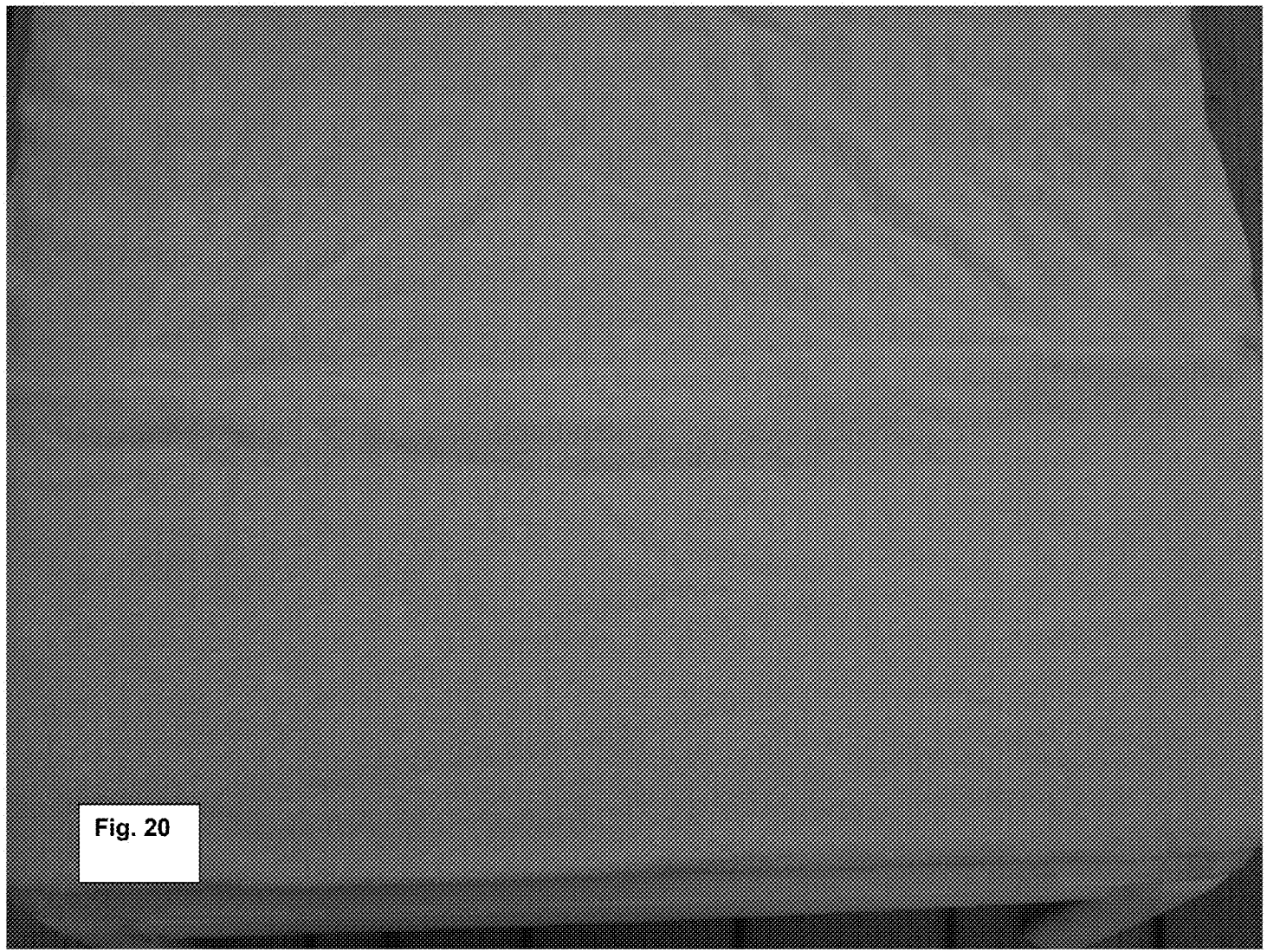
FIG. 20 depicts a close-up view of the top side of the footward portion of the exemplary beach chair showing a seam but nothing more.
Figure 21:
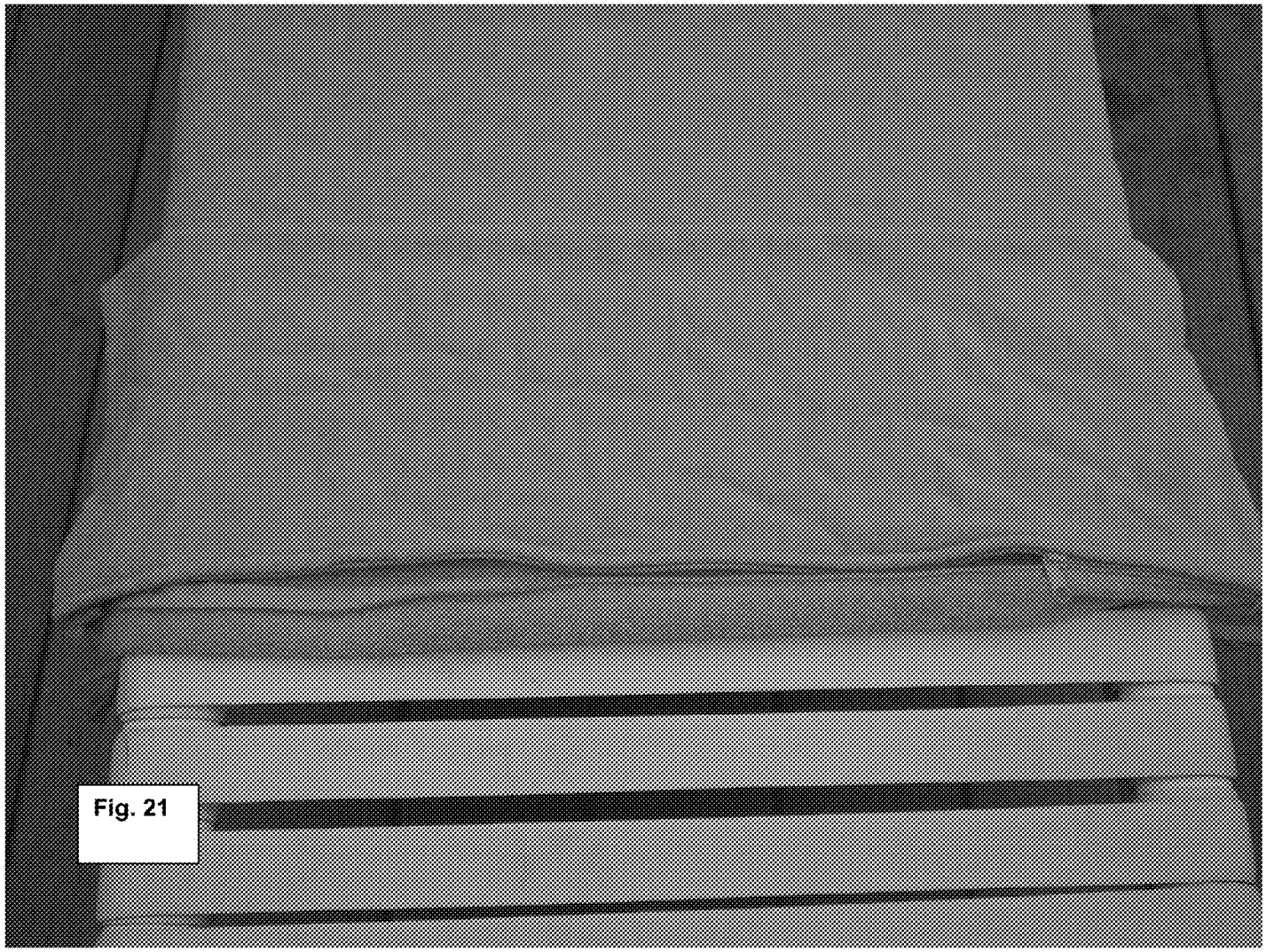
FIG. 21 depicts a close-up of the same portion of the beach chair cover with an underside pocket pouch turned back showing an open zipper pouch.
Figure 22:
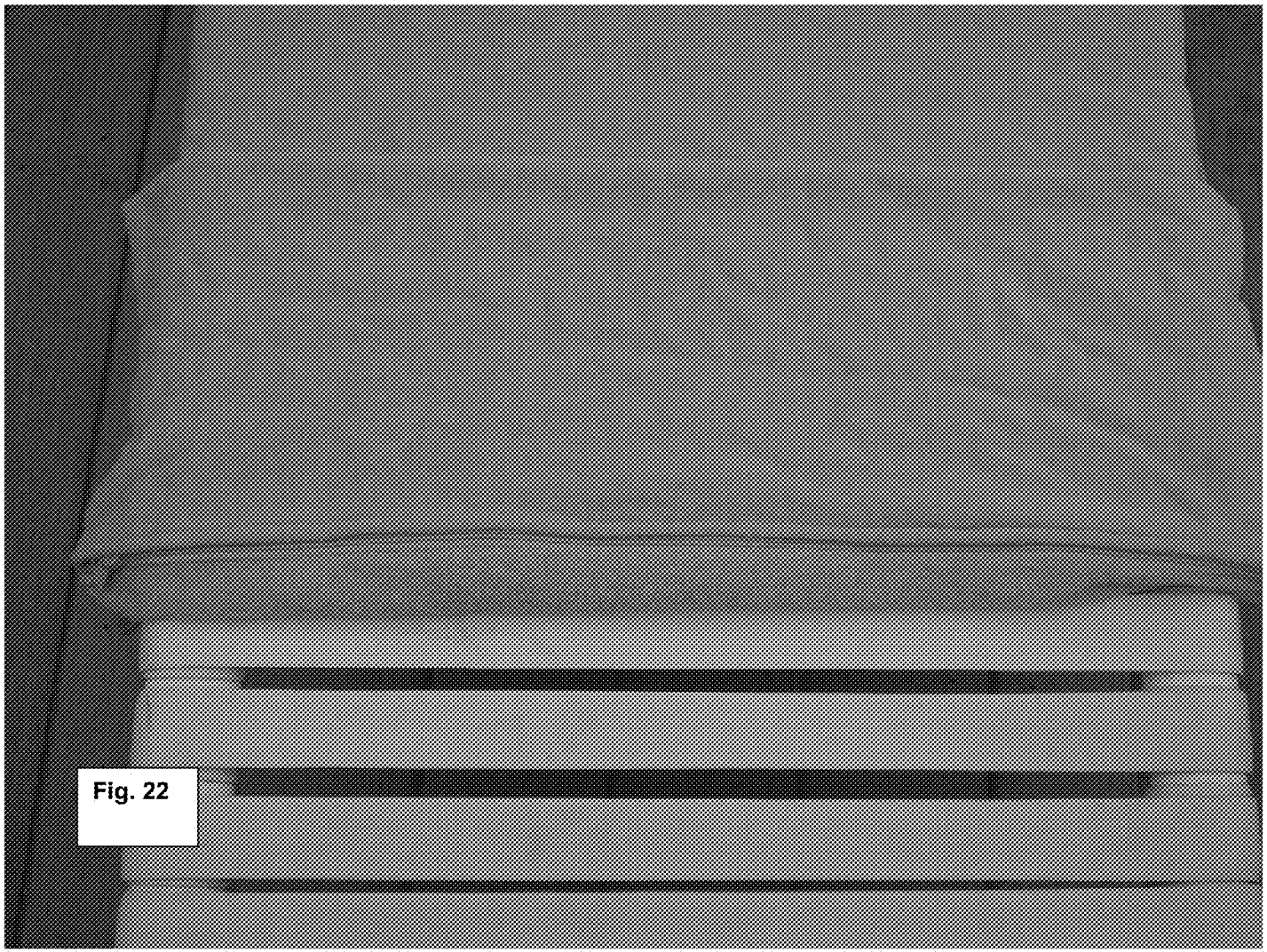
FIG. 22 depicts the same view as FIG. 21 with the pouch zippered all the way closed.
Figure 23:
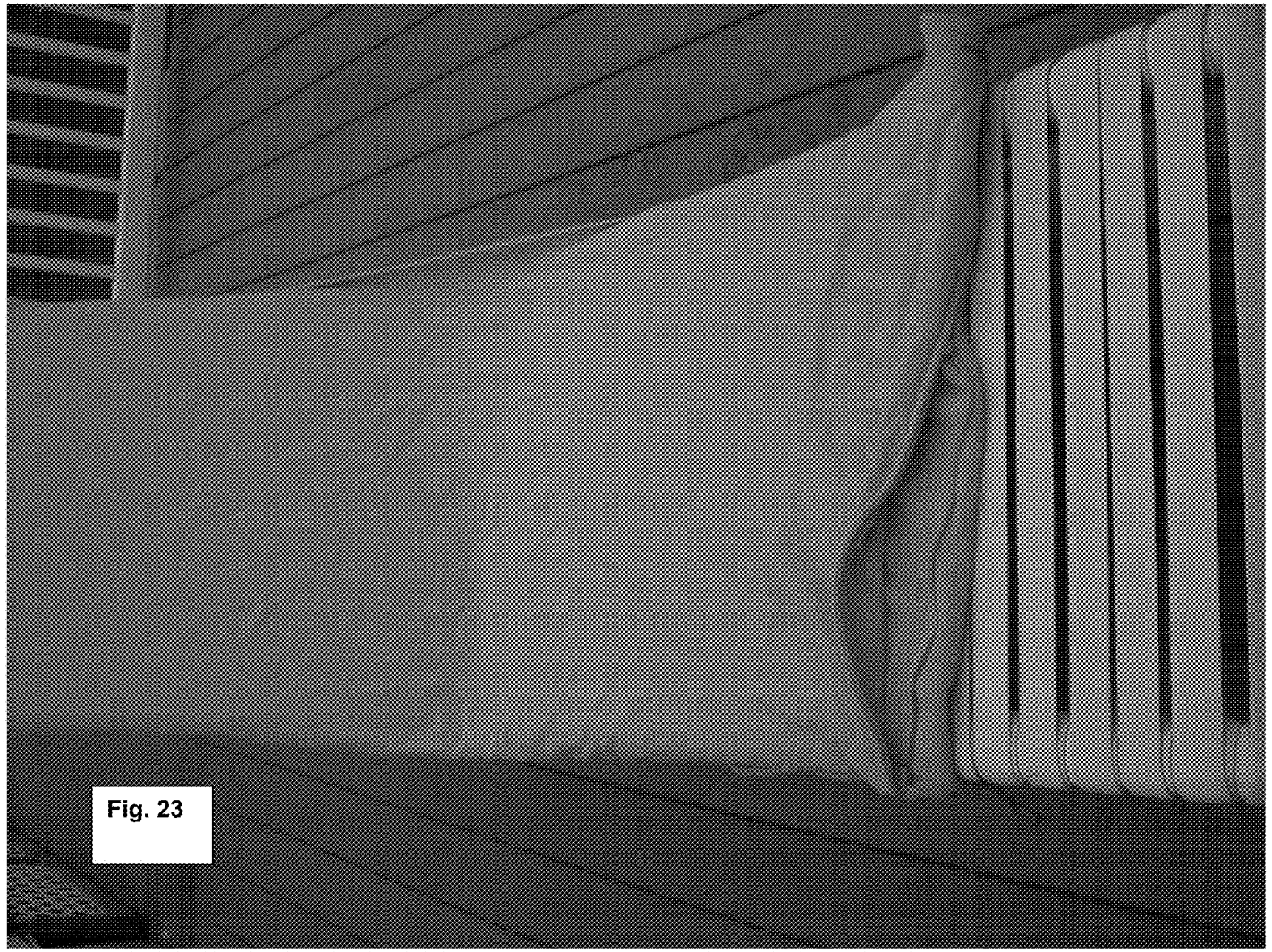
FIG. 23 shows a zoomed out view of the pocket pouch of FIGS. 21 and 22.
Figure 24:
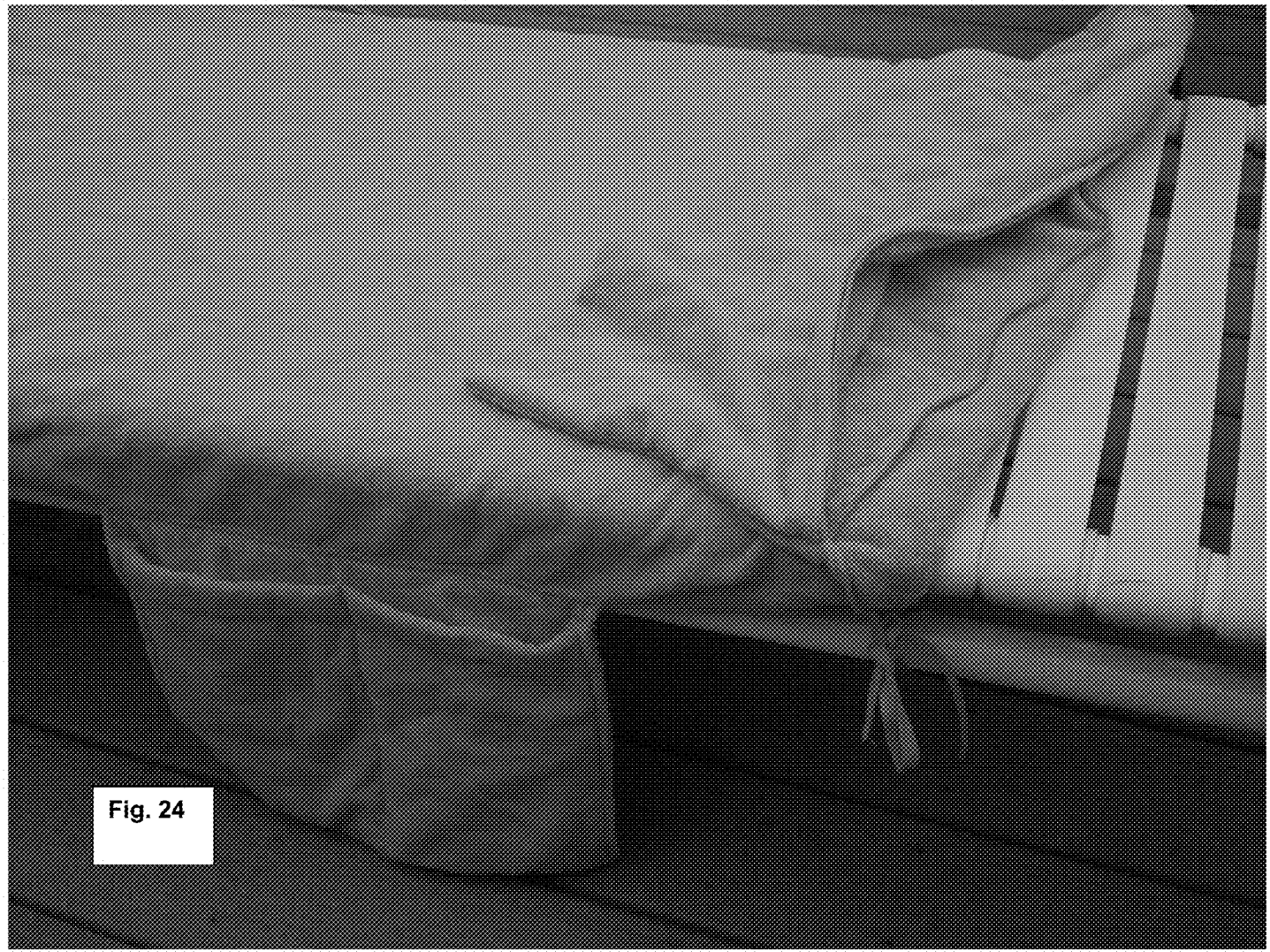
FIG. 24 is a close-up of the footward portion of the exemplary beach chair cover and a doubleside-pockets hanging from its right side.
Figure 60:
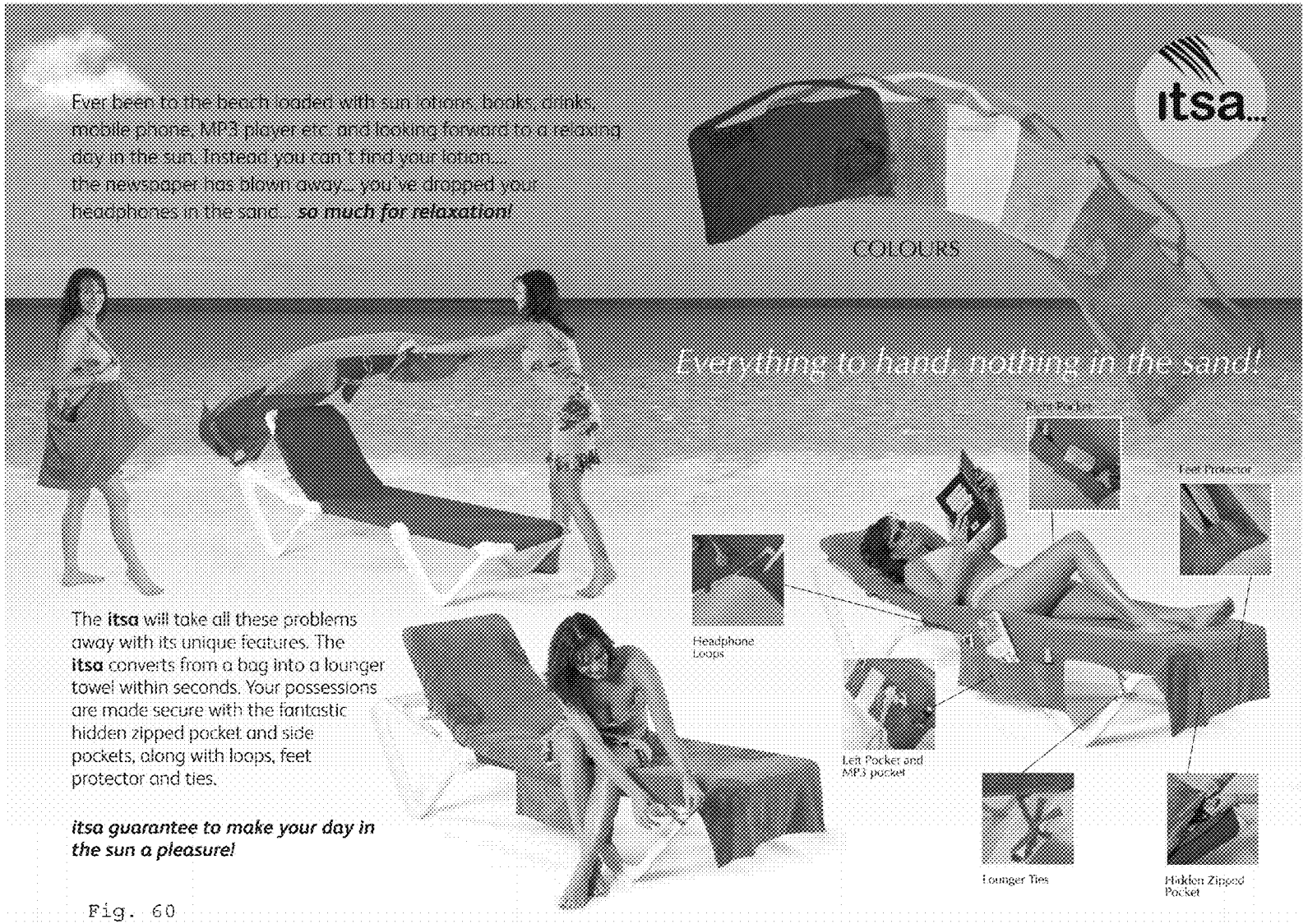
FIG. 60 is an exemplary information sheet for a portable beach chair cover according to an exemplary embodiment of the present invention.

In exemplary embodiments of the present invention a portable beach chair cover can have ties or other affixing means at or near the footward portion of the beach chair cover so that it can be affixed to a beach chair, at either the beach chairs legs or its horizontal plane, for example, depending upon its construction and size. Such additional affixing means can include cords, strings or thin rectangular pieces of fabric attached to the underside of the beach chair cover and attachable to a beach chair by tying, snaps, VELCRO, "hook and loop", "burr" and "touch" fastening or other known techniques. For example, FIG. 11 depicts exemplary ties used to affix the footward portion of an exemplary beach chair cover to a beach chair. FIG. 60 depicts an alternate placing of said ties, and shows them affixed to the legs of an exemplary beach chair.

Figure 9:
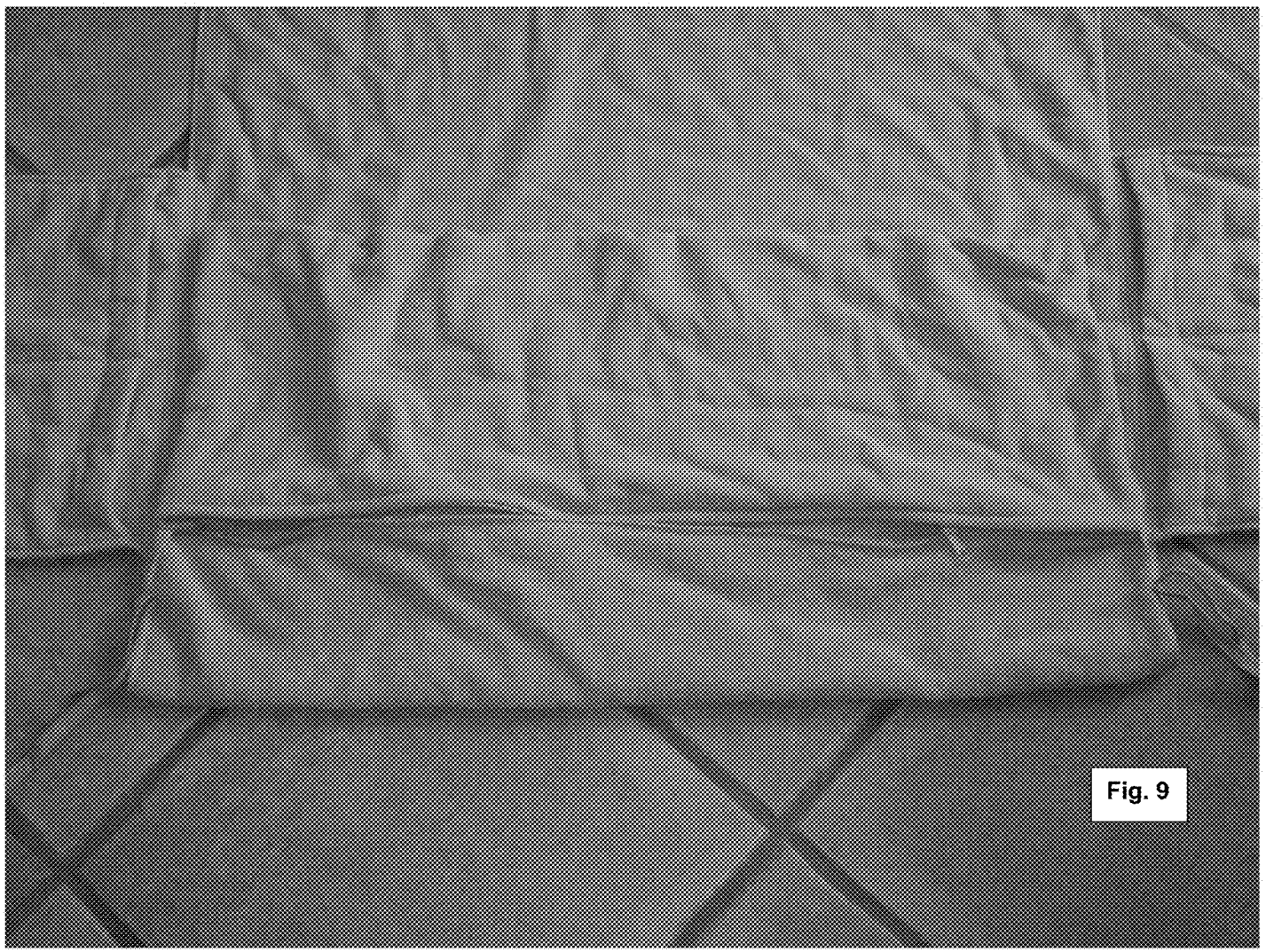
FIG. 9 is a close-up of the exemplary beach chair cover of FIG. 1 with the footward concealed flap pouch folded back.
Figure 10:
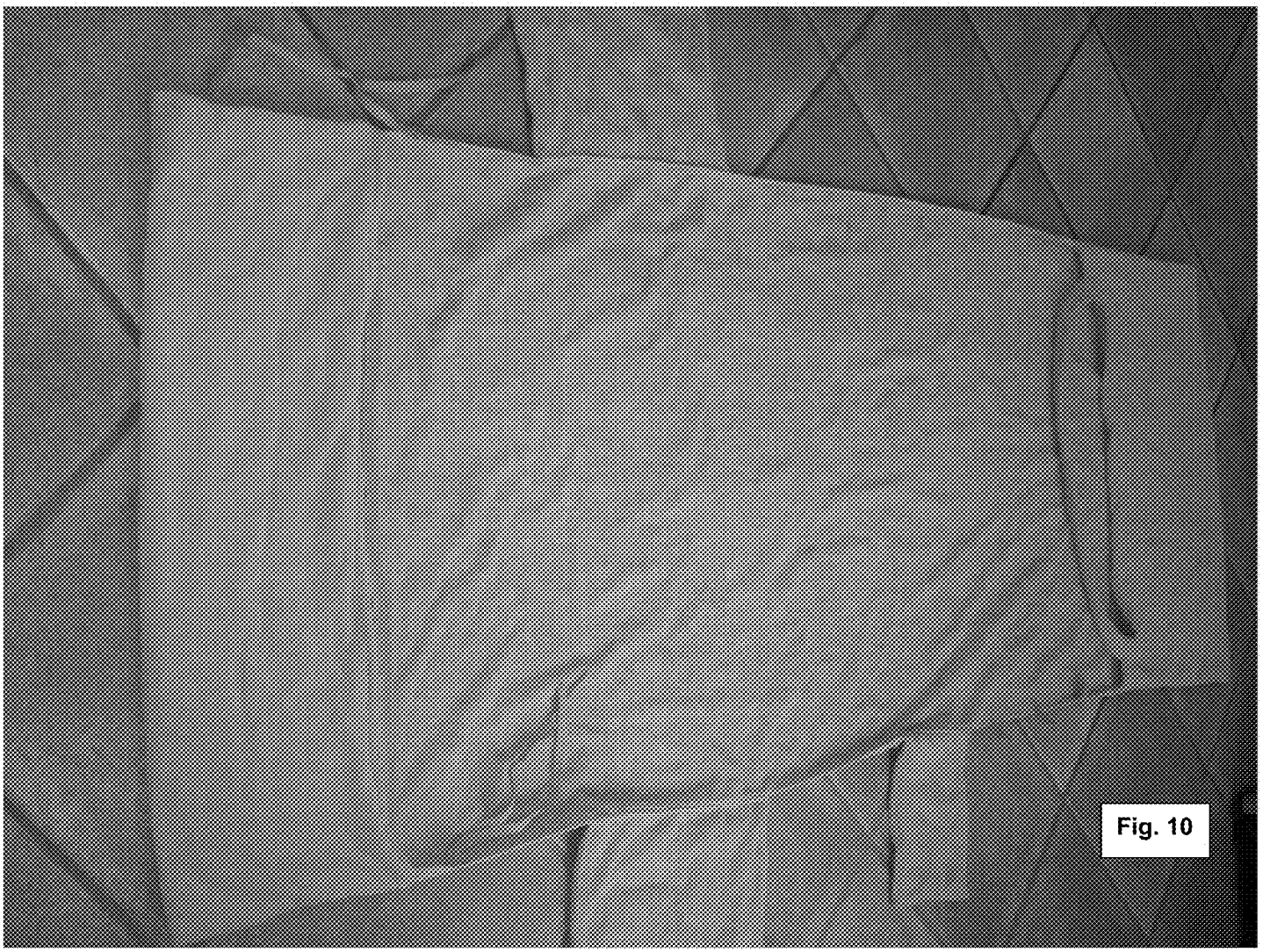
FIG. 10 depicts the underside of the exemplary beach cover of FIG. 1.
Figure 52:
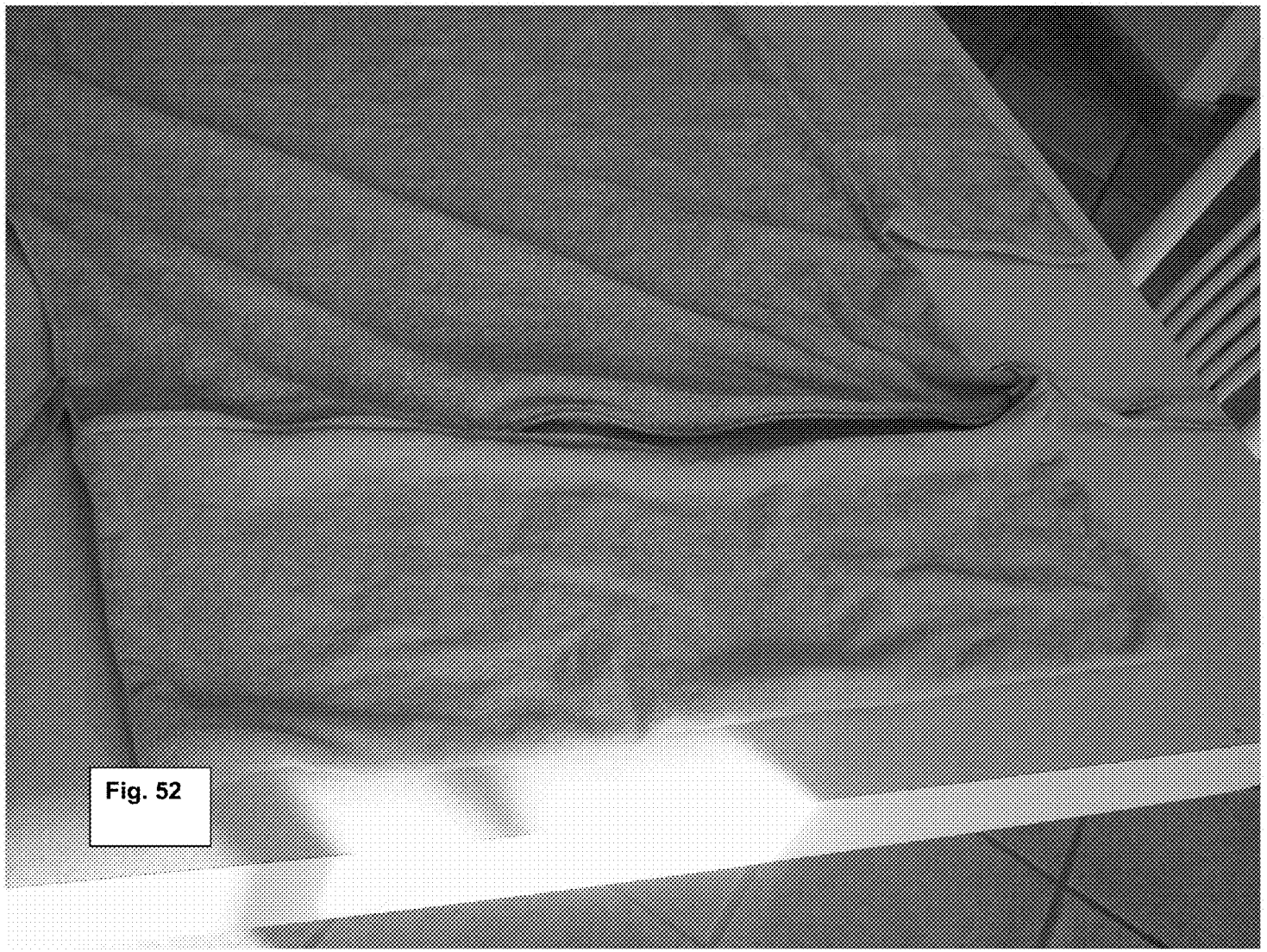
Figure 53:
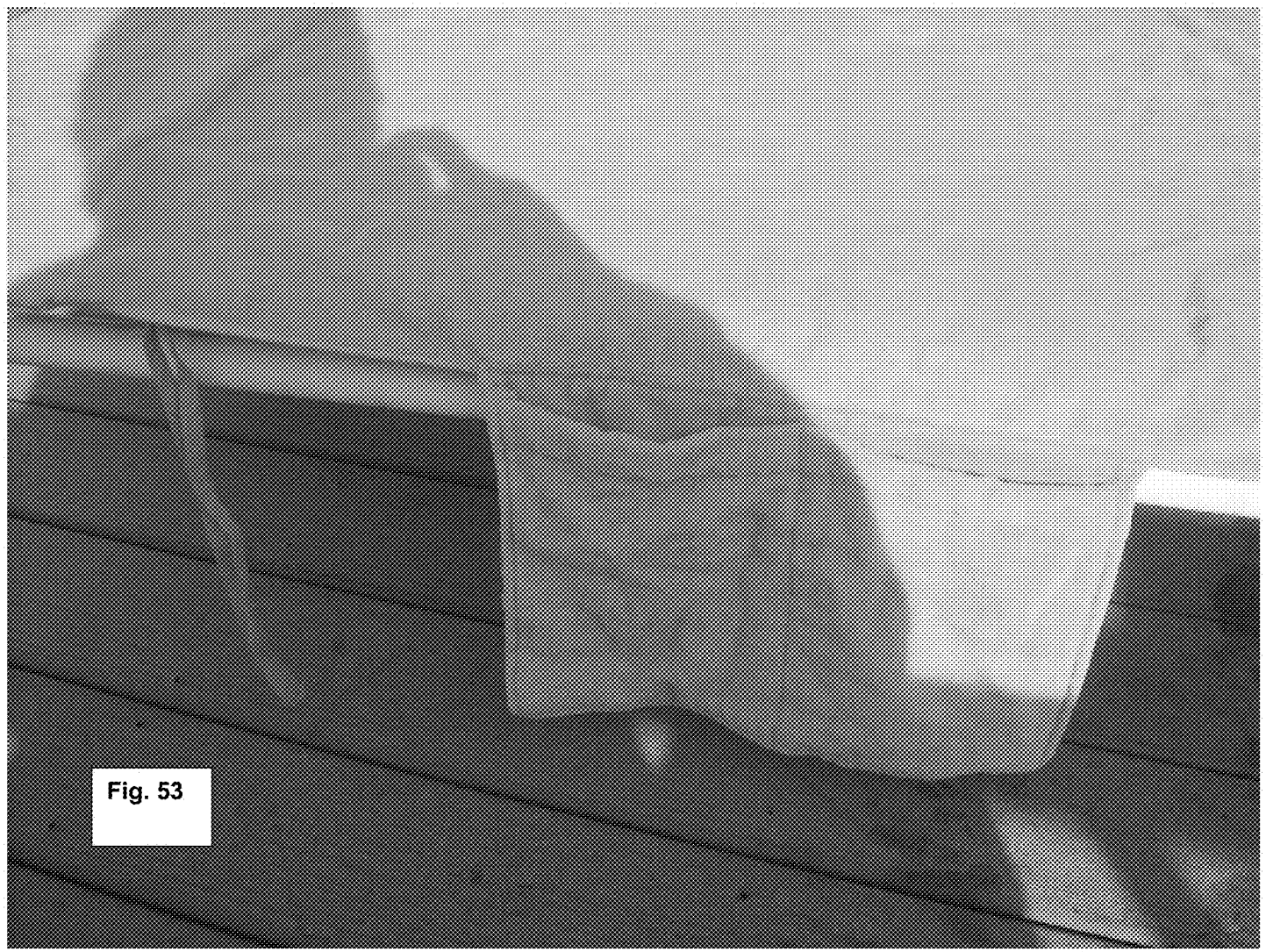
FIGS. 53-59 depict close-up views of various aspects of the exemplary beach chair cover of FIG. 1 as placed on an exemplary beach chair.
Figure 58:
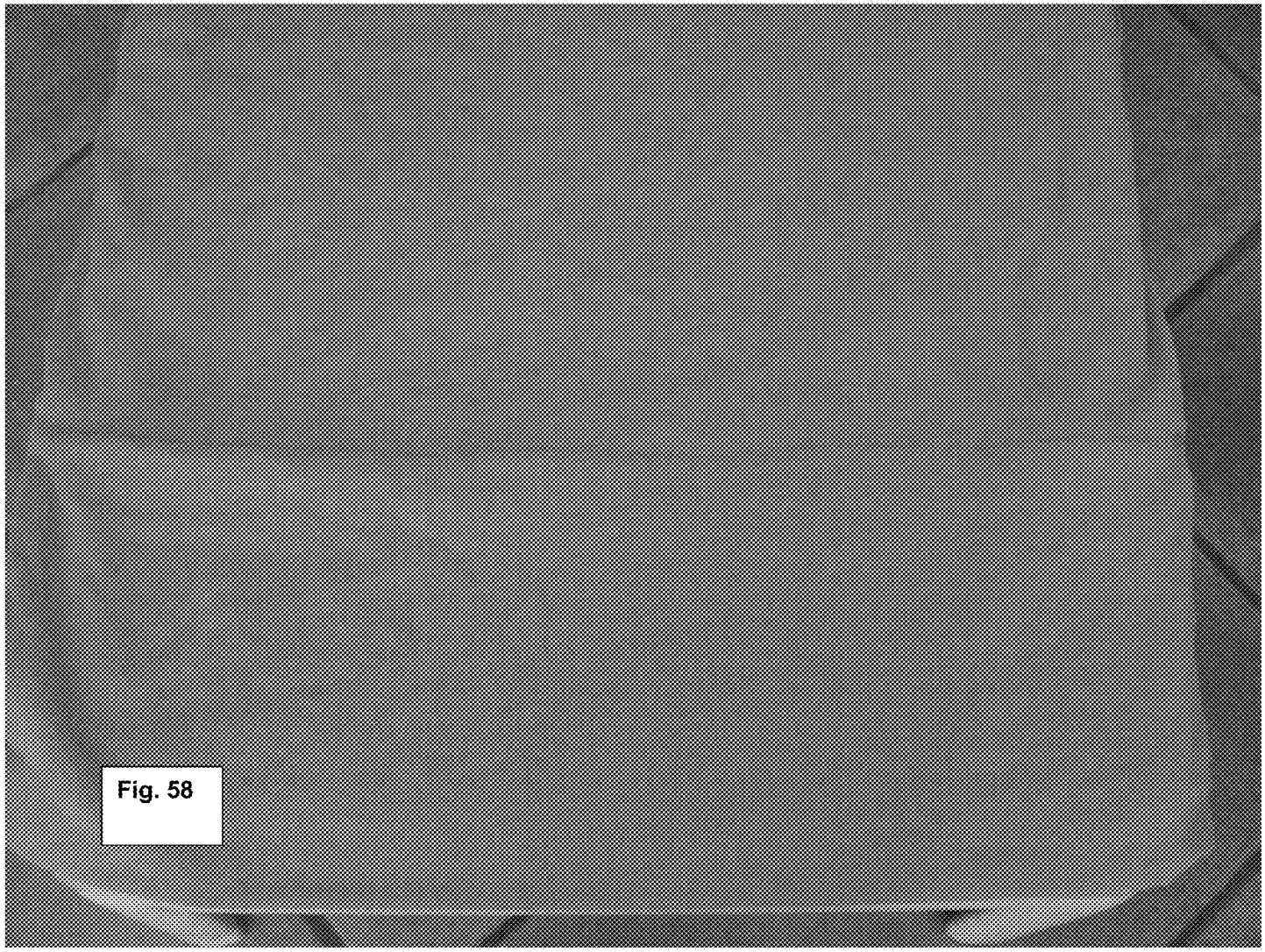
Figure 59:
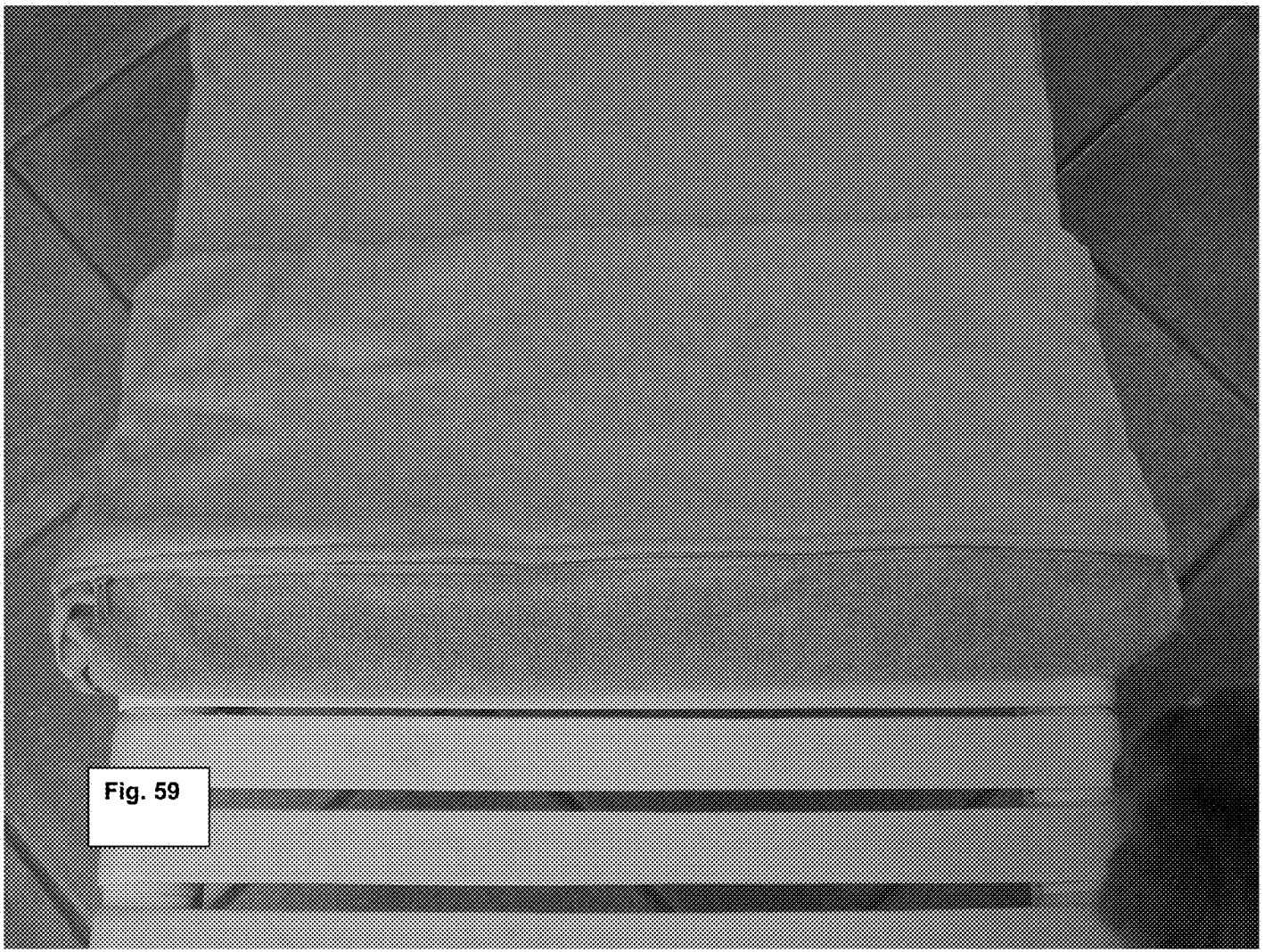

In exemplary embodiments of the present invention, there can be provided a hidden closable pouch on the underside of the beach chair cover at or near its footward end. The hidden closable pouch can be unseen when the beach chair cover is properly placed and affixed to a beach chair, and thus only viewed if the user unfastens the footward portion of the beach chair cover, then pulls back the footward end of the beach chair cover and folds it back over the beach chair cover and unzips or otherwise opens the hidden pouch. This results in a deterrent to theft, as a potential thief would need to bend down, unfasten the beach chair cover from the beach chair, then fold back the hidden pouch and open it. Additionally, the hidden pouch can be closed via a closure mechanism, which can include, for example, zippers, buttons, zippers with locks, VELCRO, "hook and loop", "burr" and "touch" fasteners, ties, snaps and any other means which may be appropriate using various known techniques. For example, FIG. 9 is a close-up of an exemplary beach chair cover depicting a footward concealed flap pouch folded back for viewing. FIG. 52 is a close up view of the underside of an exemplary zipper pouch of an exemplary beach chair cover with the zipper unzipped, and FIGS. 58 and 59 respectively depict normal and folded back positions of a footward closable pouch of an exemplary beach chair cover. Similarly, FIG. 60 depicts a hidden zipped pocket.

As described below in connection with FIG. 61, in exemplary embodiments of the present invention a beach chair cover can be of various lengths, so as to cover a variety of chairs, be they the longer lounge type chair or the normal "sitting up" chair as shown in FIG. 61.

Figure 3:
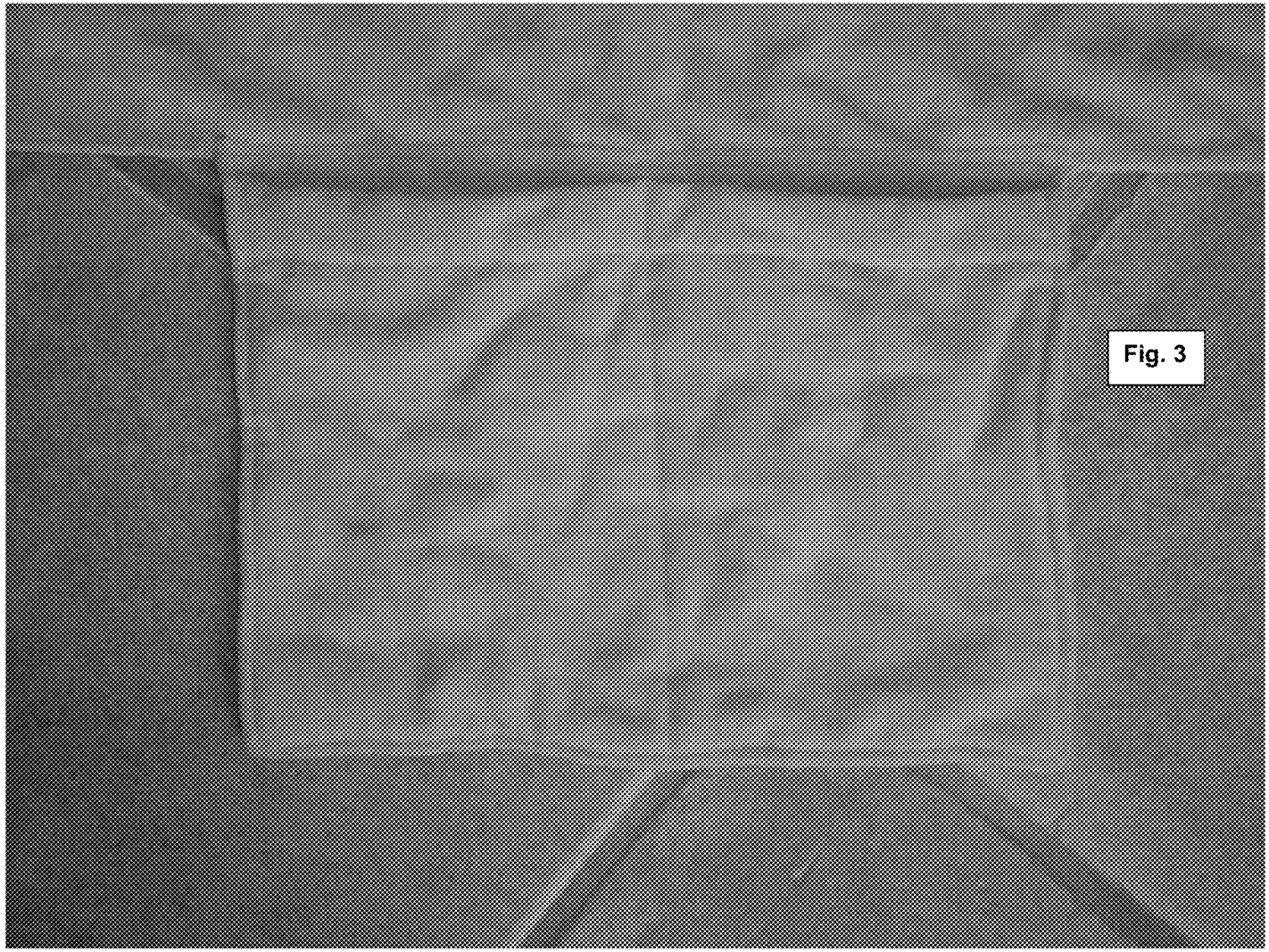
FIG. 3 is a close-up of one of the pairs of double side pockets of the exemplary beach chair cover of FIG. 1.
Figure 4:
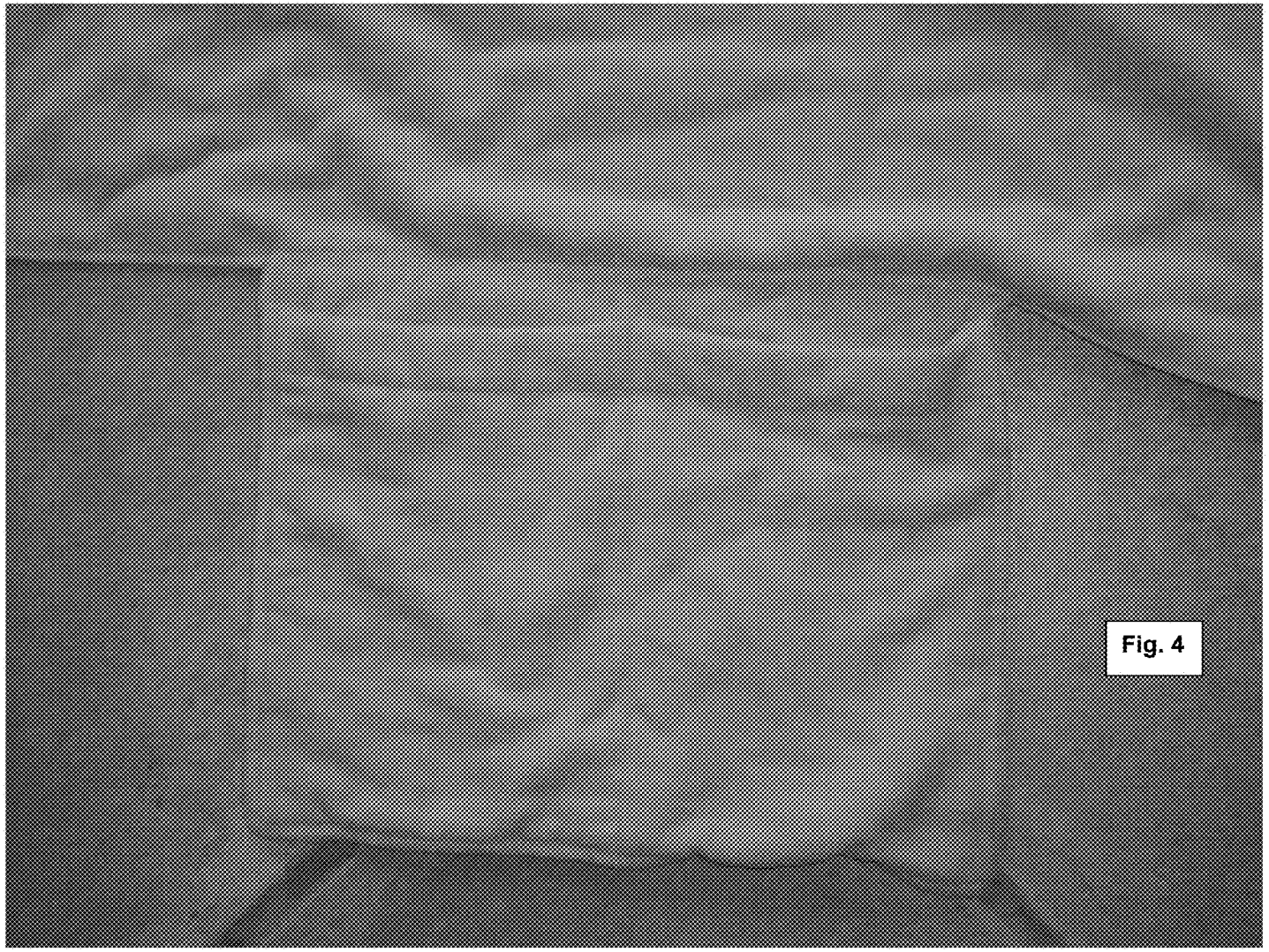
FIG. 4 is a close-up of the other pair of double side pockets of the exemplary beach chair cover of FIG. 1.
Figure 47:
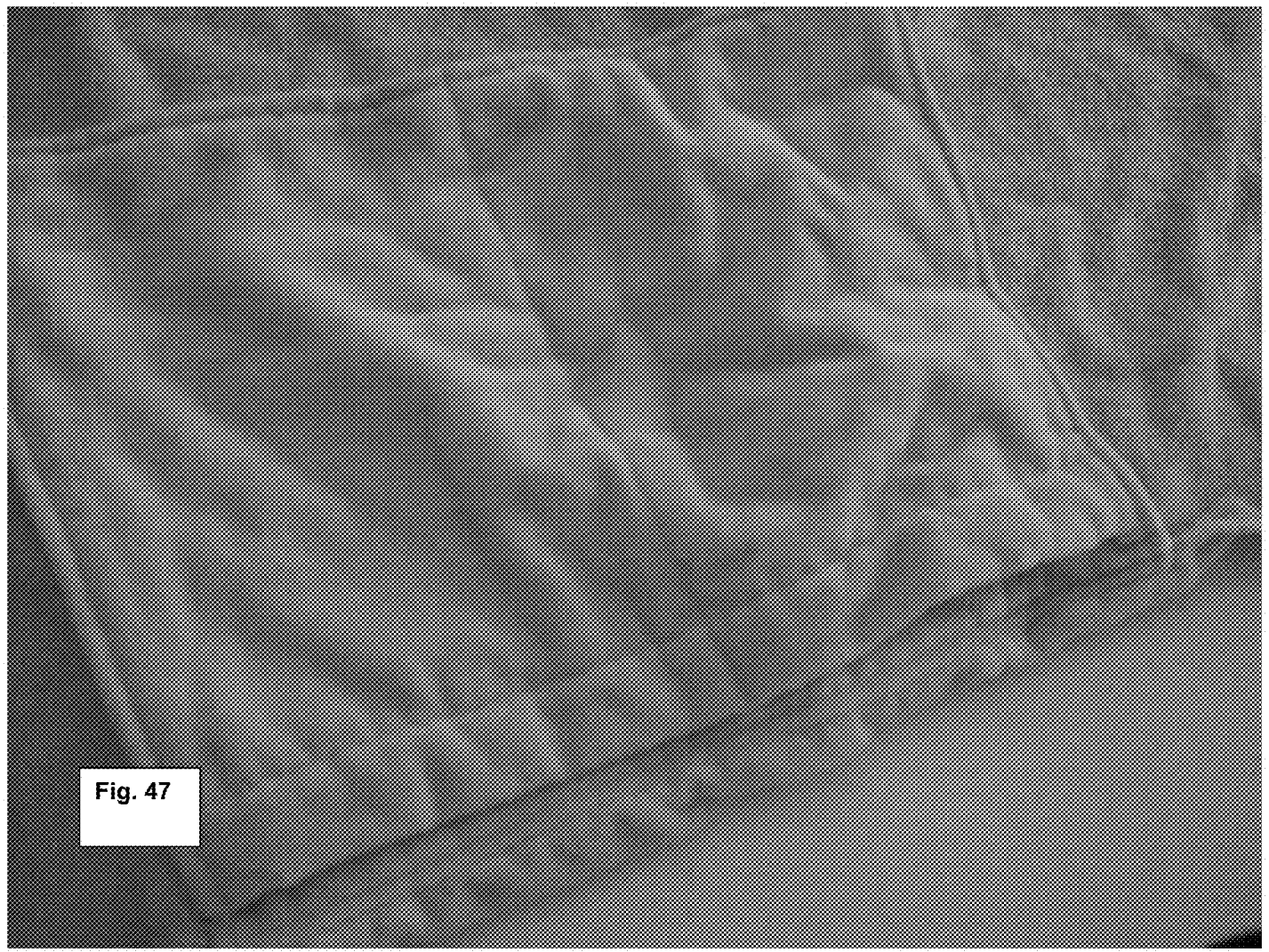
Figure 48:
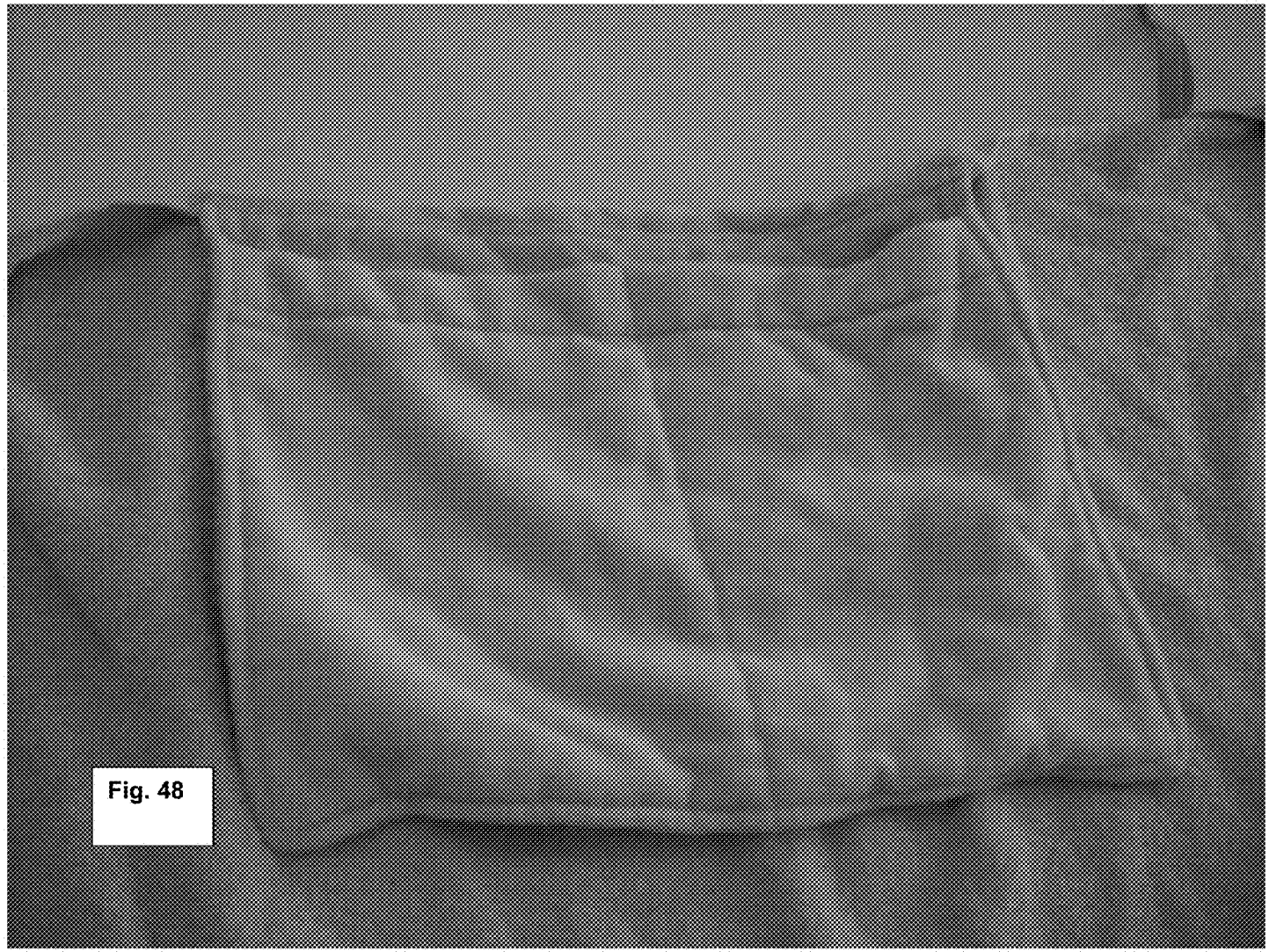
Figure 49:
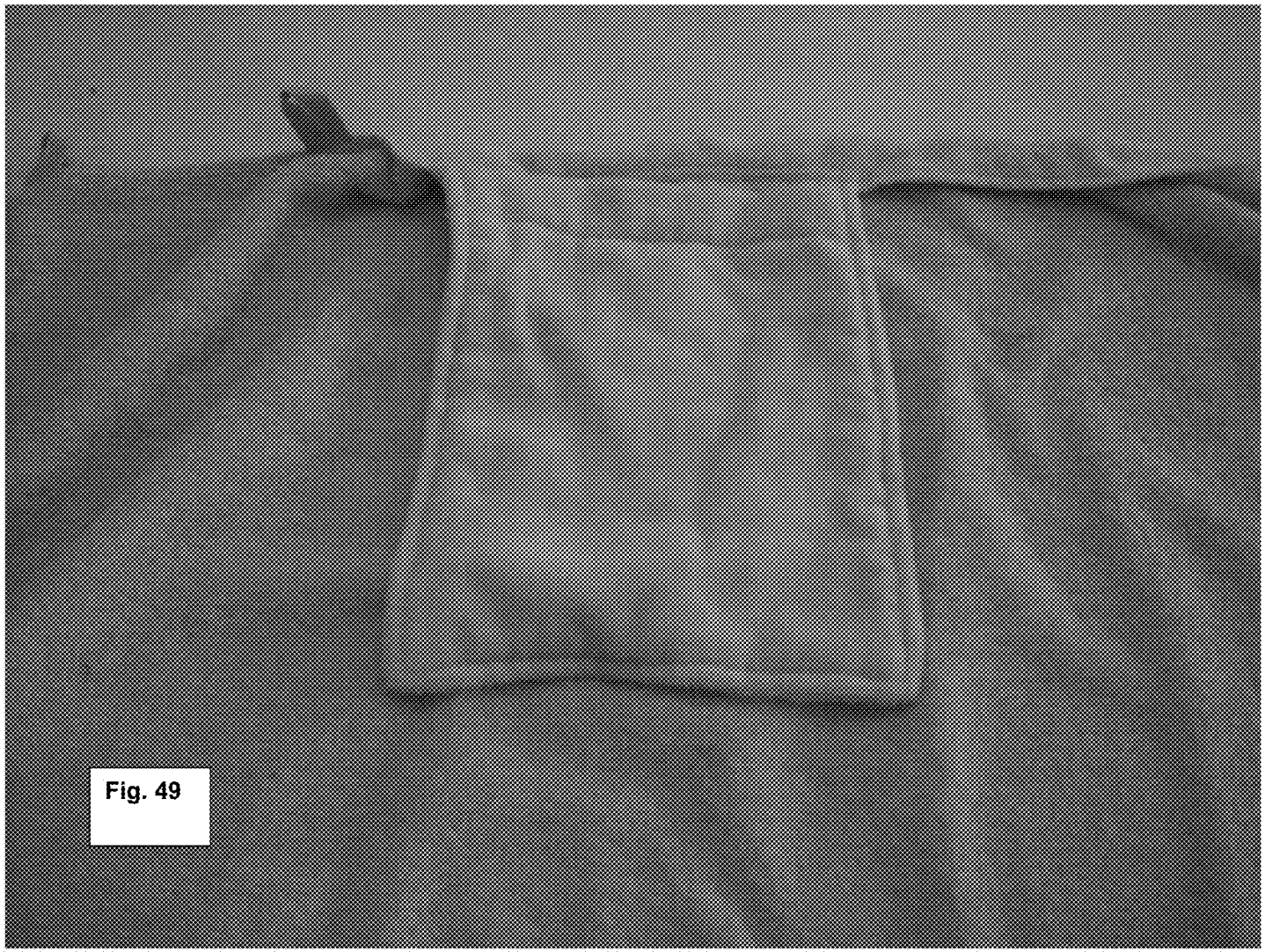
Figure 50:
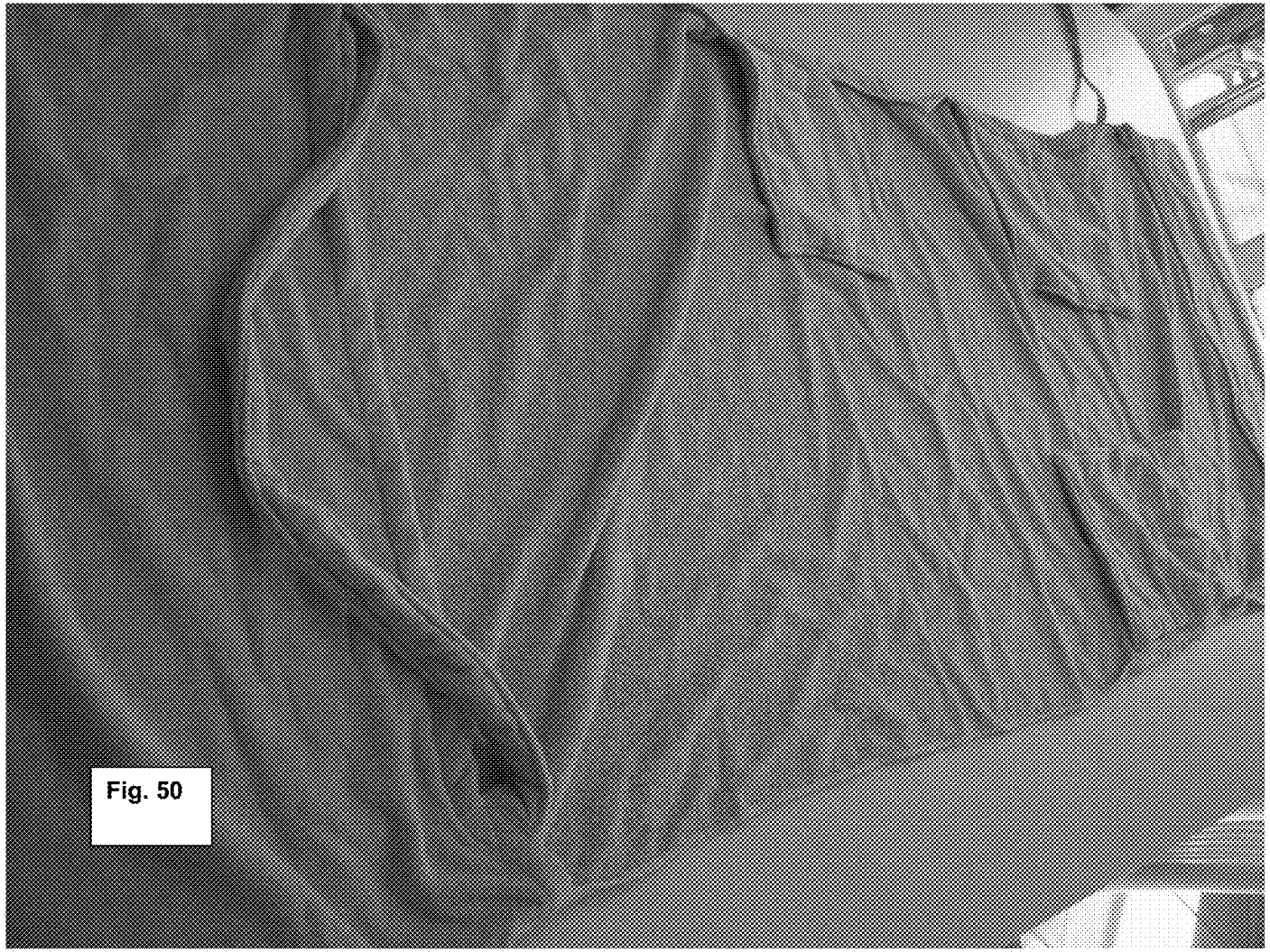
Figure 51:
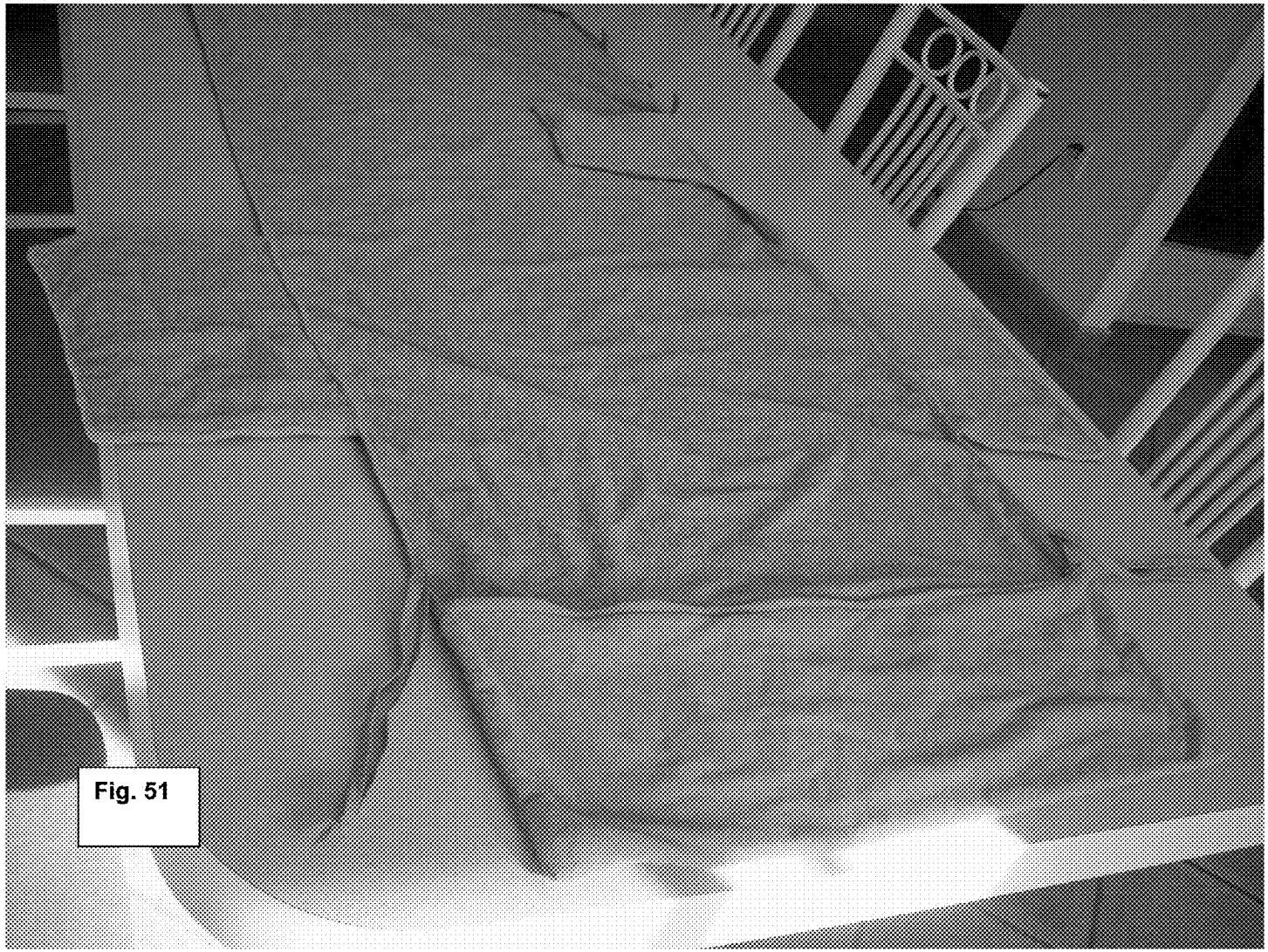

In exemplary embodiments of the present invention a portable beach chair cover can have numerous pockets sewn onto the sides at convenient places along the longitudinal ends of the linkwise sides of the beach chair cover. These pockets can be arranged in, for example, single, double or triple sets of pockets. A single pocket, or one in a se of two or three, can be sized so as to accommodate an MP3 player, portable satellite radio receiver, or other media device. For example, FIG. 3 depicts a close-up of one set of double side-pockets of an exemplary beach chair cover, and FIG. 4 depicts a close-up of another set of double side-pockets of the exemplary beach chair cover of FIG. 3. FIG. 47 is a close up of an exemplary double side-pocket folded over and sitting on an exemplary beach chair cover underside so that its front side can be seen, and FIG. 48 is the corresponding double side-pocket on the other side of the beach chair cover of FIG. 47. In the alternate exemplary embodiment of FIG. 60, there are two sets of triple side-pockets; the right side-pockets have the headward pocket of the set of three sized to hold an MP3 player, for example, and the left sided triple side-pockets have more uniform widths of the three side-pockets.

Figure 5:
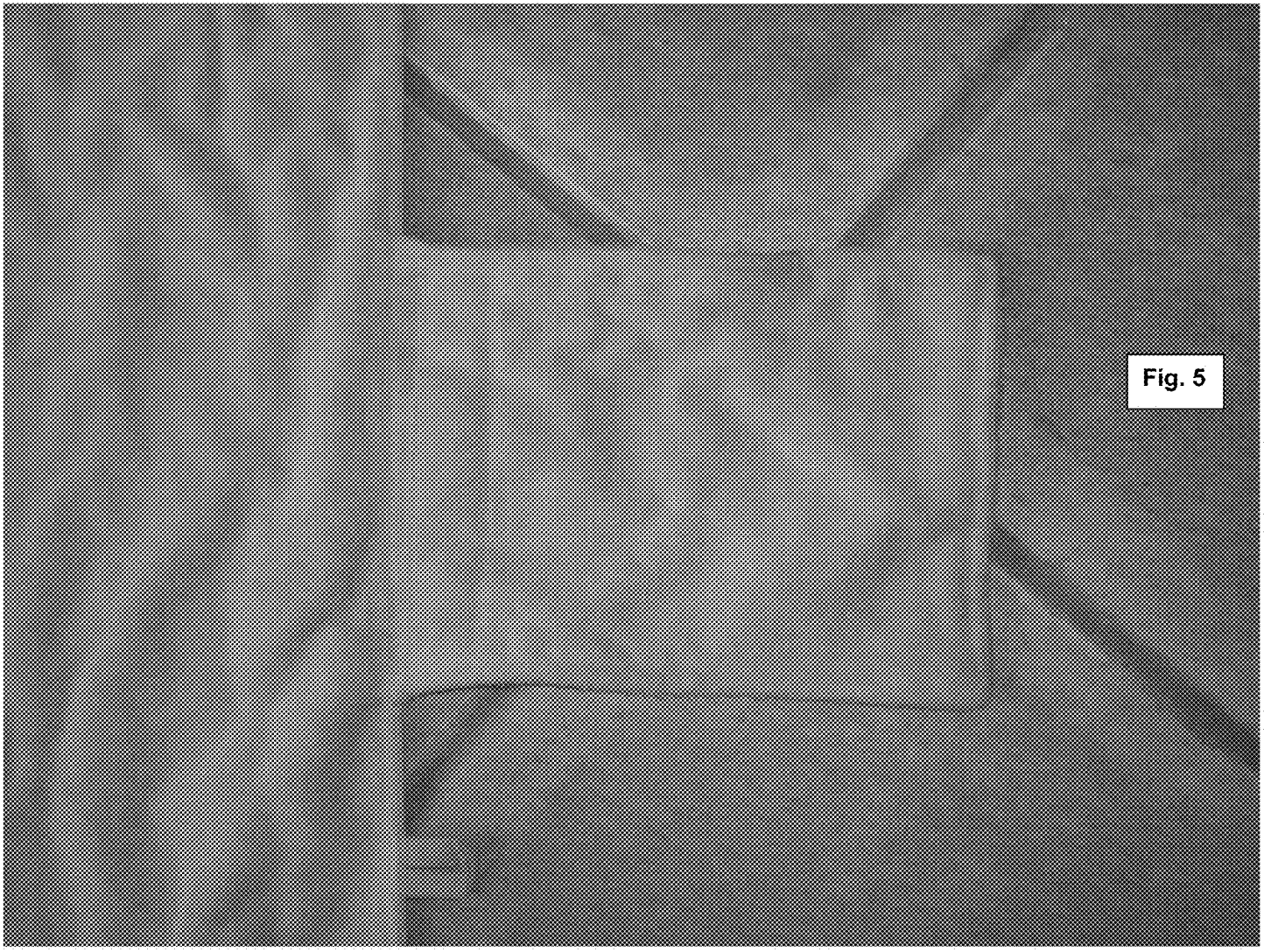
FIG. 5 depicts a single side pocket of the exemplary beach chair cover of FIG. 1 designed to hold electronic devices with a protruding cord.
Figure 6:
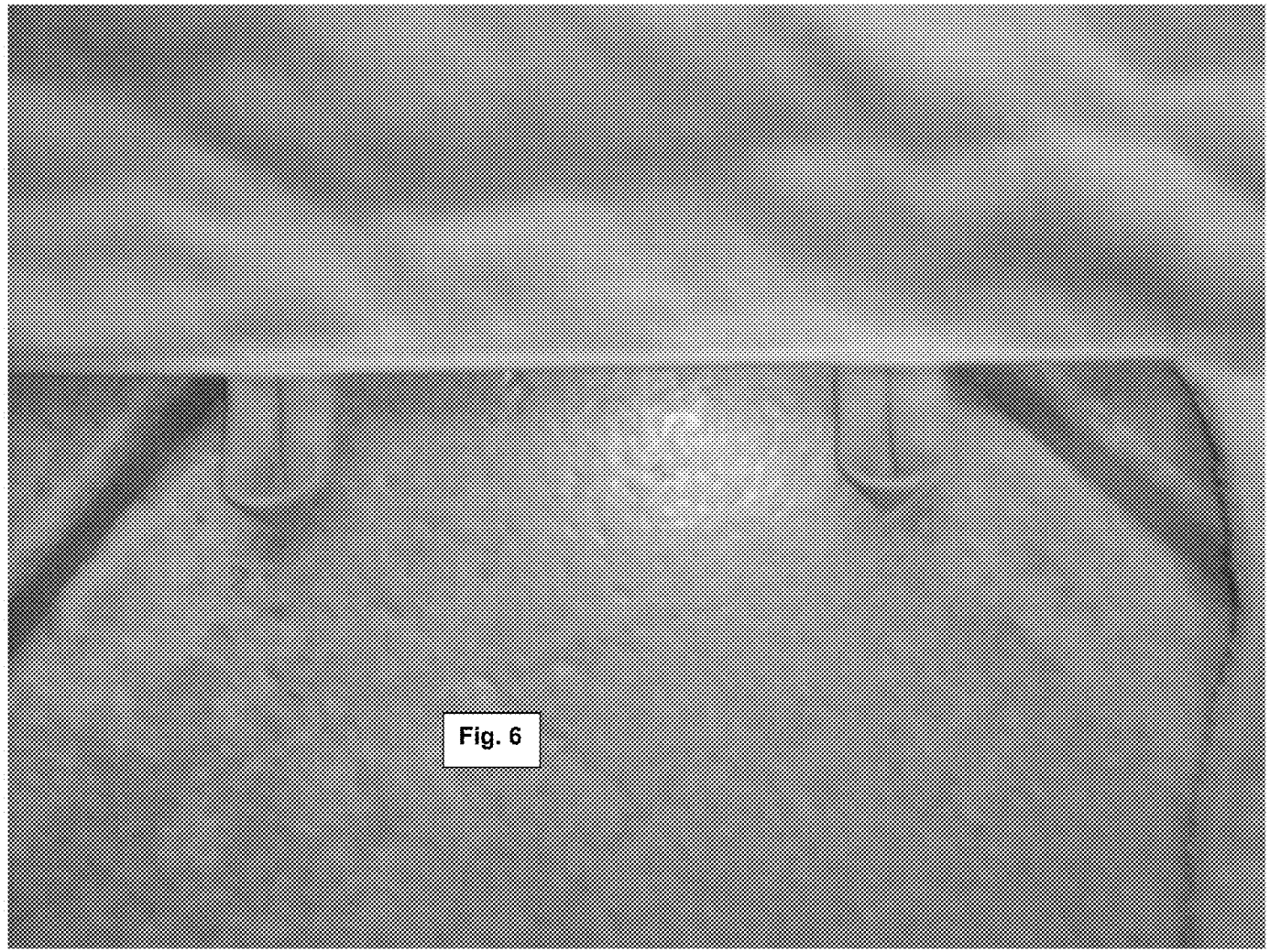
FIG. 6 is a close-up of two loops sewn in the side of the beach chair cover adjacent to the single pocket shown in close-up in FIG. 5.

Similarly, FIG. 5 depicts an exemplary single side pocket of the exemplary beach chair cover of FIGS. 3-4 designed to hold small electronic devices, such as, for example, an MP3 player, a portable satellite radio receiver, such as a Sirius Stilletto™, XM MP3 device, or the like.

The various pockets on an exemplary beach chair cover can be closed using any means described above in connection with the hidden closable pouch, or can be left open, as shown in FIGS. 3-4 and 60. These pockets can be tailored to various sizes as may be appropriate to hold items such as a user of a beach chair would bring to a beach chair environment. As noted, such items can include, for example, sunglasses, suntan lotion, books, drinks in cans or other receptacles, portable media devices such as Blackberrys, cell phones, MP3 players, portable radios, portable satellite radios, DVD players, etc. and all of these items can be neatly stored in the one or more pockets sewn into the sides of the beach chair cover.

Figure 25:
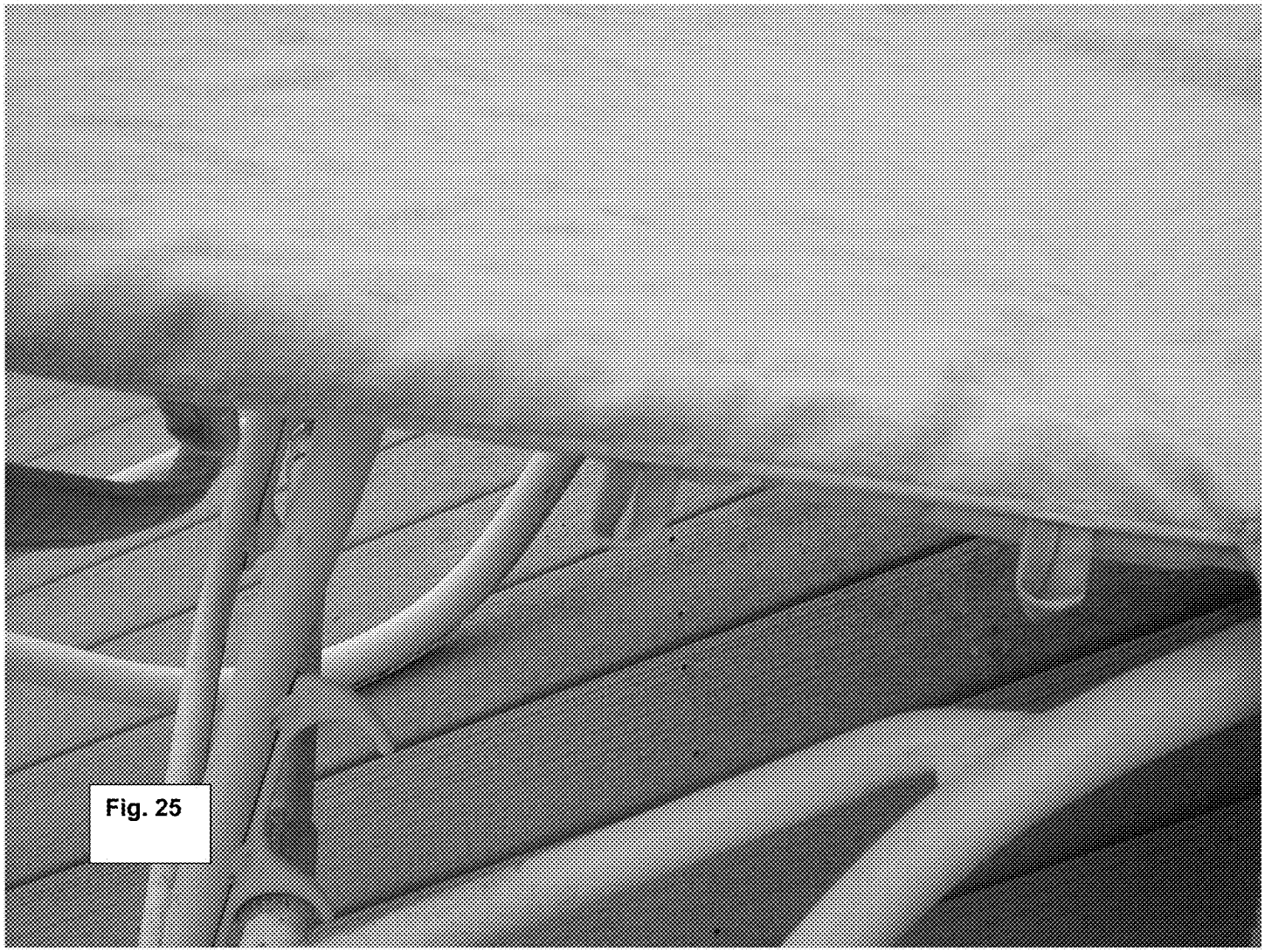
FIG. 25 depicts three loops on the right side of the exemplary beach chair cover adjacent to a single pocket pouch as shown in FIG. 12.
Figure 26:
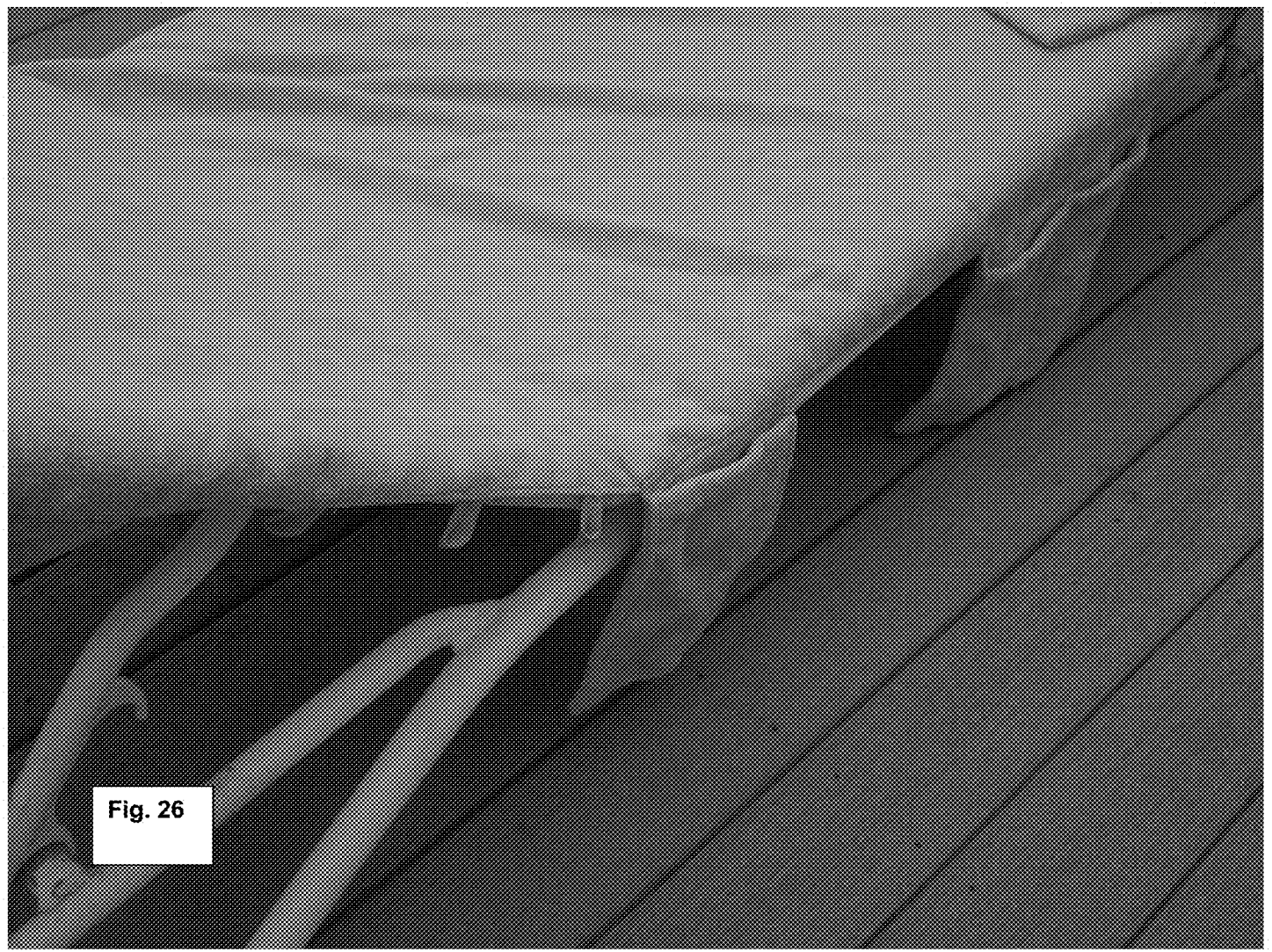
FIG. 26 is a zoomed out view of the same loops of FIG. 25.
Figure 43:
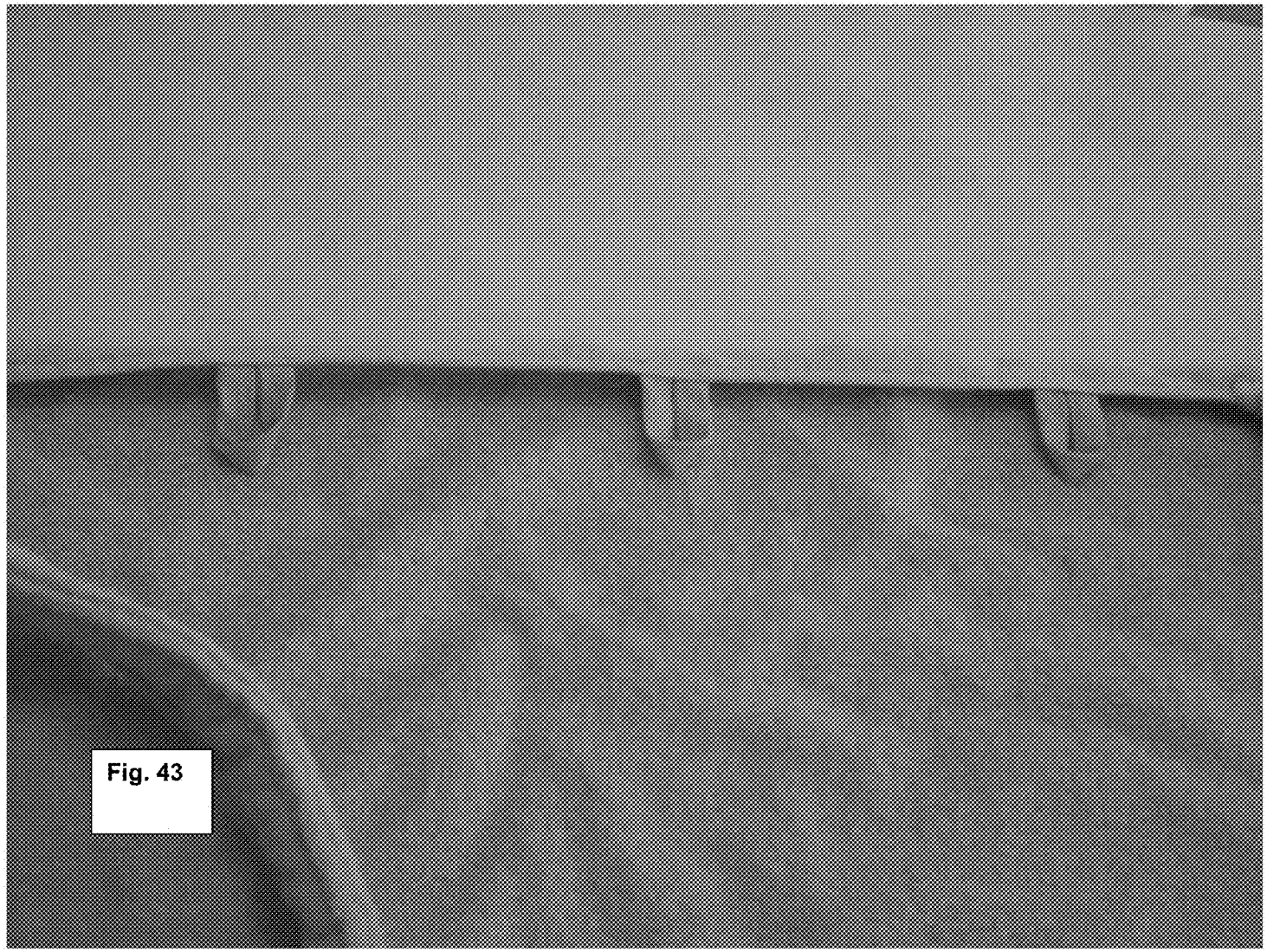
Figure 44:
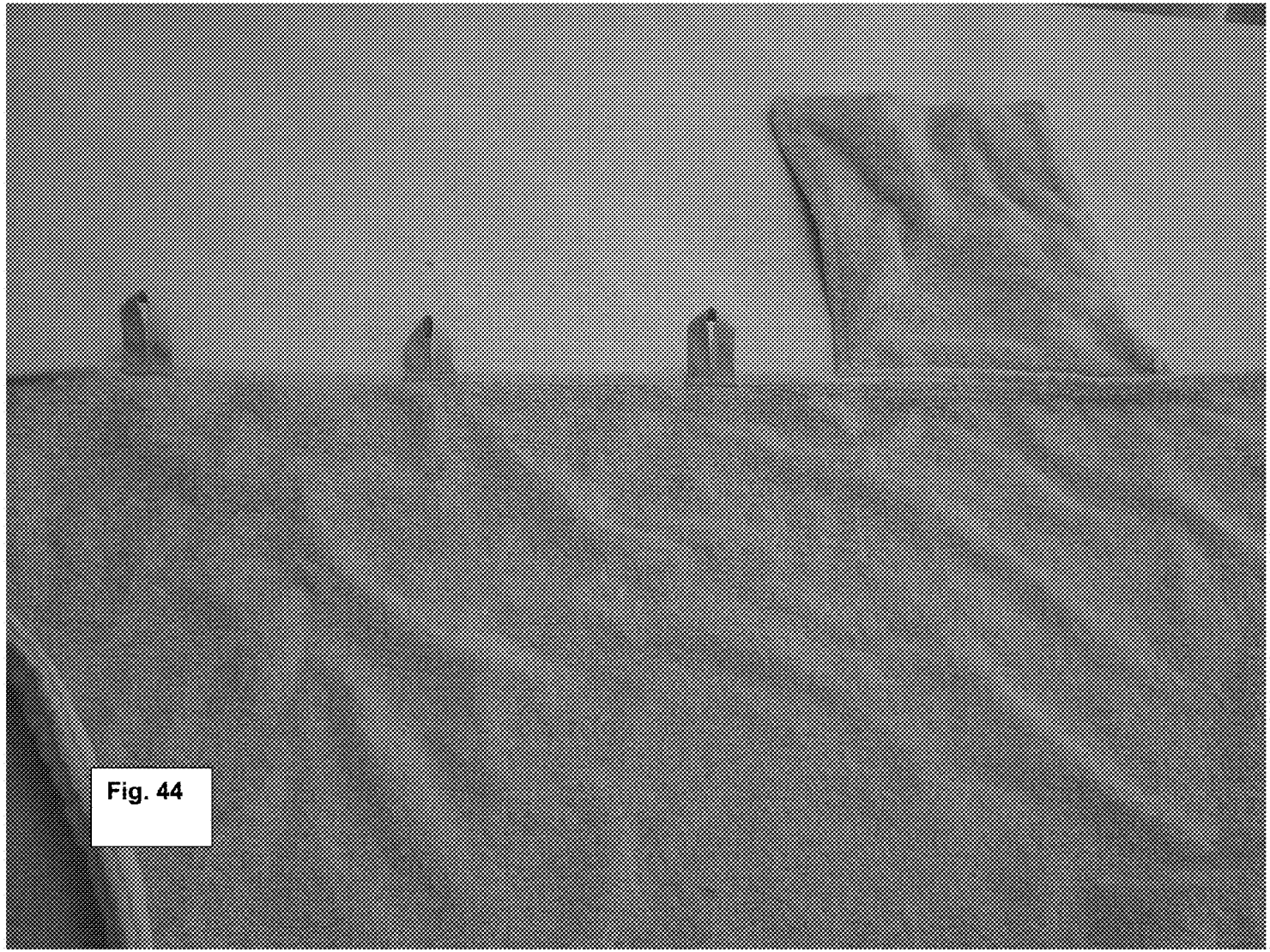
Figure 45:
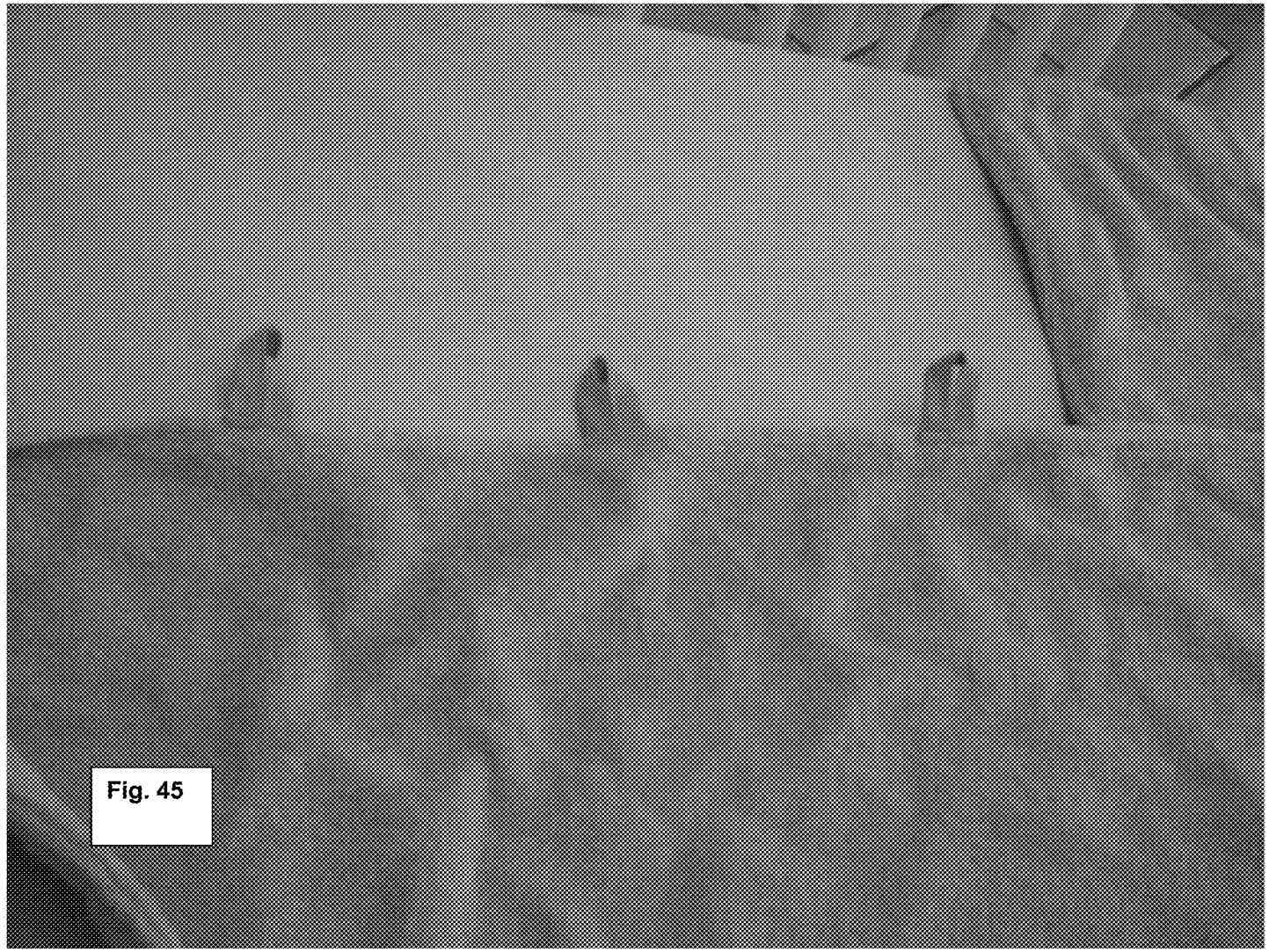
Figure 46:
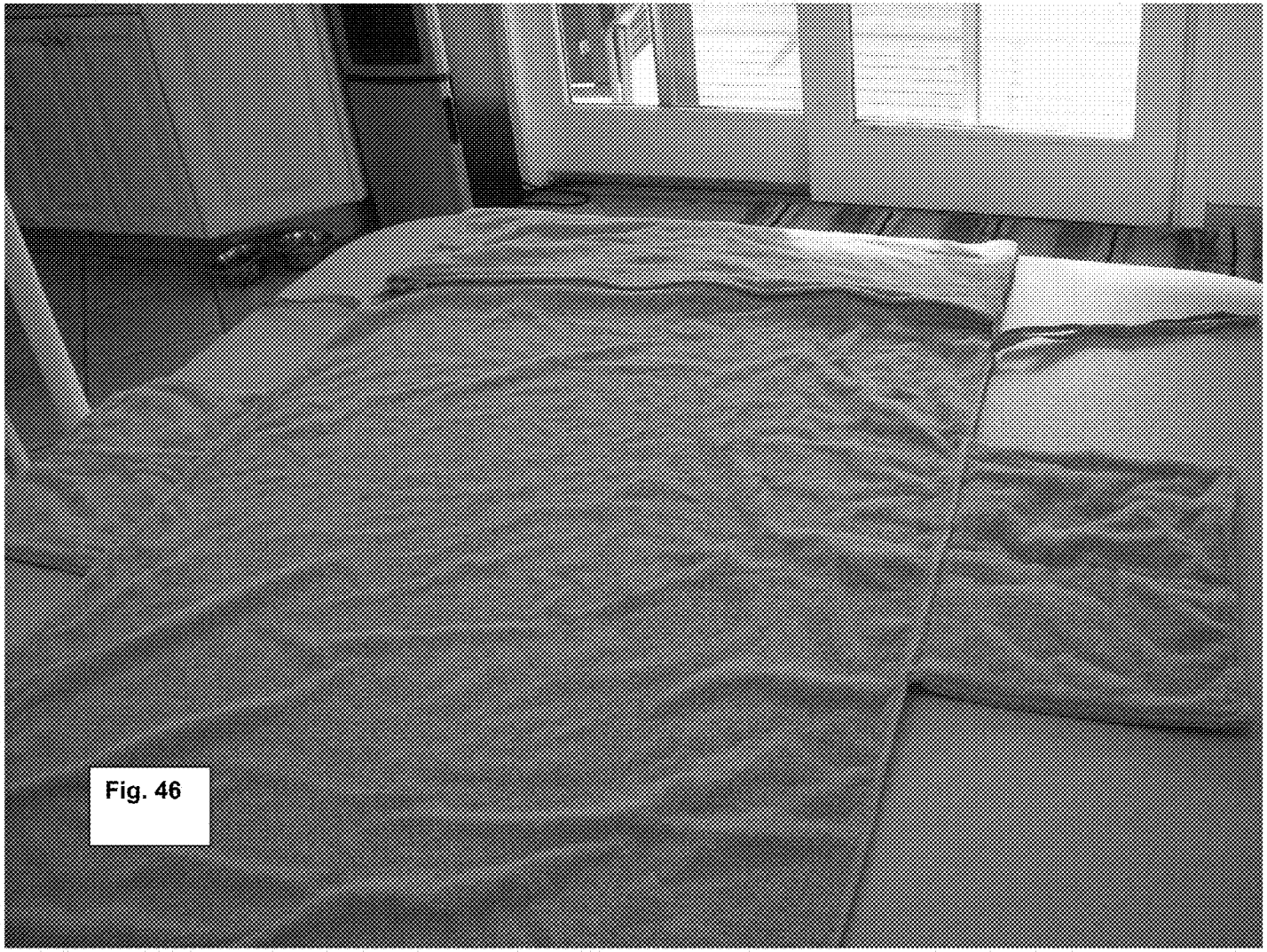

Additionally, in exemplary embodiments of the present invention a portable beach chair cover can have a number of loops or guideholes sewn into its side closer to the headward portion of the beach chair cover, such that an earphone cord or earphones cord or other cords running into any of the media playing devices stored in any of the pockets of the beach chair cover can be appropriately guided and neatly placed for use. Thus, for example, FIG. 25 depicts three loops on the right side of an exemplary beach chair cover adjacent to a single pocket pouch, and FIG. 26 is a zoomed out view of the same loops of FIG. 25. Similarly, FIG. 43 is a close up of the three loops of an exemplary beach chair cover.

In exemplary embodiments of the present invention, in addition to being affixed by the slip cover type cavity at the headward side and the ties or other affixing means at the footward side, various elastic bands can be sewn onto the underside beach chair cover around portions of its perimeter such that it more securely grabs the beach chair.

In exemplary embodiments of the present invention, there can be provided in the headward portion of the beach chair cover an opening in which a pillow can be inserted. Such a pillow can be waterproof, for example, and can be appropriate for beach and water environments. Additionally, for example, such a pillow insert can be washable, thus being easily removable and cleanable.

Similarly, in exemplary embodiments of the present invention, a beach chair cover can include an inflatable pillow that fits into the opening described above. In such embodiments when the beach chair cover is put onto a beach chair the pillow can be inflated in the inside pocket so that the pillow is on the lounge towel side and a person can rest their head thereupon.

A pillow can be inflated by mouth, by a small pump included in the beach chair cover (and conveniently stowed inside the beach chair cover when it is folded into a tote bag), or by some automatic inflation mechanism such as is commonly used on automotive air bags, for example.

Figure 27:
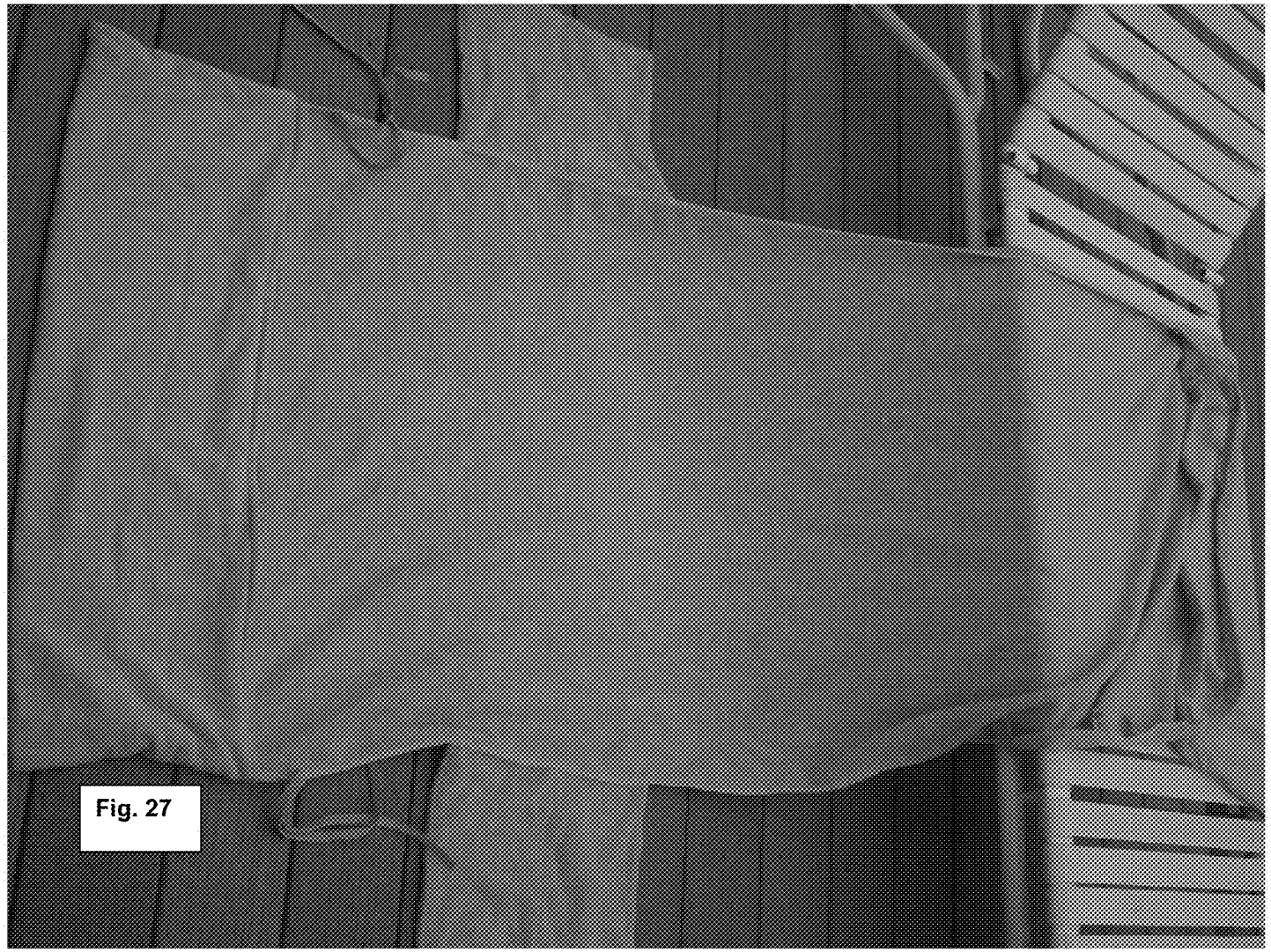
FIG. 27 depicts an initial step in folding up an exemplary beach chair cover.
Figure 28:
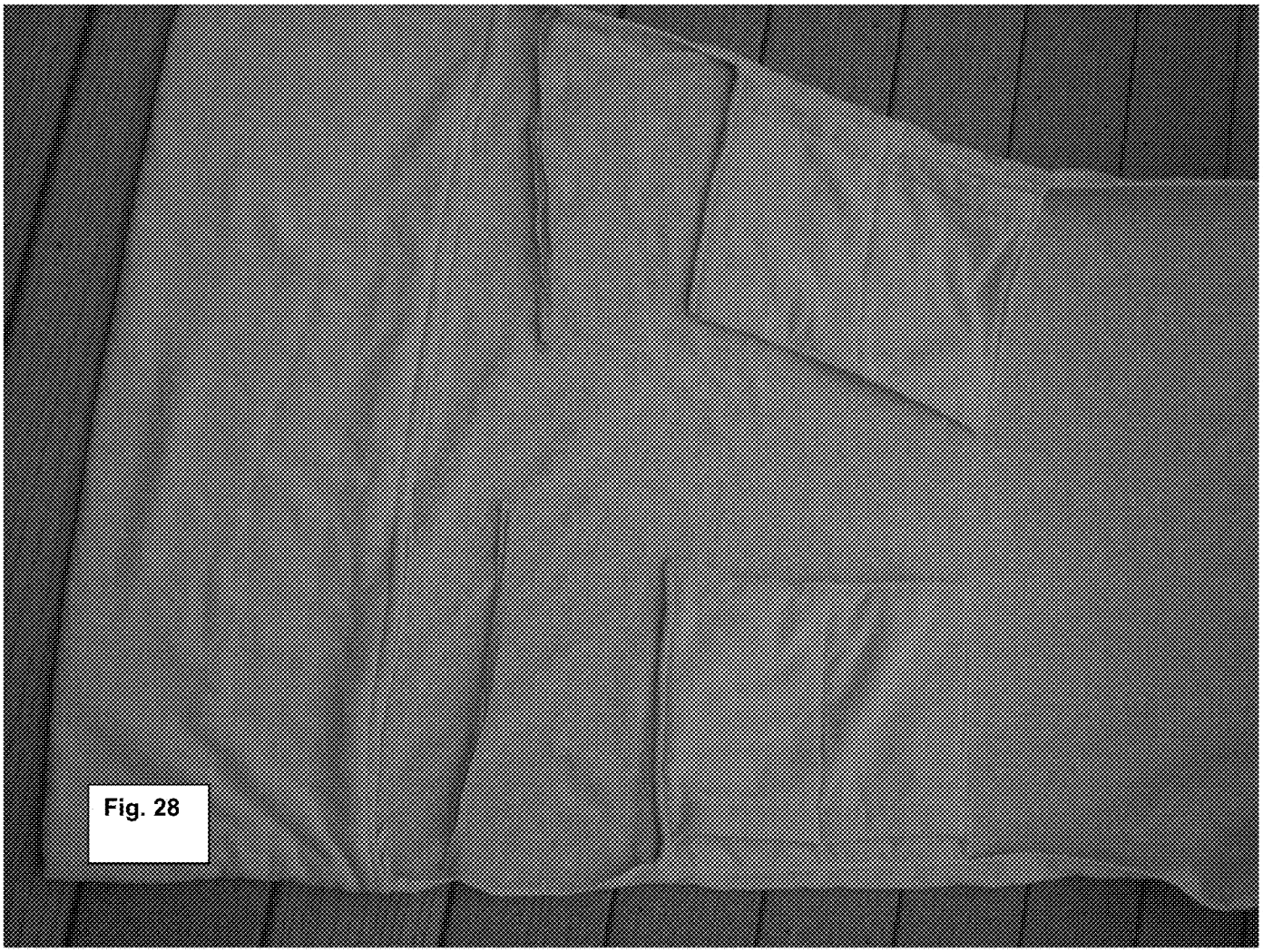
FIG. 28 depicts exemplary double pocket pouches and the exemplary ties in a folded position.
Figure 29:
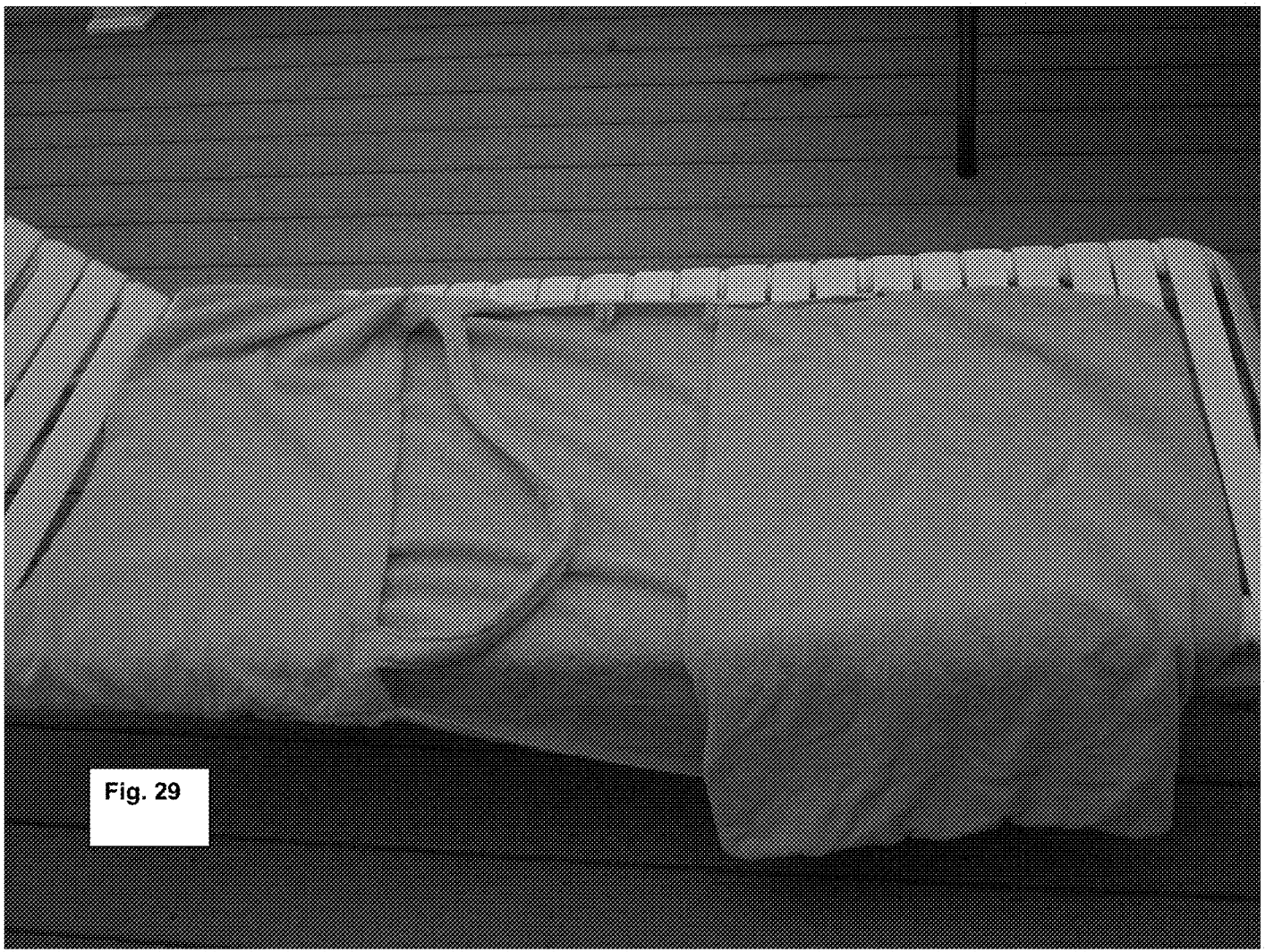
FIG. 29 shows a further stage in folding an exemplary beach chair cover.
Figure 30:
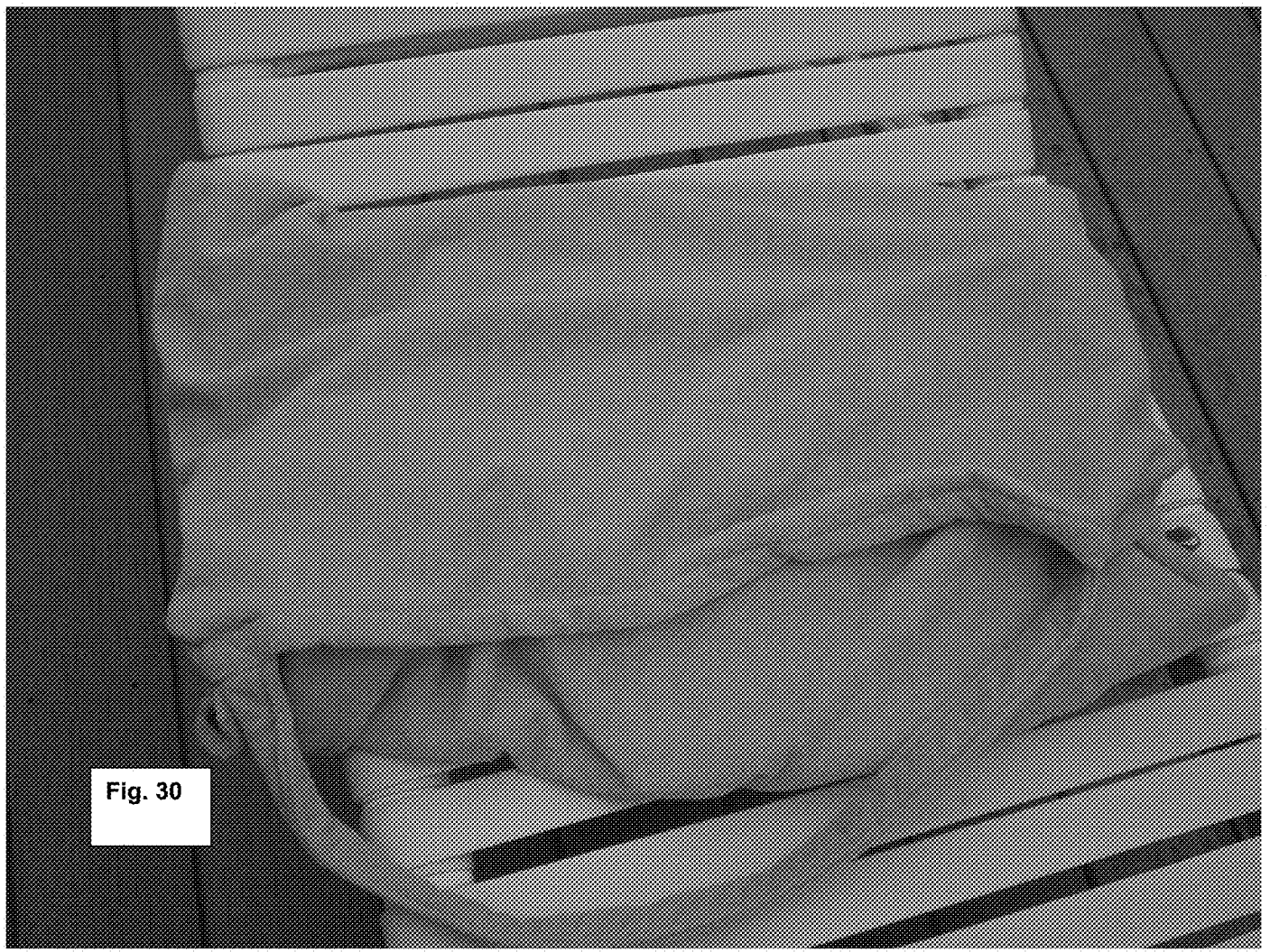
FIG. 30 shows a completely folded beach chair cover where all the material to the right of the headward portion of the exemplary beach chair cover as shown in FIG. 29 has been inserted into the headward pouch portion of the beach chair cover.
Figure 31:
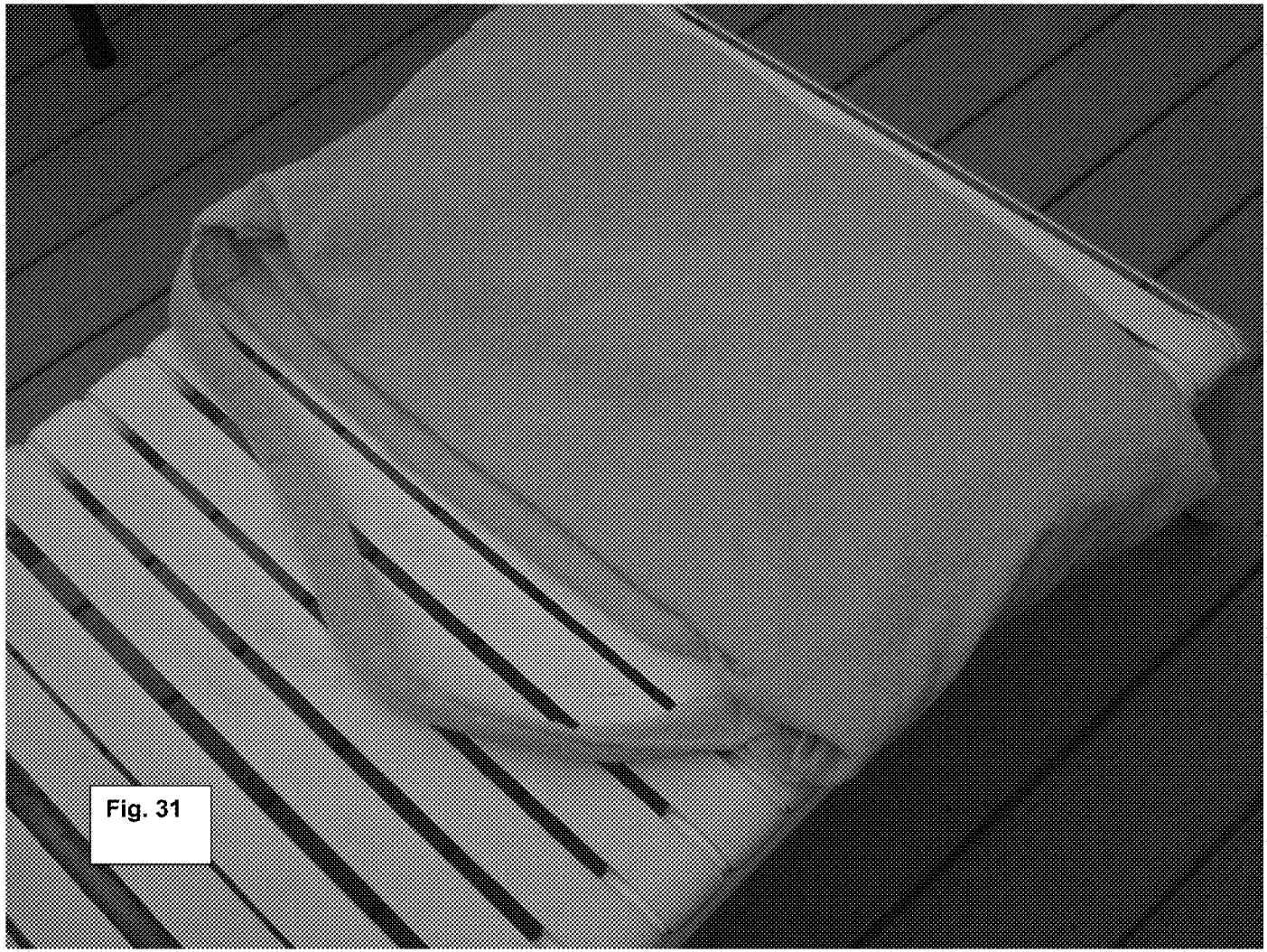
FIGS. 31-32 depict a totally folded beach cover ready to be lifted.
Figure 32:
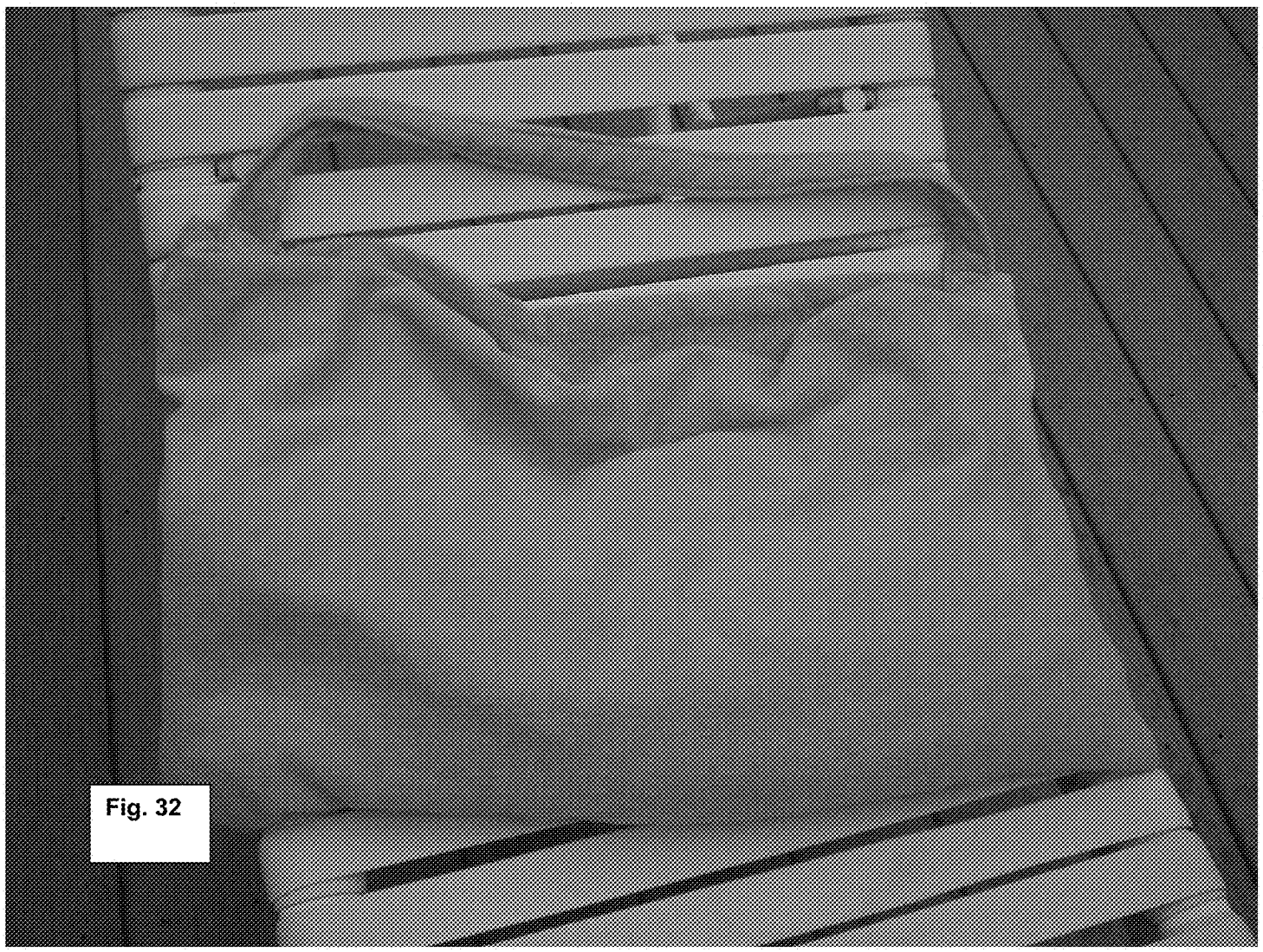
Figure 33:
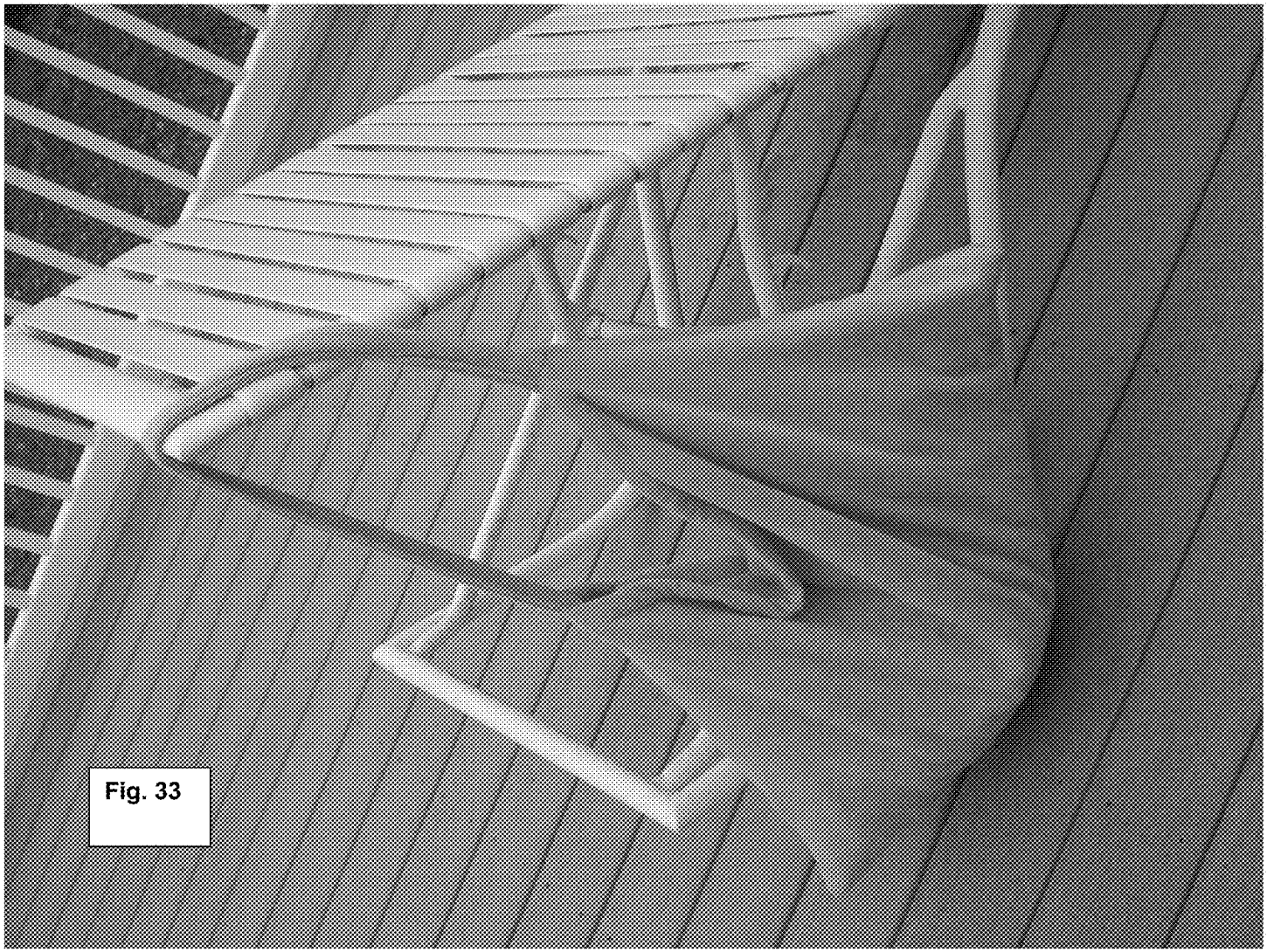
FIG. 33 shows the exemplary beach chair cover of FIGS. 31 and 32 hanging from the head portion of an exemplary beach chair.

In exemplary embodiments of the present invention, the entire beach chair cover can be folded up into the slip-over pouch provided at its headward end, and carried by means of a handle attached to the beach chair cover. This process is depicted, for example, in FIGS. 27, and 29-30. FIG. 27 depicts an initial step in folding up an exemplary beach chair cover, FIG. 29 shows a further stage in folding an exemplary beach chair cover, and FIG. 30 shows a completely folded beach chair cover where all the material to the right of the headward portion of the exemplary beach chair cover as shown in FIG. 29 has been inserted into the headward slip-over pouch portion of the beach chair cover. Similarly, FIGS. 31-32 depict a totally folded beach cover ready to be carried by a user, and FIG. 33 shows the exemplary beach chair cover of FIGS. 31 and 32 hanging from the head portion of an exemplary beach chair.

Figure 34:
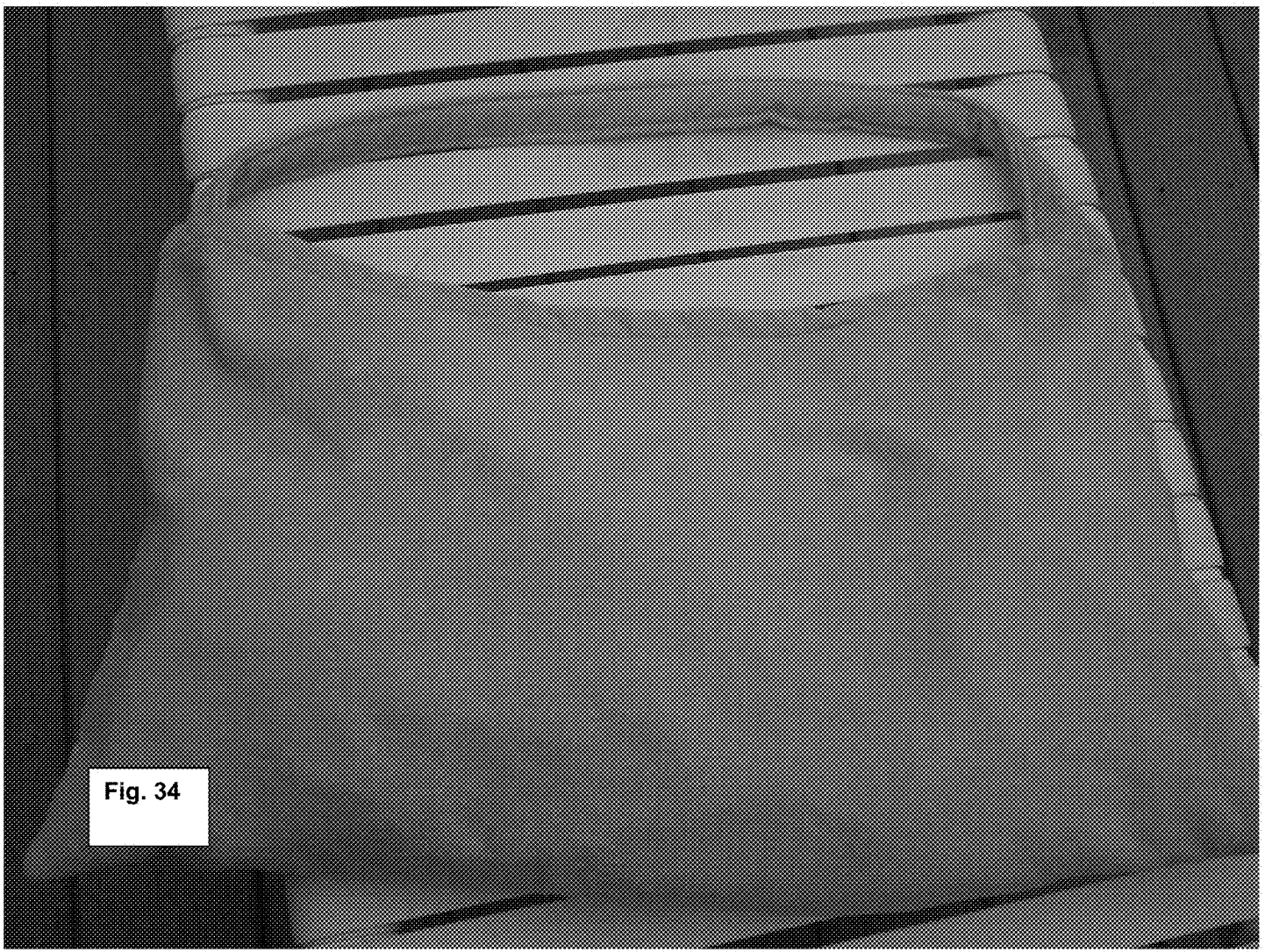
FIGS. 34-35 are other views of the exemplary beach chair cover of FIGS. 31-33.
Figure 35:
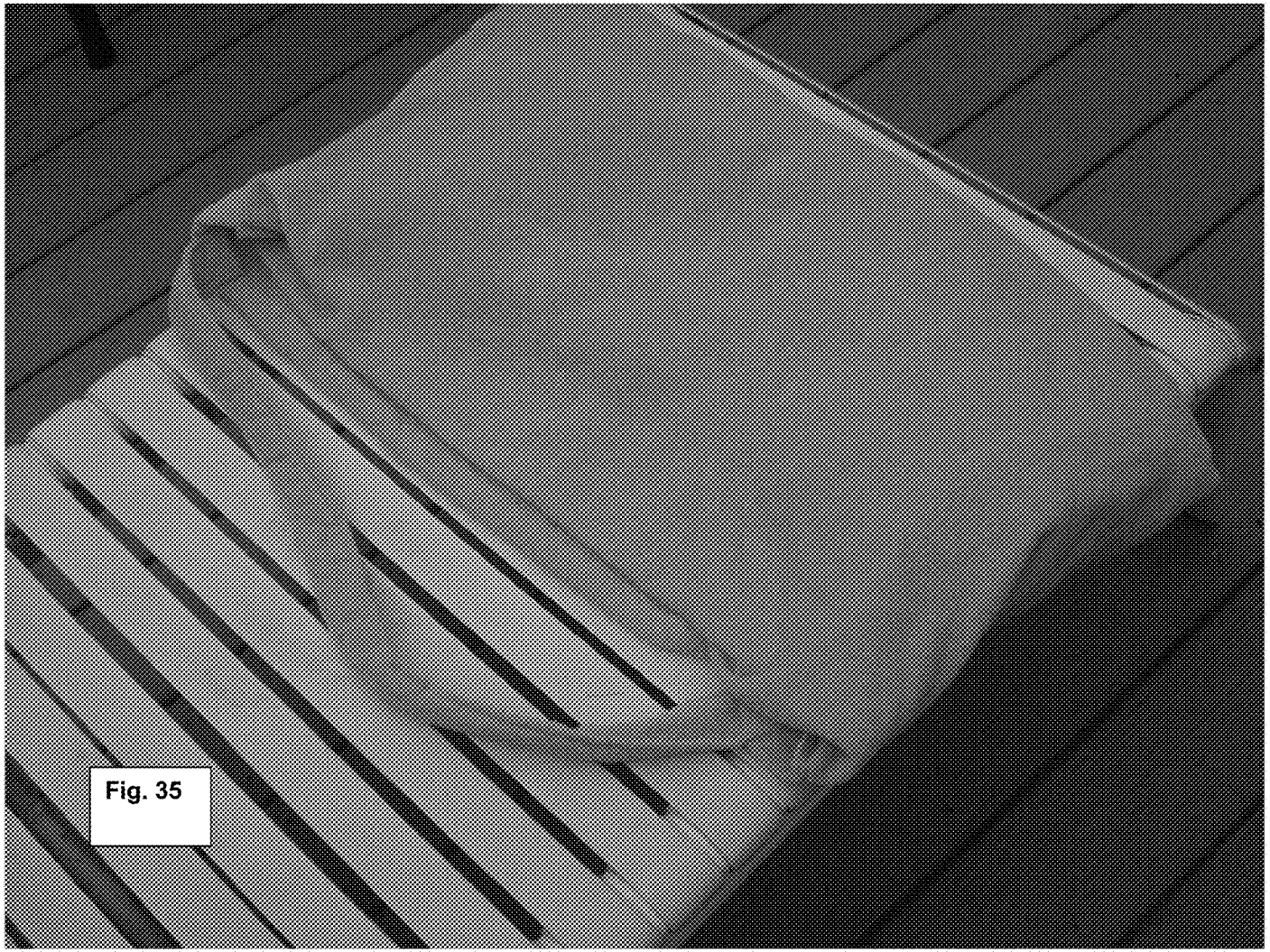
Figure 36:
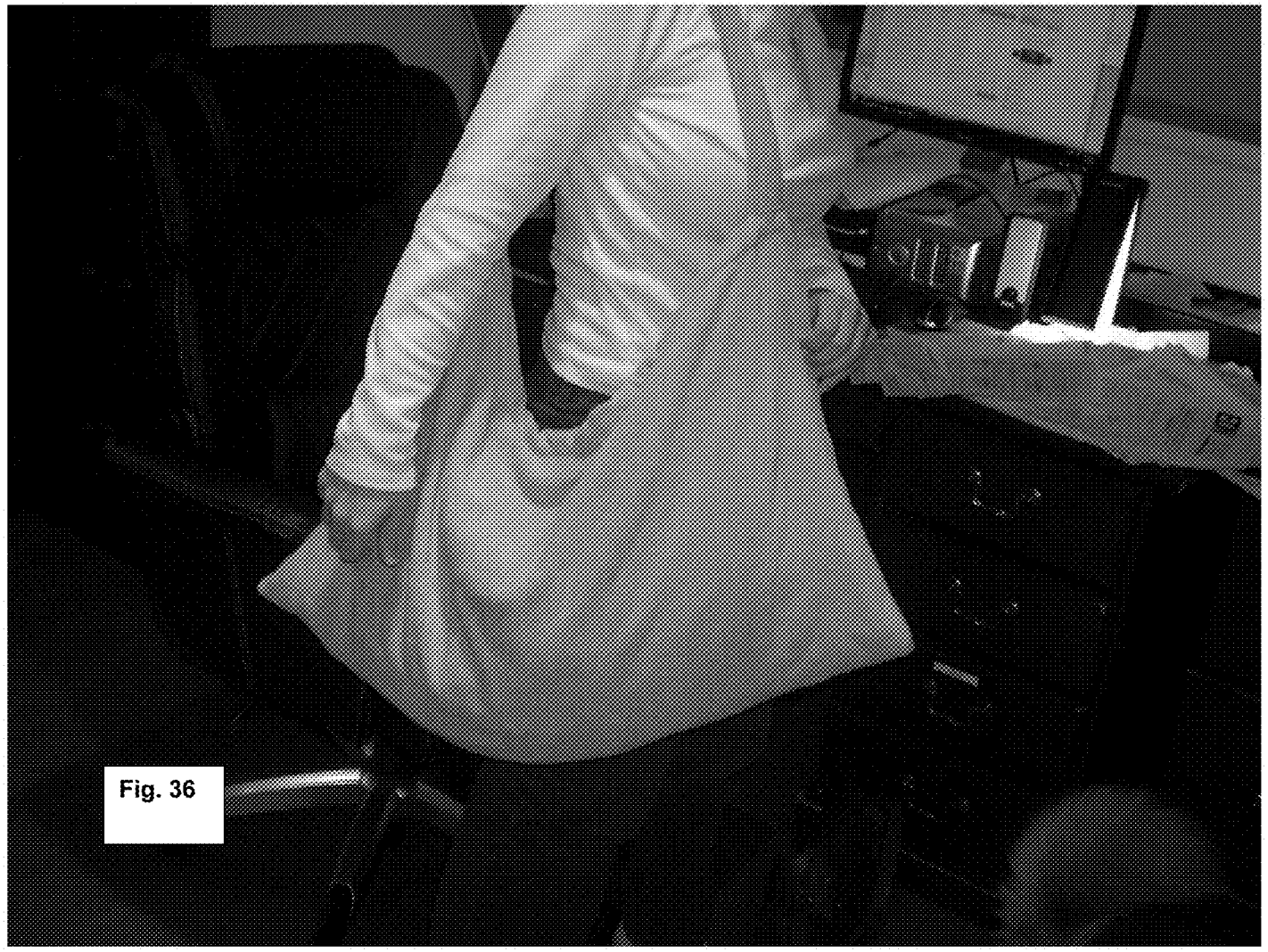
FIGS. 36-37 depict a folded up exemplary beach chair cover slung around the shoulder of a young lady.
Figure 37:
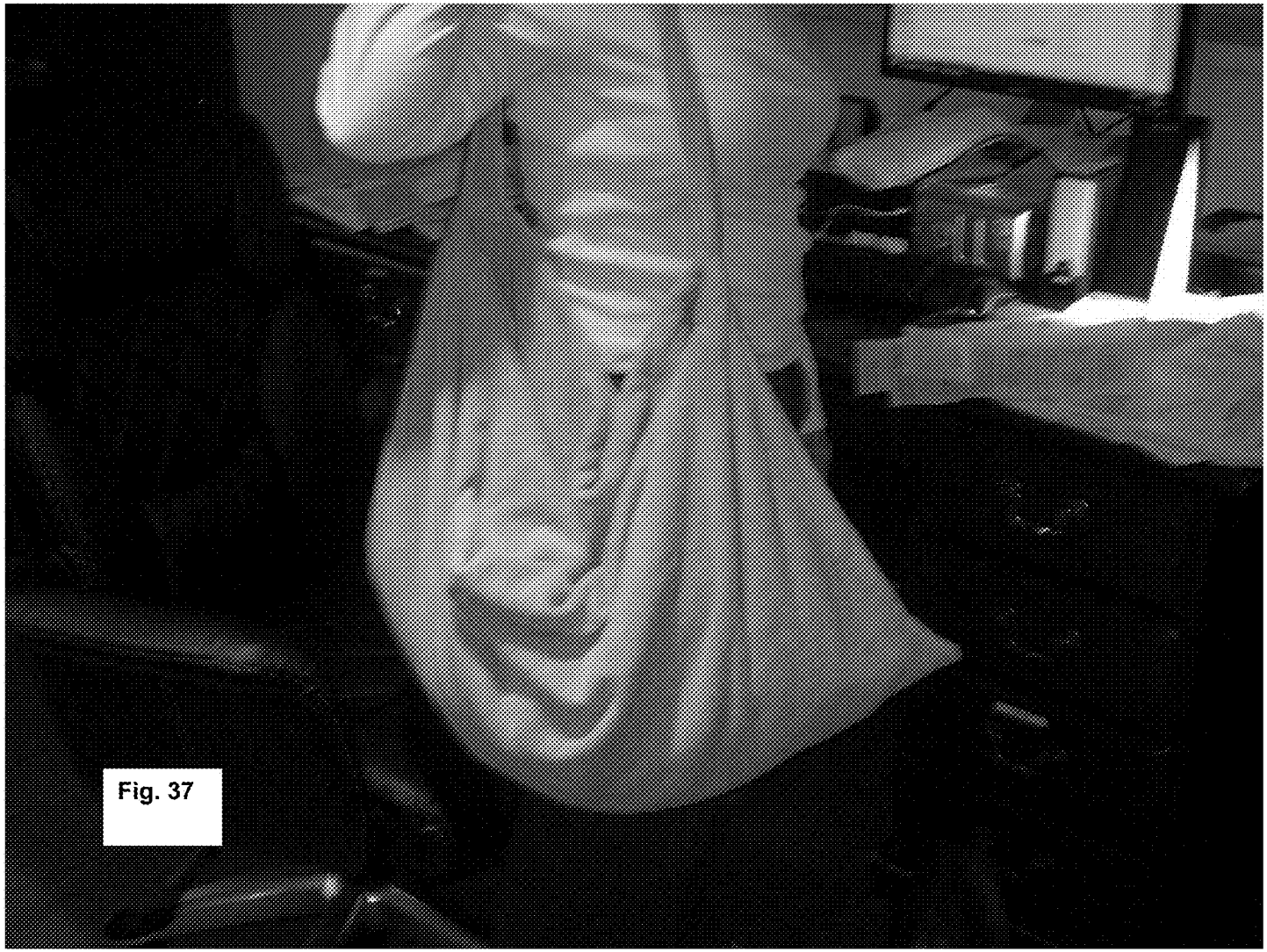
Figure 38:
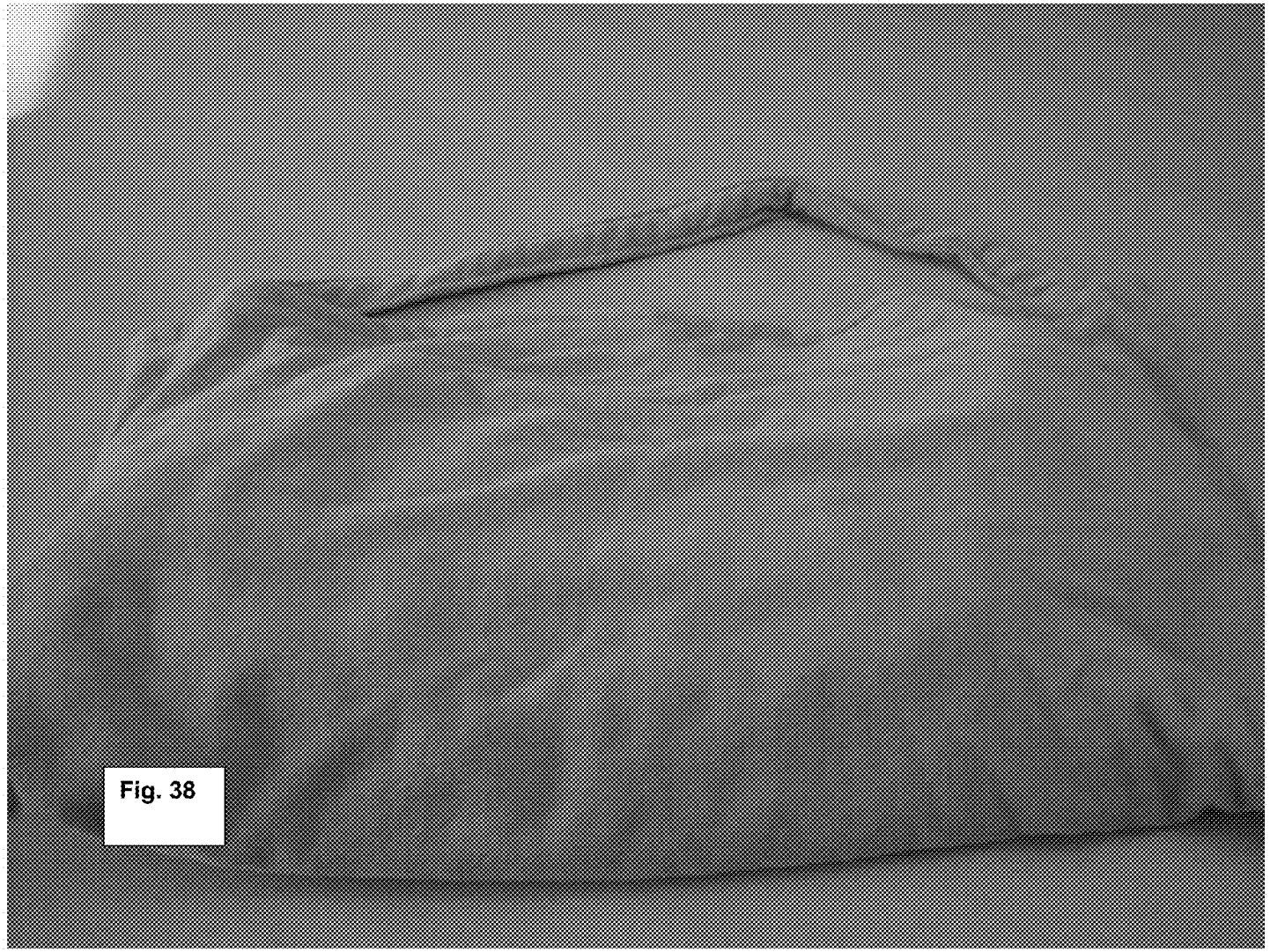
FIGS. 38 and 39 show an exemplary beach chair cover according to an exemplary embodiment of the present invention lying on a table.
Figure 39:
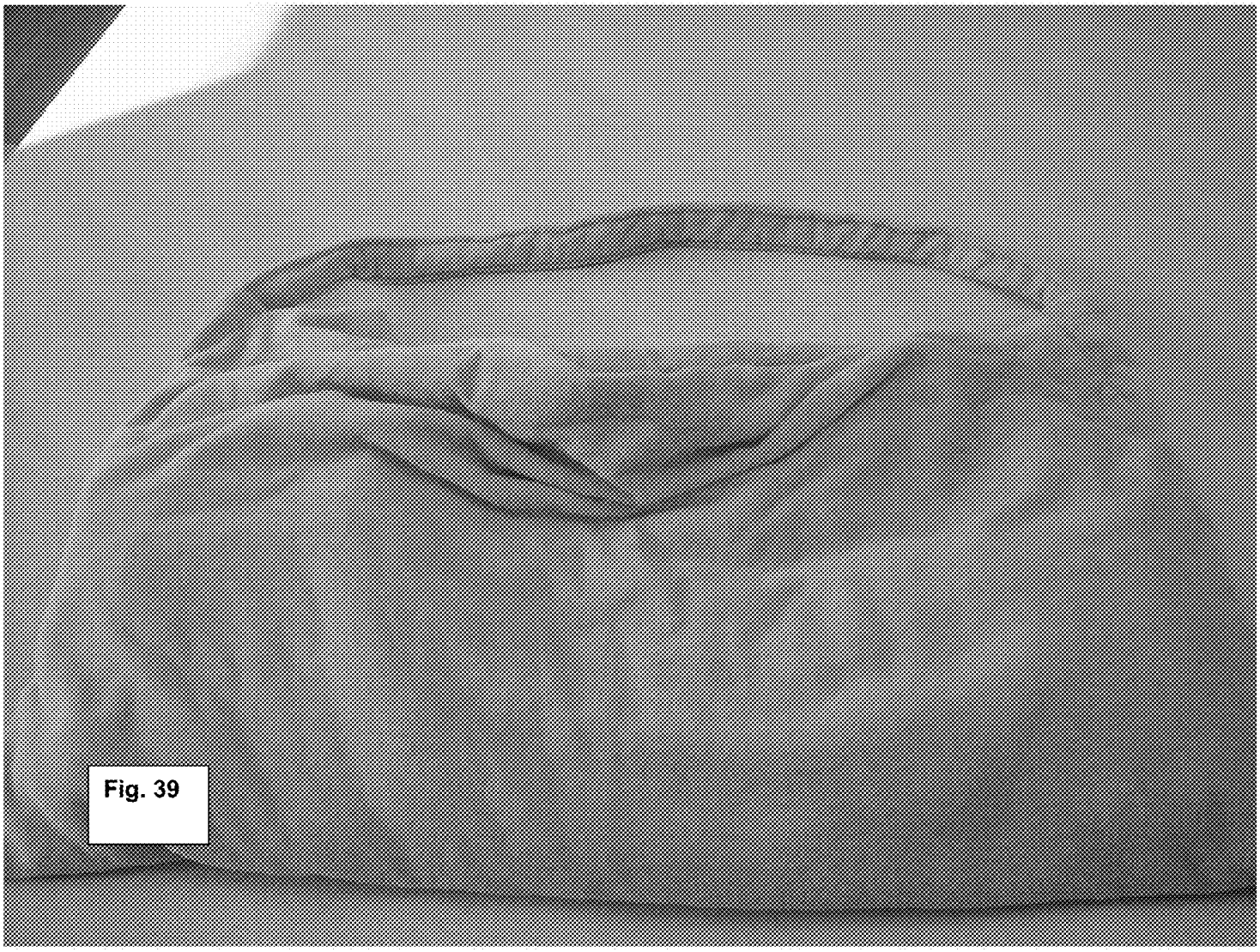
Figure 40:
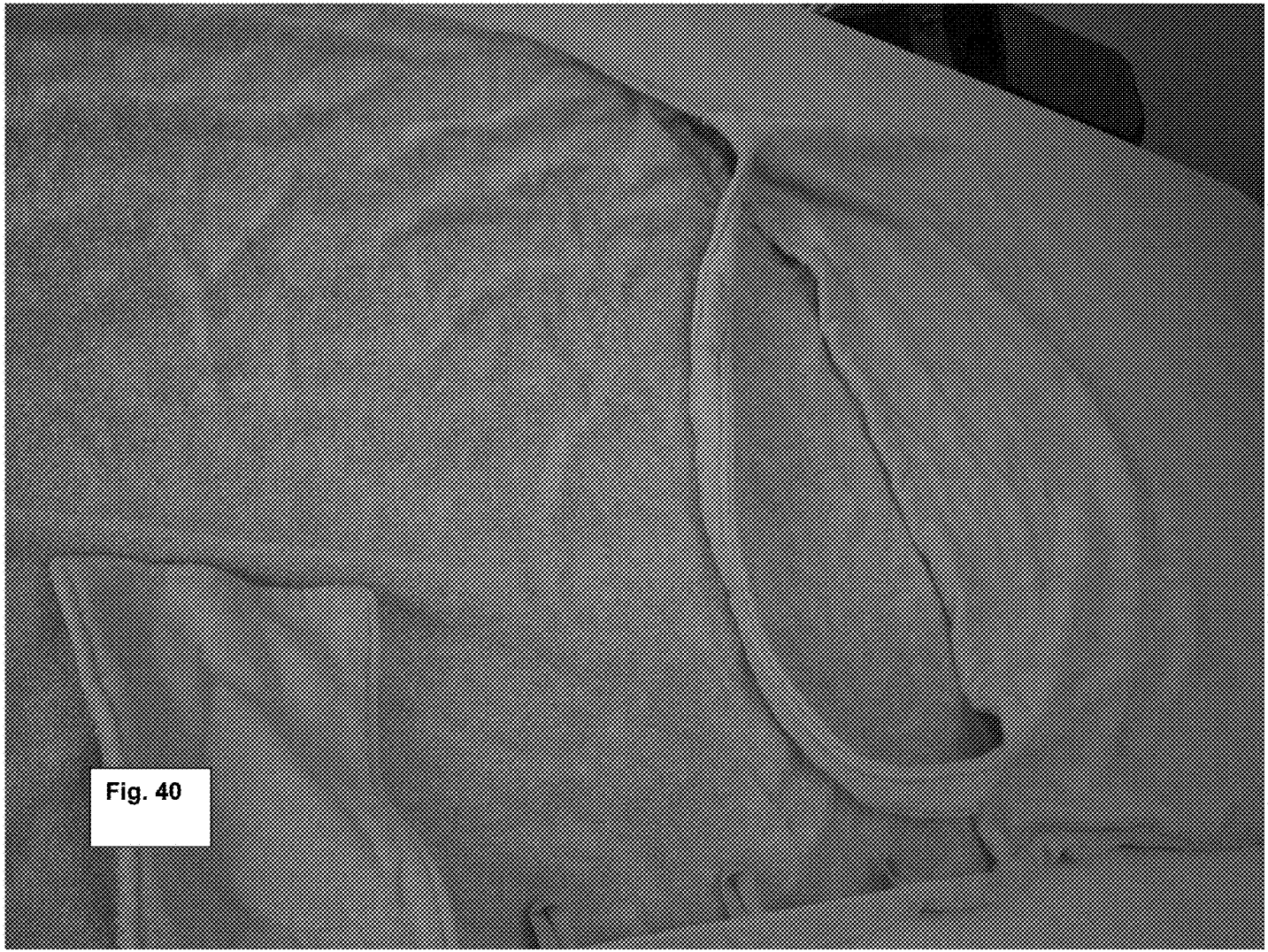
FIGS. 40-52 all depict views of the underside of an exemplary beach chair cover according to an exemplary embodiment of the present invention.
Figure 41:
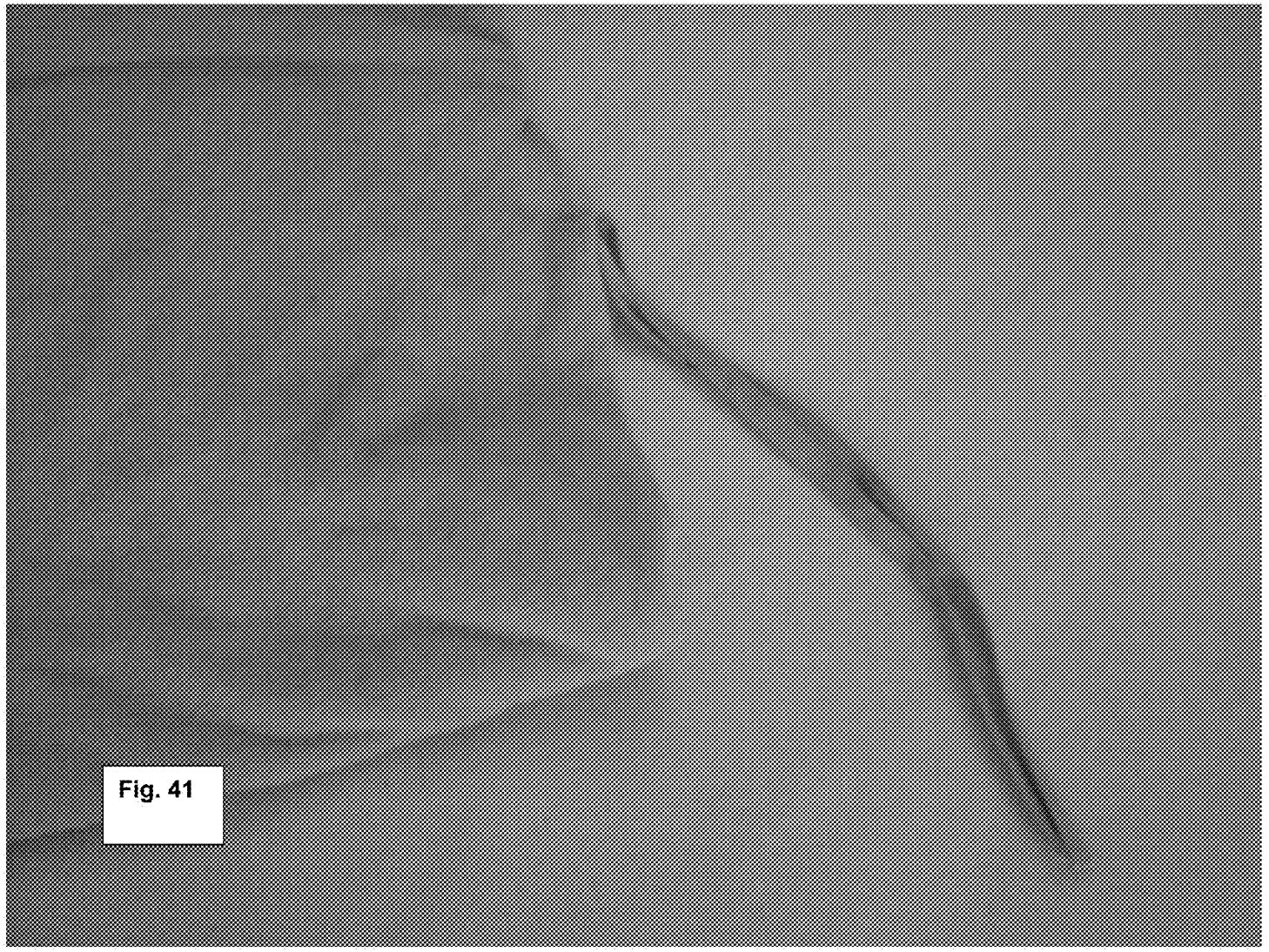
Figure 42:
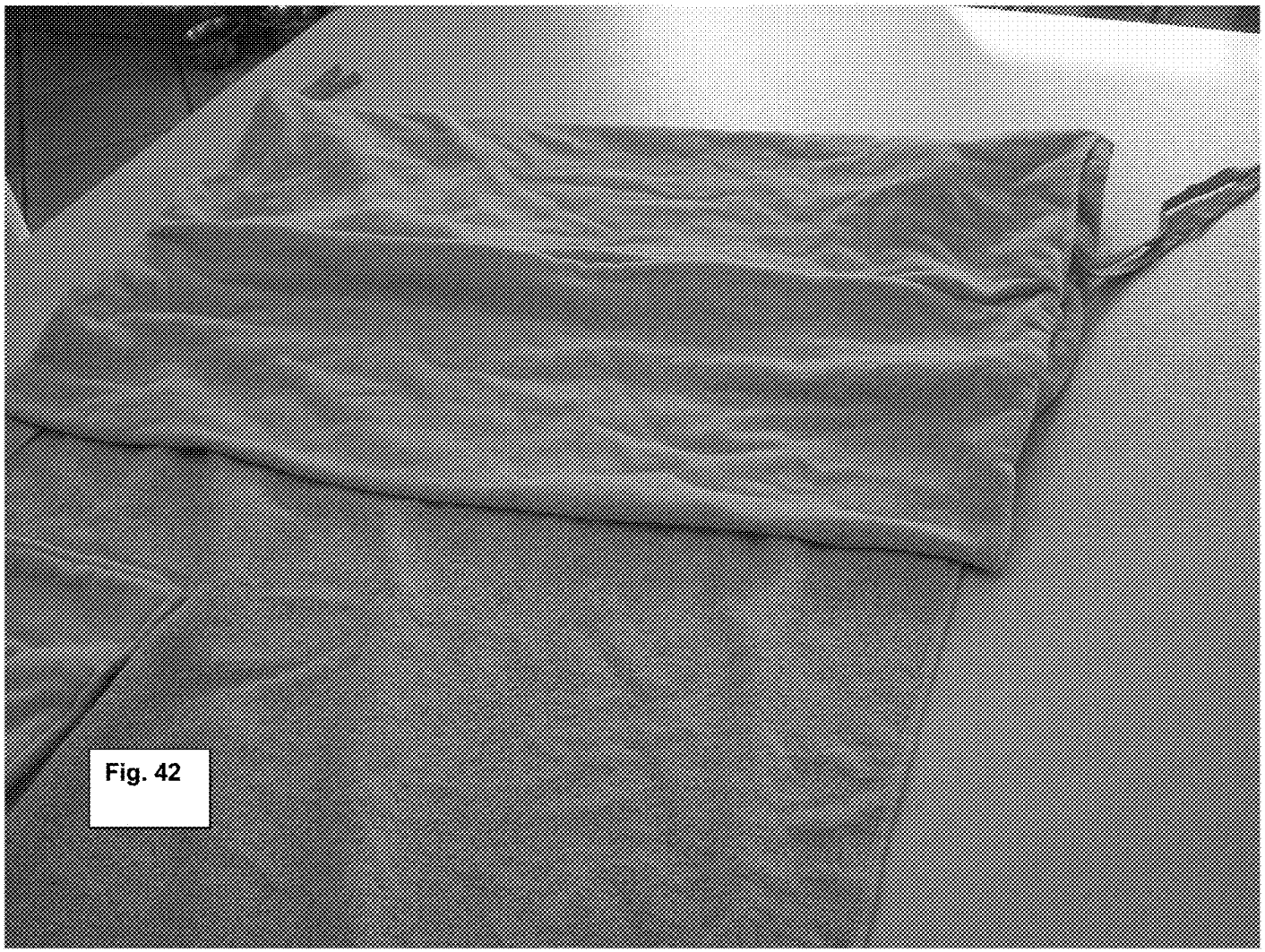

Finally, FIGS. 34-35 are other views of the exemplary beach chair cover of FIGS. 31-33, and FIGS. 36-37 depict a fully folded up exemplary beach chair cover slung around the shoulder of a young lady as she walks away from the beach chair venue.

FIG. 60 depicts an exemplary draft product information sheet for a portable beach chair cover according to an exemplary embodiment of the present invention. It is noted that the information sheet was created using a proposed descriptor called "itsa." FIG. 60 contains explanations and illustrations of various features of an exemplary portable beach chair cover according to an exemplary embodiment of the present invention. One of these is a foot protector, being a pouch at or near the footward edge of an exemplary beach chair cover, as shown in FIG. 60. Such a foot protector allows a user to insert their feet into the foot protector and feel "cozy" if the wind should pick up of they feel a bit cold, for example.

Additionally, in exemplary embodiments of the present invention, a beach chair cover can be provided with a zipper the runs across its entire width. The zipper placement can be, for example, right above (i.e., headward of) the two double or triple pockets on both sides as described above. Such a zipper can separate an exemplary beach chair cover into two pieces, being, for example, an upper portion and a lower portion, so that both pieces are functional on the lounge chair either separately or together. Thus, for example, if a user so chooses, he or she may use only the top half of the cover, with the iPOD pockets etc., and can thus be able to detach the bottom half and leave it behind.

FIG. 61 depicts an exemplary embodiment of the present invention sized to fit a standard "sitting up" type chair. Such a cover can have for example, dimensions of 26"×68" overall (including a 14" foldover portion which hangs down on the top of the back of the chair), with a tote bag depth of 14", for example, with foot protector dimensions of, for example, 10"×26", and with pockets of width 7" and depth of 9", all as shown. Alternatively, various other desirable dimensions and features can be used, as may be useful or appropriate. For such a shorter version of the chair cover, such as is depicted in FIG. 61, the loops for holding wires coming from electronic devices, such as an iPOD or the like, can be placed somewhat higher (headward) on the cover than they are on a longer type beach chair cover such as is illustrated in FIGS. 1-60.

While the present invention has been described with reference to one or more exemplary embodiments thereof, it is not to be limited thereto and the appended claims are intended to be construed to encompass not only the specific forms and variants of the invention shown, but to further encompass such as may be devised by those skilled in the art without departing from the true scope of the invention.

What is claimed:

1. A portable beach chair cover, comprising:

a slip-over pouch on a headward portion;

a handle attached to the beach chair cover adjacent to the slip-over pouch;

a zipper provided across a width of the cover, such that the cover can be separated into two parts, said two parts comprising a towel portion and a closable pouch portion; and a hidden closable pouch under a footward portion, wherein the portion of the beach chair cover not comprising the slip-over pouch can be inserted into the slip-over pouch and the pouch carried by the handle, and wherein, in operation, with the beach chair cover inserted into it, said pouch comprises a tote bag for various objects, and said handle comprises a shoulder strap by which the tote can be transported.

2. The beach chair cover of claim 1, further comprising an opening in the headward portion into which a pillow can be inserted.

3. The beach chair cover of claim 2, further comprising a waterproof pillow inserted into said opening.

4. The beach chair cover of claim 3, wherein the pillow is inflatable, and further comprising a pump or an automatic inflation device for the pillow.

5. The beach chair cover of claim 1, wherein the beach chair cover is made from a water absorbent material, and can double as a beach towel.

6. The beach chair cover of claim 1, further comprising one or more side pockets attached to an underside of the beach chair cover on at least one of its sides.

7. The beach chair cover of claim 6, wherein the one or more side pockets are each one of open, closable and closable with affixation means.

8. The beach chair cover of claim 6, wherein said side pockets are closable with at least one of ties, VELCRO® fasteners, hook and loop fasteners, and snaps.

9. The beach chair cover of claim 6, further comprising a set of loops, said set of loops attached to a side of the beach chair cover headward of a side pocket.

10. The beach chair cover of claim 9, wherein said loops are adapted to hold a cord attached to a device stored in a side pocket.

11. The beach chair cover of claim 6, wherein said side pockets can be arranged in groups of one, two, or three adjacent pockets, or any combination of same.

12. The beach chair cover of claim 6, further comprising one of a set of loops, a groove or a conduit, attached to a side of the beach chair cover, and arranged to hold one or more cords or wires attached to a device stored in a side pocket.

13. The beach chair cover of claim 1, wherein the hidden closable pouch can be closed using at least one of a zipper, a zipper with a lock, snaps, VELCRO®, ties, and fold over flap with a zipper, snaps, hook and loop fasteners, or VELCRO®.

14. The beach chair cover of claim 1, further comprising an elastic band sewn around at least a portion of the perimeter of said beach chair cover to further affix the beach chair cover to a beach chair.

15. The beach chair cover of claim 1, wherein said beach chair cover is washable.

16. The beach chair cover of claim 1, wherein said beach chair cover is made of one of cotton, a cotton-nylon blend, a cotton-polyester blend and terrycloth.

17. The beach chair cover of claim 1, wherein said beach chair cover is provided with a monogram visible on an outside of the slip-over pouch when said beach chair cover is completely folded and inserted into said slip-over pouch.

18. The beach chair cover of claim 1, further comprising a foot protector, being a pouch at or near a footward edge.

19. The beach chair cover of claim 1, further comprising one or more footward affixation devices to temporarily connect the footward portion of the beach chair cover to a chair or lounge.

20. The beach chair cover of claim 1, further comprising one of a set of loops, a groove or a conduit, attached to a side of the beach chair cover, and arranged to hold one or more cords or wires.

* * * * *